US006447970B1

(12) United States Patent
Matsunaga et al.

(10) Patent No.: US 6,447,970 B1
(45) Date of Patent: Sep. 10, 2002

(54) TONER CONTAINING ALUMINUM BENZILIC ACID COMPOUND AND IMAGE FORMING METHOD

(75) Inventors: Satoshi Matsunaga, Mishima; Manabu Ohno, Numazu; Koji Inaba, Odawara; Satoshi Handa, Shizuoka-ken; Ryota Kashiwabara, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/588,684

(22) Filed: Jun. 7, 2000

(30) Foreign Application Priority Data

| | | |
|---|---|---|
| Jun. 7, 1999 | (JP) | 11-158860 |
| Jun. 7, 1999 | (JP) | 11-158861 |
| Jun. 7, 1999 | (JP) | 11-158862 |
| May 24, 2000 | (JP) | 2000-152539 |

(51) Int. Cl.[7] ..... G03G 9/097

(52) U.S. Cl. ..... 430/108.3; 430/109.3; 430/109.4; 430/111.4; 430/124; 430/126

(58) Field of Search ..... 430/109, 110, 430/124, 126, 109.3, 109.4, 111.4, 108.3, 106.1

(56) References Cited

U.S. PATENT DOCUMENTS

| | | | | |
|---|---|---|---|---|
| 2,297,691 A | | 10/1942 | Carlson | 95/5 |
| 5,605,778 A | | 2/1997 | Onuma et al. | 430/110 |
| 5,635,325 A | | 6/1997 | Inaba et al. | 430/106 |
| 5,741,617 A | | 4/1998 | Inaba et al. | 430/110 |
| 5,744,276 A | | 4/1998 | Ohno et al. | 430/109 |
| 5,747,209 A | | 5/1998 | Takiguchi et al. | 430/106.6 |
| 5,750,303 A | | 5/1998 | Inaba et al. | 430/110 |
| 5,840,459 A | | 11/1998 | Ohno et al. | 430/11 |
| 5,948,584 A | | 9/1999 | Hashimoto et al. | 430/110 |
| 5,976,752 A | | 11/1999 | Matsunaga et al. | 430/110 |
| 5,998,080 A | | 12/1999 | Ohno et al. | 430/110 |
| 6,017,670 A | * | 1/2000 | Hashizume et al. | 430/109 |
| 6,090,515 A | | 7/2000 | Tomiyama et al. | 430/106 |
| 6,096,468 A | | 8/2000 | Ohno et al. | 430/110 |

FOREIGN PATENT DOCUMENTS

| | | | |
|---|---|---|---|
| EP | 0609003 | | 8/1994 |
| EP | 0613059 | | 8/1994 |
| EP | 0800117 | | 10/1997 |
| JP | 42-23910 | | 11/1967 |
| JP | 43-24748 | | 10/1968 |
| JP | 62-63941 | | 3/1987 |
| JP | 2-221967 | | 9/1990 |
| JP | 3-39973 | | 2/1991 |
| JP | 5-72812 | | 3/1993 |
| JP | 5-165257 | | 7/1993 |
| JP | 6-214424 | | 8/1994 |
| JP | 6-301240 | | 10/1994 |
| JP | 10-312089 | | 11/1998 |
| JP | 2000-010345 A | * | 1/2000 |

* cited by examiner

*Primary Examiner*—Christopher Rodee
(74) *Attorney, Agent, or Firm*—Fitzpatrick, Cella, Harper & Scinto

(57) ABSTRACT

A toner contains at least a binder resin, a colorant, a wax and an aluminum compound, wherein the binder resin has an acid value of 1 to 40 mgKOH/g; the binder resin contains 2% to 50% by weight of tetrahydrofuran (THF) based on the weight of the binder resin; a tetrahydrofuran-soluble matter of the binder resin has a main peak in a molecular weight range of from 2,000 to 30,000 in a chromatogram by gel permeation chromatography (GPC); and the aluminum compound is a specific aluminum compound of substituted or unsubstituted benzilic acid.

58 Claims, 7 Drawing Sheets

TONER CONTAINING ALUMINUM BENZILIC ACID COMPOUND AND IMAGE FORMING METHOD

FIELD OF THE INVENTION AND RELATED BACKGROUND ART

The present invention relates to a toner used in a recording method using electrophotography, electrostatic recording, electrostatic printing, toner-jet recording, and the like.

As electrophotography, a number of methods have been known such as those disclosed in U.S. Pat. No. 2,297,691, and Japanese Patent Publication Nos. 42-23910, and 43-24748. In general, an electrostatically charged image is formed on a photosensitive member by various means, the electrostatically charged image is then developed using a toner, the toner image is transferred on a transferring material such as paper, and is fixed by applying heat and/or pressure, or exposing to solvent vapor to form a toner image.

Although various methods and equipment have been developed for the final step described above, i.e. the fixation of toner images onto a sheet such as paper, a method most generally used today is the hot-pressing method using a stationary heater through hot rollers or heating films.

In the hot-pressing method using hot rollers, a sheet carrying toner images is passed between the hot rollers having surfaces to which the toner is not adhered while allowing the surface of the rollers to contact with the toner image surface of the sheet under a pressure. By this method, since the surface of the hot rollers contacts with the toner images on the sheet under a pressure, the thermal efficiency in the fusion of the toner onto the sheet is very high, and the images can be fixed promptly.

In the hot-rolling method, however, since the surfaces of the heating rollers contact with softened or molten toner images under a pressure, a part of the toner images is adhered and transferred onto the surfaces of the fixing rollers, and then transferred to the sheet again, often causing the contamination of the sheet, known as the offset phenomenon. This offset phenomenon is significantly affected by the speed and temperature for fixation. In general, when the fixation speed is low, the surface temperature of the heating rollers is set relatively low; and when the fixation speed is high, the surface temperature of the heating rollers is set relatively high. This is done such that the amount of heat provided from the hot rollers to the toner is made substantially constant regardless of the fixing speed.

The toner on the sheet forms a number of toner layers. If the fixing speed is high, and the surface temperature of the hot rollers is high, the temperature difference between the toner layer contacting with the hot rollers and the lowermost toner layer contacting with the sheet is large. If the surface temperature of the hot rollers is high, the uppermost toner layer is excessively softened or melted to cause the offset phenomenon easily. If the surface temperature of the hot rollers is low, the lowermost toner layer is not melted sufficiently for fixation, often causing a phenomenon in which the toner not to fix on the sheet, known as cold offset.

In order to solve such problems, when the fixing speed is high, a method for anchoring the toner into the sheet by elevating the pressure for fixation is generally used. In this method, the roller temperature can be lowered to some extent, and the hot offset phenomenon of the toner can be prevented. However, since the shearing force applied to the toner becomes very large, the sheet is wound around the fixing roller to cause winding offset, or when a separating blade is used for separating the sheet from the fixing rollers, the trace of the separating blade often appears on the fixed images. Furthermore, because of a high pressure, line images are often defaced during fixing, or the toner is often scattered, causing the degradation of fixed images.

The toner for forming electrostatic images must have positive or negative charge depending on the polarity of the electrostatic images to be developed and the method of developing, To make the toner charged, the frictional chargeability of the resin that is a component of the toner can be used, but the chargeability of the resin is generally low. Therefore, to impart desired frictional chargeability to the resin, a dye and/or a pigment for imparting chargeability, or further a charge-controlling agent is added to the toner.

The known charge-controlling agents for positive frictional chargeability include nigrosine dyes, azine dyes, copper phthalocyanine pigments, quaternary ammonium salts, or polymers having quaternary ammonium salts on the side chains. The known charge-controlling agents for negative frictional chargeability include the metal complex salts of monoazo dyes; the metal complexes or metal salts of salicylic acid, naphthoic acid, dicarboxylic acids, or the derivatives thereof; or resins having acid groups.

Among these, colorless, white, or light color agents are useful as the charge-controlling agent for color toners.

Heretofore, toners containing a metal compound of an oxycarboxylic acid have been proposed. For example, toners containing aluminum compound of aromatic oxycarboxylic acid as charge promoting additives are disclosed in Japanese Patent Application Laid-Open No. 6-214424; toners containing the boron compound of benzilic acid are disclosed in Japanese Patent Application Laid-Open Nos. 62-63941, 2-221967, 3-39973, and 5-72812; a color toner containing a boron complex salt of benzilic acid and silicone-oil-treated hydrophobic inorganic fine powder is disclosed in Japanese Patent Application Laid-Open No. 5-165257; and a toner containing a metal complex salt of benzilic acid having an amide as the counter ion is disclosed in Japanese Patent Application Laid-Open No. 6-301240. However, although these toners have somewhat improved charge speed, they have a disadvantage in that the frictional charging of the toner is insufficient. To solve the above-described problems, Japanese Patent Application Laid-Open No. 10-312089 discloses a toner using the combination of a boron complex salt of benzilic acid and a metal salt of a derivative of salicylic acid. According to examinations by the inventors of the present invention, although the combination use of a boron complex salt of benzilic acid and a metal salt of a derivative of salicylic acid improves the frictional charging of the toner and the charge speed of the toner, the distribution of the toner's frictional charging becomes broad due to the mixed presence of charge-controlling agents having different electrification series, and improvement is still required.

Also, there are problems related to the dispersion of various additives used in the manufacture of the toner. In particular, wax is difficult to disperse uniformly, and if dispersion is not uniform, there are problems not only in the fixation properties of the toner, but also in developing properties. These problems are even more significant due to the recent particle-size reduction.

SUMMARY OF THE INVENTION

The present invention provides a toner without the above-described problems.

Therefore, it is an object of the present invention to provide a toner that has good fixing properties at low temperatures in both medium- to high-speed machines using hot fixing rollers, and medium- to low-speed machines of the hot-pressing fixation method using stationary heaters through heat-resistant films, without the contamination of heating members due to offset from a low temperature to a high temperature.

It is another object of the present invention to provide a toner that excels in good fixing properties at low temperatures and exhibits good half-tone fixing properties while its particle diameter is reduced and its high colorant (particularly magnetic material) content is increased.

It is a further object of the present invention to provide a toner that excels in frictional charging and charge speed, maintains good environmental stability, and can form high-quality images for a long period of time.

According to an aspect of the present invention, there is provided a toner containing at least a binder resin, a colorant, a wax, and an organic aluminum compound, wherein, i) the binder resin has an acid value of 1 to 40 mgKOH/g, ii) the binder resin contains 2 to 50 percent by weight of tetrahydrofuran (THF)-insoluble matter based on the weight of the binder resin, iii) the tetrahydrofuran-soluble matter of said binder resin has a main peak in the molecular weight range of from 2,000 to 30,000 in a chromatogram by gel permeation chromatography (GPC), and iv) the organic aluminum compound is an aluminum compound of substituted or unsubstituted benzilic acid represented by the following Formula (1):

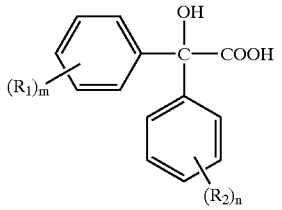

wherein $R_1$ and $R_2$ may be the same or different and each represents a substituent selected from the group consisting of straight-chain or branched alkyl, alkenyl, alkoxy, halogen, nitro, cyano, amino, carboxy, and hydroxy; and m and n each are an integer of from 0 to 5.

According to another aspect of the present invention, there is provided an image forming method, comprising at least (a) a charging step for charging an image carrier that carries electrostatic images (or an image bearing member);

(b) an exposing step for forming electrostatic images by exposure of the charged image carrier;

(c) a developing step for developing the electrostatic images with a toner carried on the surface of a toner carrier (or a toner carrying member) to form toner images;

(d) a transferring step for transferring the toner images formed on the surface of the image carrier onto a transfer material via or not via an intermediate transfer member; and (e) a fixing step for fixing the transferred toner images to the transfer material; wherein the toner contains at least a binder resin, a colorant, a wax, and an organic aluminum compound, i) the binder resin has an acid value of 1 to 40 mgKOH/g, ii) the binder resin contains 2 to 50 percent by weight of tetrahydrofuran (THF)-insoluble matter based on the weight of the binder resin, iii) the tetrahydrofuran-soluble matter of the binder resin has a main peak in the molecular weight range of from 2,000 to 30,000 in a chromatogram by gel permeation chromatography (GPC), and iv) the organic aluminum compound is an aluminum compound of substituted or unsubstituted benzlic acid represented by the above Formula (1).

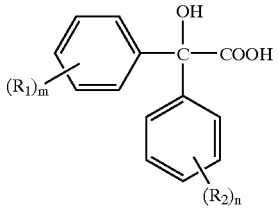

DETAILED DESCRIPTION OF THE PREFERRED EMBODIMENTS

Figure 1:
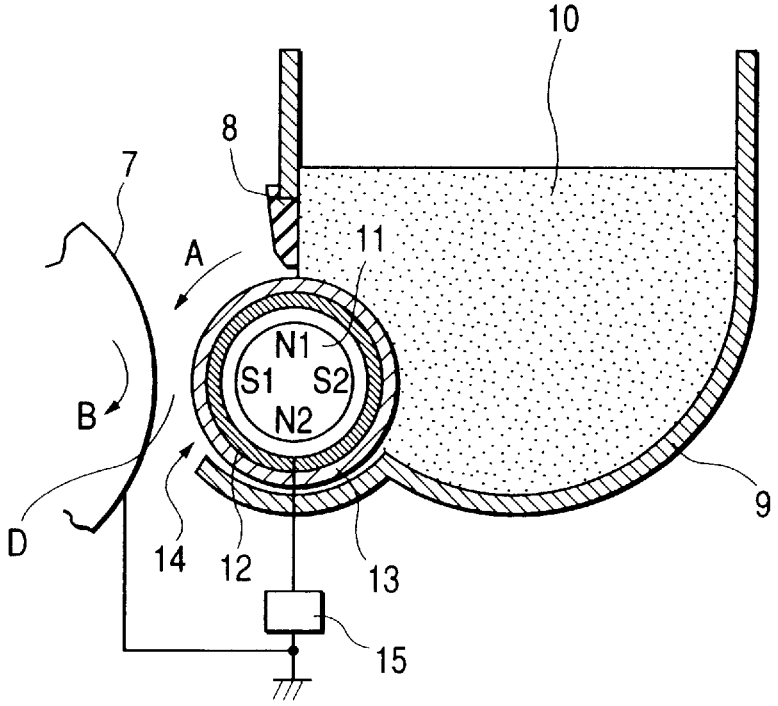
FIG. 1 is a schematic diagram illustrating an example of a developer-supplying developing unit in which a developer carrier (or a developer carrying member) is incorporated (using a magnetic blade as regulating means)

The inventors of the present invention carried out repeated examinations, and found that in order to prevent a fixing member from contamination due to offset without heating the fixing member, only the improvement of the fixing properties of a toner at low temperature and of the resistance to high temperature offset is insufficient, and that the improvement in the releasability of the toner from the fixing member is critical.

Heretofore, the inhibition of the offset phenomenon of a toner has been considered to be the same as the improvement of the fixing properties of the toner. However, there is a limit in the inhibition of the offset phenomenon ascribable to the improvement of fixing properties by improving wax or the like contained in the toner, and this is insufficient.

Also, when the releasability of the toner is insufficient even if the releasability of the fixing member and the cleaning member, the sufficient effect on prevention of offset effect can be expected in the initial stage of using these members, but each member may be aged and degraded, and eventually offset may occur when used over a long period of time.

Heretofore, the binder resin of the toner that contains components insoluble to organic solvents such as chloroform and THF has been proposed from the point of view of improving the resistance to hot offset of the toner. However, even such a toner may not exhibit a sufficient offset prevention effect on the aged and degraded fixing member or the cleaning member. Also, some toners contain wax imparting releasability to the toner, but a large quantity of wax must be added for maintaining a sufficient offset prevention effect on the aged and degraded fixing member or cleaning member. This may cause problems in developing properties of the toner, i.e., the lowering of image density by enduring operation or increase in fog density. Furthermore, the dispersion of wax contained in toner particles is difficult to control, and the toner comes to contain a large quantity of liberated wax. As a result, the toner on the photosensitive member cannot be removed completely, and defective images may be formed.

In order to maintain a sufficient offset prevention effect on the aged and degraded fixing member or cleaning member, the improvement of the releasability of the toner must be compatible with the developing properties of the toner.

According to the inventors of the present invention, the object of the present invention is achieved by the toner which has a specific acid value, contains a specific THF-insoluble matter, and contains a specific molecular-weight component, and in which the THF-soluble matter of the binder resin of the toner has a main peak at the specific molecular-weight region.

In the toner of the present invention, the acid value of the binder resin may be 1 to 40 mgKOH/g, preferably 2 to 40 mgKOH/g. Furthermore, when the binder resin is a polyester-based resin, or a resin that contains a hybrid resin component having polyester units and vinyl polymer units, its acid value is preferably 5 to 35 mgKOH/g, more preferably 10 to 30 mgKOH/g. Also when the binder resin is a vinyl-polymer-based resin, its acid value is preferably 2 to 30 mgKOH/g, more preferably 5 to 20 mgKOH/g. In the toner that contains aluminum benzilate as the charge-controlling agent, if the acid value of the binder resin is less than 1 mgKOH/g, or exceeds 40 mgKOH/g, the dispersion of the aluminum compound is not always satisfactory, and the image density may be lowered due to enduring operation.

In the toner of the present invention, the binder resin contained in the toner must contain 2 to 50 percent by weight of THF-insoluble matters. In the toner that contains aluminum benzilate as the charge-controlling agent, if the THF-insoluble matters contained in the binder resin of the toner is either less than 2 percent by weight or more than 50 percent by weight, the dispersion of wax contained in the toner is not always satisfactory, and the adhesion of the toner to the fixing member may become trangible due to enduring operation.

When the binder resin is a polyester-based resin, or a resin that contains a hybrid resin component having polyester units and vinyl polymer units, the binder resin contains preferably 5 to 40 percent by weight, more preferably 7 to 30 percent by weight of THF-insoluble matters.

When the binder resin is a vinyl-polymer-based resin, the binder resin contains preferably 3 to 50 percent by weight, more preferably 5 to 30 percent by weight of THF-insoluble matters.

In the toner of the present invention, the binder resin must have the main peak at the region of a molecular weight between 2,000 and 30,000. If the binder resin does not have the main peak at the region of a molecular weight between 2,000 and 30,000, either the hot-offset resistance, blocking resistance, or low-temperature fixing properties of the toner will become deteriorated.

When the binder resin is a polyester-based resin, the binder resin has the main peak preferably at the region of a molecular weight between 2,000 and 15,000, more preferably between 4,000 and 12,000, and most preferably between 6,000 and 10,000.

When the binder resin is a resin that contains hybrid resin components having polyester units and vinyl polymer units, the binder resin has the main peak preferably at the region of a molecular weight between 2,000 and 15,000, more preferably between 3,000 and 10,000, and most preferably between 4,000 and 9,000.

Furthermore, when the binder resin is a vinyl-polymer-based resin, the binder resin has the main peak preferably at the region of a molecular weight between 5,000 and 30,000, more preferably between 7,000 and 25,000, and most preferably between 9,000 and 20,000.

In the toner of the present invention, when the binder resin contained in the toner is a polyester-based resin, the THF-soluble matters of the binder resin contains components of a molecular weight of 100,000 or more and less than 10,000,000, in a quantity preferably 5 to 30 percent by weight, more preferably 7 to 27 percent by weight, and most preferably 10 to 25 percent by weight. When the binder resin is a resin that contains hybrid resin components having polyester units and vinyl polymer units, the THF-soluble matters of the binder resin contains components of the above-described molecular weight in a quantity preferably 5 to 40 percent by weight, more preferably 7 to 35 percent by weight, and most preferably 10 to 30 percent by weight. If the THF-soluble matters of the binder resin contains components of the above-described molecular weight in an amount less than the lower limit in each resin, the toner may have poor hot-offset resistance; if the THF-soluble matters of the binder resin contains components of the above-described molecular weight in an amount more than the upper limit in each resin, the low-temperature fixing properties of the toner may be lowered.

In the toner of the present invention, when the binder resin contained in the toner is a polyester-based resin, the THF-soluble matters of the binder resin contains components of a molecular weight of 5,000 or more and less than 100,000, in a quantity preferably 50 to 80 percent by weight, more preferably 52 to 78 percent by weight, and most preferably 55 to 75 percent by weight. When the binder resin is a resin that contains hybrid resin components having polyester units and vinyl polymer units, the THF-soluble matters of the binder resin contains components of the above-described molecular weight in a quantity preferably 40 to 70 percent by weight, more preferably 42 to 68 percent by weight, and most preferably 45 to 65 percent by weight. If the THF-soluble matters of the binder resin contains components of the above-described molecular weight in an amount less than the lower limit in each resin, the dispersion of the aluminum compound of benzilic acid contained in the toner is not always satisfactory, and the image density may be lowered due to enduring operation.

When the binder resin contained in the toner is a polyester-based resin, or a resin that contains hybrid resin components having polyester units and vinyl polymer units, the THF-soluble matters of the binder resin contains components of a molecular weight of 1,000 or more and less than 5,000, in a quantity preferably 10 to 30 percent by weight, more preferably 12 to 28 percent by weight, and most preferably 15 to 25 percent by weight. If the THF-soluble matters of the binder resin contains components of the above-described molecular weight in an amount less than 10 percent by weight, the low-temperature fixing properties of the toner may by lowered; if the THF-soluble matters of the binder resin contains components of the above-described molecular weight in an amount more than 30 percent by weight, the toner may have poor blocking resistance.

When the binder resin contained in the toner is a vinyl-polymer-based resin, the THF-soluble matters of the binder resin have at least one sub-peak and/or shoulder preferably in the region of a molecular weight between 200,000 and 1,500,000, and more preferably in the region of a molecular weight between 300,000 and 1,200,000, and most preferably in the range of a molecular weight between 400,000 and 1,000,000. If the THF-soluble matters of the binder resin has neither sub-peak nor shoulder, the low-temperature fixing properties of the toner may not be able to be compatible with hot-offset resistance.

In the toner of the present invention, the dielectric dissipation factor (tan δ) of the toner measured at a frequency of 100 kHz is preferably between $1\times10^{-3}$ and $3\times10^{-2}$. If the dielectric dissipation factor of the toner is less than $1\times10^{-3}$, problems arise easily on the image density stability of the toner at normal temperature and low humidity, and if the dielectric dissipation factor is more than $3\times10^{-2}$, problems arise easily on the image density stability of the toner under the environment of high temperature and high humidity as well as normal temperature and normal humidity.

When the binder resin contained in the toner is a polyester-based resin, the dielectric dissipation factor of the toner is preferably between $5\times10^{-3}$ and $3\times10^{-2}$, more preferably between $7\times10^{-3}$ and $2\times10^{-2}$, and most preferably between $8\times10^{-3}$ and $1.5\times10^{-2}$.

When the binder resin contained in the toner is a resin that contains hybrid resin components having polyester units and vinyl polymer units, the dielectric dissipation factor of the toner is preferably between $3\times10^{-3}$ and $3\times10^{-2}$, more preferably between $4\times10^{-3}$ and $2\times10^{-2}$, and most preferably between $5\times10^{-3}$ and $1.5\times10^{-2}$.

When the binder resin contained in the toner is a vinyl-polymer-based resin, the dielectric dissipation factor of the toner is preferably between $1\times10^{-3}$ and $2\times10^{-2}$, more preferably between $3\times10^{-3}$ and $1.5\times10^{-2}$, and most preferably between $5\times10^{-3}$ and $1\times10^{-2}$.

In the toner of the present invention, the contact angle of the toner to water is 105 to 130 degrees, preferably 107 to 127 degrees, and more preferably 110 to 125 degrees. If the contact angle of the toner to water is less than 105 degrees, it may become difficult to maintain the sufficient offset prevention effect on the fixing member and the cleaning member degraded with enduring operation, and if the contact angle of the toner to water exceeds 130 degrees, the problems of the developing properties of the toner and the cleaning properties of the toner remaining on the photosensitive member may occur, which is not preferable.

Wax contained in the toner of the present invention has preferably a main peak molecular weight (Mp) of 500 to 20,000 measured by GPC and ratio (Mw/Mn) of weight average molecular weight (Mw) to number average molecular weight (Mn) of 1.0 to 20, more preferably Mp of 600 to 15,000 and ratio (Mw/Mn) of 1.1 to 18, and further more preferably Mp of 700 to 10,000 and ratio (Mw/Mn) of 1.2 to 10. The size of dispersed particles of wax in toner particles is too small if Mp is less than 500 and the ratio (Mw/Mn) is less than 1.0, and the size of dispersed particles of wax is too large if Mp is more than 20,000 or the ratio (Mw/Mn) is more than 20, and in both of the cases, it is difficult to control the size of the dispersed wax articles, which is not preferable.

In the toner of the present invention, two different types of wax may be contained, and in this case Mp measured by GPC may be 500 to 20,000 and the ratio (Mw/Mn) may be 1.2 to 25 although preferable is the case where Mp is 700 to 15,000 and the ratio (Mw/Mn) is 1.5 to 22, and further more preferable is the case where Mp is 1200 to 10,000 and ratio (Mw/Mn) is 2 to 20. In both of the case where Mp is less than 500 and the ratio (Mw/Mn) is less than 1.2 and the case where Mp is more than 20,000 and the ratio (Mw/Mn) is more than 25, the particle size distribution of wax in toner particles becomes wider and the control thereof is difficult, which is not preferable.

Wax contained in the toner of the present invention is preferably selected from ester wax, hydrocarbon wax, polyethylene wax, or polypropylene wax, and particularly preferable is hydrocarbon wax, polyethylene wax or polypropylene wax.

Preferably, wax contained in the toner of the present invention is synthetic hydrocarbon obtained from the distillation residue obtained by the Arge method that uses carbon monoxide and hydrogen as raw materials, or wax obtained by hydrogenation of these substances. Furthermore, wax for which fractionation of hydrocarbon wax has been applied through press sweating, solvent processing, utilization of vacuum distillation and fractional crystallization is more preferably used.

Wax contained in the toner of the present invention has a structure that can be represented by formula (2).

$$CH_3\text{-}(CH_2\text{—}CH_2)_a CH_2\text{—}CH_2\text{—}A$$

In this formula, A represents a hydroxyl group or a carboxyl group and a represents an integer of from 20 to 60, but preferable is the case where A represents a hydroxyl group and a represents an integer of from 30 to 50.

In the case where the wax contained in the toner of the present invention is acid-modified polyethylene, it has an acid value of 1 to 20 mgKOH/g with the polyethylene being modified using at least one acid monomer selected from maleic acid, maleic half ester and maleic anhydride, and the wax has preferably an acid value of 1.5 to 15 mgKOH/g.

In the case where the wax contained in the toner of the present invention is acid-modified polypropylene, it has an acid value of 1 to 20 mgKOH/g with in the polyethylene being modified using at least one acid monomer selected from maleic acid, maleic half ester and maleic anhydride, and the wax has preferably acid value of 1.5 to 15 mgKOH/g.

In the case where two types of wax are contained in the toner of the present invention, at least one of them is one of the aforementioned types of wax.

Preferable combinations of wax in the case where two types of wax are contained in the toner of the present invention are shown in Table 1.

The wax contained in the toner of the present invention preferably has an endothermic main peak in the range of 40 to 140° C. in the DSC curve of the toner containing wax measured by a differential scanning calorimeter (DSC), more preferably has an endothermic main peak in the range of 70 to 140° C., further preferably has an endothermic main peak in the range of 75 to 135° C., and most preferably has an endothermic main peak in the range of 80 to 130° C. and at the same time has endothermic sub peaks or endothermic shoulders. If it has an endothermic main peak in a range other than those described above, it will be difficult to satisfy all of low temperature fixation, hot offset resistance and blocking resistance simultaneously.

The benzilic acid preferably used in the present invention is represented by the following Formula (1).

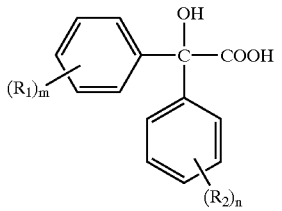

(In the formula shown above, $R_1$ and $R_2$ may be the same or different and each represents a substituent selected from the group consisting of straight-chain or branched alkyl, alkenyl, alkoxy, halogen, nitro, cyano, amino, carboxy and hydroxy, and m and n each represent an integer of from 0 to 5.)

Examples will be shown below, but the present invention should not be limited to these benzilic acids.

Formula (1-1)

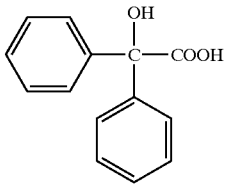

Formula (1-2)

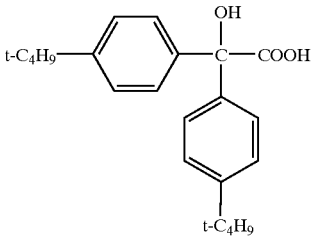

Formula (1-3)

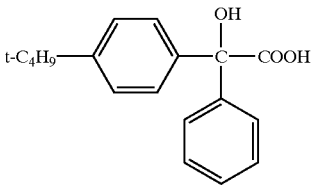

-continued

Formula (1-4)

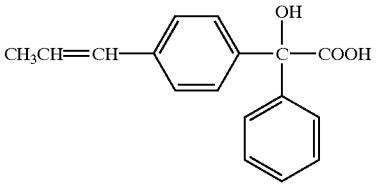

The structural formula of aluminum compounds of benzilic acid which are preferably used in the toner of the present invention will be shown below, but the present invention should not be limited to these compounds.

Formula (1-5)

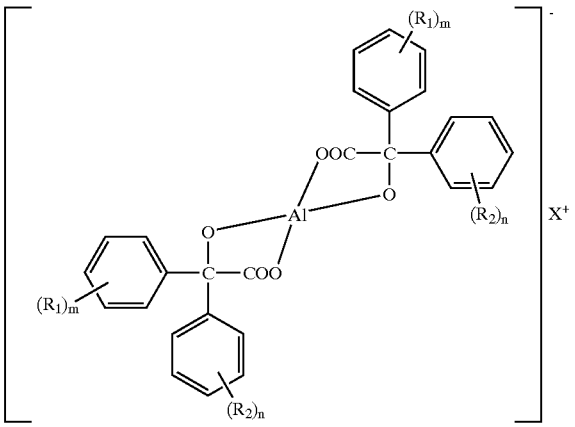

(In the formula shown above, X represents a monovalent cation, specifically an ion of hydrogen, lithium, sodium, potassium, ammonium and alkyl ammonium.)

Formula (1-6)

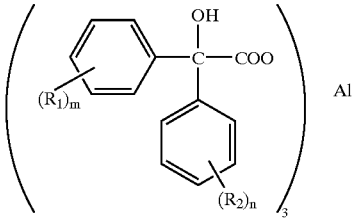

Examples of aluminum compounds of benzilic acid that are preferably used in the toner of the present invention will be shown, but the present invention should not be limited to these aluminum compounds of benzilic acid.

Compound (1)

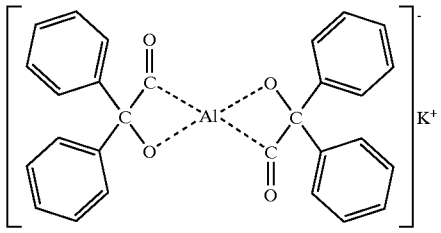

-continued

Compound (2)

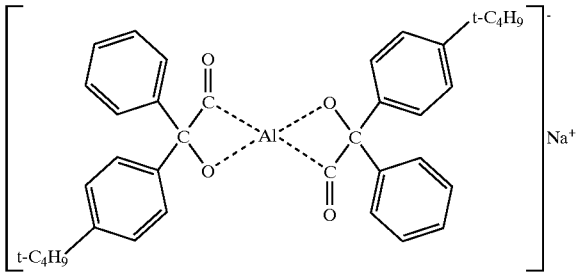

Compound (3)

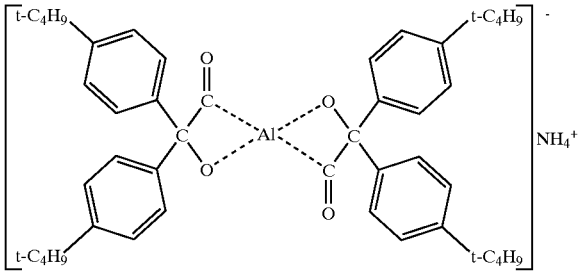

Compound (4)

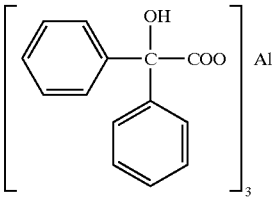

Compound (5)

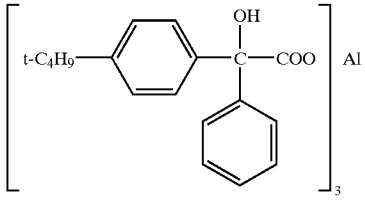

Compound (6)

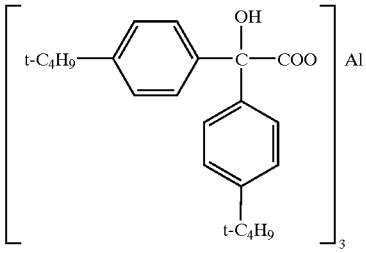

Aluminum compounds of benzilic acid preferably used in the toner of the present invention can be obtained, for example, by mixing a substituted or unsubstituted benzilic acid an aluminum salt such as aluminum sulfate ($Al_2(SO_4)_3$) in a desired mole ratio, heating and reacting the mixture in the presence of alkali, filtering and collecting the resulting precipitate, and further washing and drying it. However, the method of producing aluminum compounds of benzilic acid related to the present invention should not be limited to this.

Furthermore, since aluminum compounds of benzilic acid related to the present invention give good transparency, sharp images can be obtained when these compounds are used in color toners, which is very preferable.

The substituted or unsubstituted benzilic acids reacted with aluminum not only improve the frictional charge and charge speed of toner, but also maintain environmental stability and come to have charge controlling capability by which high quality images can be provide over a long period of time.

In the toner of the present invention, the content of the aluminum compound of benzilic acid contained as a charge controlling agent is preferably 0.1 to 5 percent by weight, more preferably 0.5 to 3 percent by weight, further preferably 0.7 to 2 percent by weight. If the content of the aluminum compound of benzilic acid in the toner is less than 0.1 percent by weight or more than 5 percent by weight, image density may decrease due to enduring operation, which is not preferable.

As a binder resin to be used in the toner of the present invention, any resin known as binder resin for toner may be used, but more preferable is a resin containing polyester as a main component, a resin containing a hybrid resin component having a polyester unit and a vinyl polymer unit, or a resin containing a vinyl polymer as a main component. In the present invention, the term "main component" means the component contained in an amount more than 50 percent by weight based on the entire binder resin.

In the toner of the present invention, in the case where a resin containing polyester as a main component is used as binder resin, polyester containing substantially no chloroform-insoluble matter or polyester containing a chloroform-insoluble matter of less than 10 percent by weight and polyester containing a chloroform-insoluble matter of 10 to 60 percent by weight are mixed preferably in the ratio of 2:8 to 8:2 by weight for use, more preferably they are mixed in the ratio of 3:7 to 7:3 by weight for use, and further more preferably they are mixed in the ratio of 4:6 to 6:4 by weight for use.

In the toner of the present invention, monomers of polyester include the following.

Alcoholic components include ethylene glycol, propylene glycol, 1,3-butanediol, 1,4-butanediol, 2,3-butanediol, diethylene glycol, triethylene glycol, 1-5-pentandiol, 1,6-hexanediol, neopentyl glycol, 2-ethyl 1,3-hexanediol, bisphenol hydride A, bisphenol derivatives represented by the following formula (3), and diols represented by the following formula (4).

Formula (3)

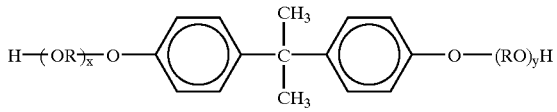

(In the formula shown above, R represents an ethylene or propylene group, each of x and y is an integer of one or more, and the average of x+y is 2 to 10.)

Formula (4)

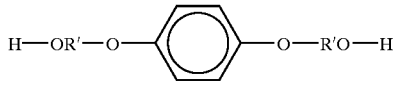

(In the formula shown above, R' represents

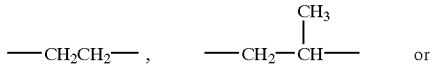

or

-continued

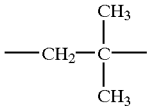

Acid components include aromatic dicaboxylic acids such as phtalic acid, isophthalic acid and terephthalic acid or their anhydrides; alkyl dicaboxylic acids such as succinic acid, adipic acid, sebacic acid and azelaic acid or their anhydrides; succinic acid substituted with an alkyl group having 6 to 12 carbon atoms or their anhydrides; unsaturated dicarboxylic acids such as fumalic acid, maleic acid and citraconic acid or their anhydrides.

The case will be described where the resin containing a hybrid resin component having a polyester unit and a vinyl polymer unit is used as a binder resin contained in the toner. The presence of the hybrid resin component can be identified by $^{13}$C-NMR measurement. In case of a magnetic toner containing a magnetic substance that may inhibit the resolving power of $^{13}$C-NMR spectrum, the magnetic substance is dissolved by adding the magnetic toner in a concentrated solution of hydrochloric acid and stirring at room temperature for 70 to 80 hours, and the resultant solution can be used as a sample for measurement. Furthermore, the toner containing carbon black and organic pigment can be used directly as a sample for measurement. One example of results of $^{13}$C-NMR measurement in the case where acrylic ester is used as a vinyl polymer will be shown in Table 2.

The measurement of $^{13}$C-NMR spectrum was carried out in the following conditions.

Measuring Apparatus: FT NMR apparatus (JNM-EX400 manufactured by Nippon Denshi Co.)

Frequency: 100.40 MHz

Pulse Condition: 5.0 $\mu$s

Data Point: 32768

Frequency Range: 10500 Hz

Integrated Times: 20000 times

Temperature: 40° C.

Sample: prepared by placing a sample being measured in a sample tube of a 10 mm diameter, adding $CDCl_3$ as a solvent, and dissolving the sample in a constant temperature bath at 40° C.

In the toner of the present invention, the hybrid resin component having a vinyl polymer unit and a polyester unit contained in a binder resin is formed by chemically bonding the polyester unit to the vinyl polymer unit which is formed by addition polymerization of an aromatic vinyl monomer and a (meta) acrylic ester monomer. In the polyester unit are contained an alcoholic component and/or carboxylic acid capable of controlling dispersion of wax.

Also, the hybrid resin component is produced through ester exchange reaction of (meta) acrylic ester and alcohol that is a monomer of polyester. For the aforesaid hybrid resin component, 10 to 60 mol % of (meta) acrylic ester constituting the vinyl polymer unit may participate in esterification reaction with the polyester unit, but preferably 15 to 50 mol % participates in the esterification reaction, and further preferably 20 to 45 mol % participates in the esterification reaction. If only less than 10 mol % of the (meta) acrylic ester constituting the vinyl polymer unit participates in the esterification reaction with the polyester unit, it is difficult to achieve an effect enough to control the dispersion condition of wax, and if more than 60 mol % participates in the esterification reaction, a component with a relatively high molecular weight is increased so that fixing properties at low temperature may be deteriorated, which is not preferable.

The composition of polyester unit constituting the hybrid resin composite and the vinyl polymer unit is preferably in the ratio of 30:70 to 90:10 by weight, more preferably 40:60 to 80:20, and further more preferably 50:50 to 70:30. If the content of the polyester unit forming the hybrid resin component is less than 30 percent by weight or more than 90 percent by weight, in either case, it is difficult to optimize the interaction of the hybrid resin component and the aluminum compound of benzilic acid, and it may be difficult to control the dispersion condition of wax, which is not preferable.

In the toner of the present invention, the aforesaid alcoholic components or acid components can be used directly as monomers forming the polyester unit.

The vinyl monomers forming the vinyl polymer unit include the following.

Styrene; styrene and its derivatives such as o-methylstyrene, m-methylstyrene, p-methylstylene, p-phenylstylene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-metoxystyrene, p-chlorostyrene, 3,4-dichlorostyrene, m-nitrostyrene, o-nitrostyrene and p-nitrostyrene; styrene unsaturated mono olefins such as ethylene, propylene, butylene and isobutylene; unsaturated polyenes such as butadiene and isoprene; vinyl halides such as vinyl chloride, vinyliden chloride, vinyl bromide and vinyl fluoride; vinyl esters such as vinyl acetate, vinyl propionate and vinyl benzoenate; a-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethylaminoethyl methacrylate and diethylaminoethyl methacrylate; acrylic esters such as methyl acrylate, ethyl acrylate, propyl acrylate, n-butyl acrylate, isobutyl acrylate, n-octyl acrylate, dodecyl acrylate, 2-ethyl hexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropyl ketone; N-vinyl compounds such as N-vinyl pyrrole, N-vinyl carbazole, N-vinyl indole and N-vinyl pyrolidone; vinyl naphthalenes; and acrylic or methacrylic acid derivatives such as acrylonitrile, methacrylonitrile and acrylamido are included.

Furthermore, unsaturated dibasic acids such as maleic acid, citraconic acid, itaconic acid, alkenyl succinic acid, fumaric acid and mesaconic acid; unsaturated dibasic acid anhydrates such as maleic acid anhydrate, citraconic acid anhydrate, itaconic acid anhydrate and alkenyl succinic acid anhydrate; half esters of unsaturated dibasic acid such as methyl maleate half ester, ethyl maleate half ester, butyl maleate half ester, methyl citraconate half ester, ethyl citraconate half ester, butyl citraconate half ester, methyl itaconate half ester, methyl alkenyl succinate half ester, methyl fumarate half ester and methyl mesaconate half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrates such as crotonic acid anhydrate and cinnamic acid anhydrate, and anhydrates of such α-β-unsaturated acids and lower fatty acids; and monomers having carboxyl groups such as alkenyl maronate, alkenyl glutarate, alkenyl adipate, their acid anhydrates and their monoesters are included.

Furthermore, acrylic or methacrylic esters such as 2-hydroxyethylacrylate, 2-hydroxyethylmethacrylate and 2-hydroxypropylmethacrylate; and monomers having hydroxy groups such as 4-(1-hydroxy-1-methylbutyl) styrene and 4-(1-hydroxy-1-methylhexyl) styrene are included.

In the hybrid resin component, the polyester unit preferably has a crosslinked structure formed by crosslinking with polyvalent carboxylic acid of trivalent or more or its anhydrates, or polyvalent alcohol of trivalent or more. Polyvalent carboxylic acids of trivalent or more include, for example, 1,2,4-benzenetricarboxylic acid, 1,2,4-cyclohexanetricarboxylic acid, 1,2,4-naphthalenetricarboxylic acid, pyromellitic acid and their acid anhydrates or lower alkyl esters, and the polyvalent alcohols of trivalent or more include, for example, 1,2,3-propanetriol, trimethylolpropane, hexanetriol and pentaerythritol, but preferably 1,2,4-benzenetricarboxylic acid and its acid anhydrates.

In the toner of the present invention, the vinyl polymer unit of the binder resin may have a crosslinked structure formed by cross linking with a cross linking agent that has two or more vinyl groups, but cross linking agents to be used in this case include, for example, divinyl benzene and zivinyl naphthalene, as aromatic divinyl compounds; ethyleneglycol diacrylate, 1,3-butyleneglycol diacrylate, 1,4-butanediol diacrylate, 1,5-pentanediol diacrylate, 1,6-hexanediol diacrylate, neopentylglycol diacrylate and the above compounds in which their acrylates are replaced with methacrylates, as diacrylate compounds bound with alkyl chains; diethyleneglycol diacrylate, triethylene glycol diacrylate, tetraethylene glyco ldiacrylate, polyethylene glycol #400 diacrylate, polyethylene glycol #600 diacrylate, dipropylene glycol diacrylate and the above compounds in which thier acrylates are replaced with methacrylates, as diacrylate compounds bound with alkyl chains containing a ether linkage; polyoxyethylene (2)-2, 2-bis (4-hydroxyphenyl) propane diacrylate, polyoxyethylene (4)-2, 2-bis (4-hydroxyphenyl) propane diacrylate and the above compounds in which their acrylates are replaced with methacrylates, as diacrylate compounds bound with chains containing aromatic groups and ether linkages; and MANDA (Trade Name; Nippon Kayaku), as polyester type diacrylates.

Multifunctional cross linking agents include pentaerysritol triacrylate, trimethyrolethane triacrylate, trimethyrolpropane triacrylate, tetramethyrolmethane tetraacrylate, oligoester acrylate and the above compounds in which their acrylates are replaced with methacrylates; triallylcyanurate and triallylmellitate.

These cross linking agents can be used in the ratio of 0.01 to 10 parts by weight (further preferably 0.03 to 5 parts by weight) with respect to 100 parts by weight of other monomers.

Of these cross linking agents, those that are preferably used as resin for toners in terms of fixation and offset resistance (or anti-offset properties) include aromatic divinyl compounds (particularly divinyl benzene) and diacrylate compounds bound with chains containing one of aromatic groups and ether linkages.

In the hybrid resin component, the vinyl polymer component and/or the polyester component preferably include a monomer component that can react with both resin components. Of monomers constituting the polyester component, those that can react with vinyl polymers include, for example, unsaturated dicarboxylic acids such as phthalic acid, maleic acid, citraconic acid and itaconic acid or their anhydrates. Of monomers constituting the vinyl polymer component, those that can react with polyester resin components include compounds having carboxyl groups or hydroxy groups, and acrylic or methacrylic esters.

A method for obtaining reaction products of vinyl polymers and polyester resin is preferably a method in which in the presence of polymers containing monomers which can react with each of the vinyl polymer and polyester described above, the reaction product is obtained by making one or both of these resins participate in polimerization reaction.

Polymerization initiators that are used in the case where vinyl polymers are produced include, for example, ketone peroxides such as 2,2'-azobisisobutyronitrile, 2,2'-azobis(4-methoxy-2,4-dimethylvaleronitrile), 2,2'-azobis(-2,4-dimethylvaleronitrile), 2,2'-azobis(-2-methylbutyronitrile), dimethyl-2,2'-azobisisobutylate, 1,1'-azobis(1-cyclohexanecarbonitrile), 2-(carbamoylazo)-isobutyronitrile, 2,2'-azobis(2,4,4-trim ethylpentane), 2-phenylazo-2,4-dimethyl-4-methoxyvaleronitrile, 2,2'-azobis(2-methyl-propane), methylethylketone peroxide, acetylacetone peroxide and cyclohexanone peroxide, 2,2-bis (t-butylperoxy)butane, t-butyl hydroperoxide, cumen hydroperoxide, 1,1,3,3-tetramethylbutyl hydroperoxide, di-t-butyl peroxide, t-butylcumylperoxide, di-cumylperoxide, α,α'-bis(t-butylperoxyisopropyl) benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxycarbonate, di-methoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutylate, t-butyl peroxyneodecanoate, t-butyl peroxy2-ethylhexanoate, t-butyl peroxylaurate, t-butyl peroxybenzoate, t-butyl peroxyisopropylcarbonate, di-t-butyl peroxyisophtalate, t-butyl peroxyallylcarbonate, t-amyl peroxy2-ethylhexanoate, di-t-butyl peroxyhexahydroterephthalate and di-t-butyl peroxyazelate.

Production methods capable of producing binder resin containing hybrid resin components and having properties according to the present invention include, for example, the production methods described in the following (1) to (6).

(1) A method in which the vinyl polymer, polyester and hybrid resin component are blended after they are produced wherein the blend is to distill out an organic solvent (for example, xylene) after dissolving and swelling in the organic solvent, and preferably wax is added in this blend process to produce binder resin containing wax. Further, the hybrid resin component can be obtained by producing the vinyl polymer and polyester resin separately followed by dissolving and swelling them in a small amount of organic solvent, adding an esterification catalyst and alcohol and effecting ester interchange reaction by heating.

(2) A method in which after production of the vinyl polymer unit, in the presence of this polymer, the polyester unit and the hybrid resin component are produced. The hybrid resin component is produced through the reaction of the vinyl polymer unit (a vinyl monomer may be added if necessary) with polyester monomer (alcohol, carboxylic acid) and/or polyester. In this case, an organic solvent may be optionally added. Preferably, wax is added in this process.

(3) A method in which after production of the polyester unit, in the presence of this polyester unit, the vinyl polymer unit and the hybrid resin component are produced. The hybrid resin component is produced through the reaction of the polyester unit (a polyester monomer may be added if necessary) with vinyl monomer and/or the vinyl polymer unit. Preferably, wax is added in this process.

(4) A method in which after production of the vinyl polymer unit and the polyester unit, the hybrid resin component is produced by adding vinyl monomer and/or polyester monomer (alcohol, carboxylic acid) in the presence of these polymer units. In this case, an organic solvent may be optionally added. Preferably, wax is added in this process.

(5) After production of the hybrid resin component, the vinyl polymer unit and the polyester unit are produced by adding vinyl monomer and/or polyester monomer (alcohol, carboxylic acid) to effect addition polymerization and/or condensation polymerization reaction. In this case, as for the hybrid resin component those produced by the aforesaid methods (2) to (4) may be used, and those produced by known methods may also be used if necessary. Furthermore, an organic solvent may be optionally used. Preferably, wax is added in this process.

(6) The vinyl polymer unit, the polyester unit and the hybrid resin component are produced by mixing a vinyl monomer and a polyester monomer (such as alcohol and carboxylic acid) to effect continuous addition polymerization and condensation polymerization reaction. Furthermore, an organic solvent may be optionally used. Preferably, wax is added in this process.

In the aforesaid methods (1) to (5), as the vinyl polymer unit and/or the polyester unit, polymer units having a plurality of different molecular weights and crosslinkage degees may be used.

Of the aforesaid production methods (1) to (6), the method (3) is particularly preferable in that the molecular weight of the vinyl polymer unit can be easily controlled, formation of the hybrid resin component can be controlled, and the dispersion condition of wax can be controlled in the case where wax is added.

The case will be described below where as a binder resin to be contained in the toner, a resin containing a vinyl polymer as a main component is used.

As for monomers for obtaining vinyl polymers, the aforesaid vinyl monomers can be used directly, but preferable is a combination of monomers such that a styrene-(meta) acrylic copolymer is formed.

In the production of vinyl polymers to be used in the case where toners are produced by a grinding method, acrylic acid, methacrylic acid, α-ethyl acrylic acid, crotonic acid, cinnamic acid, vinyl acetic acid, isocrotonic acid, angelic acid and their α- or β-alkyl derivatives; unsaturated dicarboxylic acids such as fumaric acid, maleic acid, citraconic acid, alkenyl succinic acid, itaconic acid, mesaconic acid, dimethyl maleic acid and dimethyl fumalic acid and their monoesters or anhydrates may be used as monomers for regulating acid value. A binder resin having a desired acid value can be obtained by polymerizing these monomers individually or in combination with other monomers. Of these, monoester derivatives of unsaturated dicarboxylic acid are particularly preferable in order to control the acid value.

For example, monoesters of α, β-unsaturated dicarboxylic acid such as monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; and monoesters of alkenyldicarboxylic acid such as n-butenylsuccinic monobutyl, n-octenylsuccinic monomethyl, n-butenylmalonic monoethyl, n-dodesenylglutamic monomethyl and n-butenyladipic monobutyl are included.

Monomers containing carboxylic groups as described above may be added in the ratio of 0.1 to 20 parts by weight, preferably 0.2 to 15 parts by weight with respect to 100 parts by weight of all the monomers constituting a binder resin.

The reason for selecting the aforesaid monoester monomers of dicarboxylic acid is that they are preferably used in the form of esters having low solubility in aqueous suspension while having high solubility in organic solvents and other monomers.

Carboxylic groups and carboxylic ester portions in the polymer obtained by the polymerization of the aforesaid monomers may be treated with alkali to be saponified. That is, they may be reacted with the cationic component of alkali for changing the carboxylic group or the carboxylic ester portion into a polar functional group.

This treatment with alkali may be carried out by putting binder resin as alkali solution in the solvent used during polymerization and stirring after the binder resin is produced. Alkalis that can be used in the present invention include hydroxides of alkali metals and alkaline earth metals such as Na, K, Ca, Li, Mg and Ba; hydroxides of transition metals such as Zn, Ag, Pb and Ni; and hydroxides of quaternary ammonium salts such as ammonium salts, alkyl ammonium salts and pyridium salts. Particularly preferable examples include NaOH and KOH.

The aforesaid saponification reaction is not necessarily carried out for all the carboxylic groups and carboxylic esters in a polymer, but they may be saponified partially to be changed into polar functional groups.

The amount of alkali that is used for the saponification reaction is depending on the type of polar groups in a polymer, dispersion methods and the type of constituent monomers and is difficult to determine indiscriminately, but may be 0.02 to 5 times the equivalent of the acid value of binder resin. If it is less than 0.02 times the equivalent, saponification reaction is not sufficient and the number of polar functional groups formed through the reaction is smaller, resulting in insufficient crosslinking reaction that is made through subsequent saponification. To the contrary, if it is more than 5 times the equivalent, functional groups such as carboxylic ester portions are unfavorably affected by, for example, the hydrolysis of ester and the formation of salts through saponification reaction.

The treatment with alkali of 0.02 to 5 times the equivalent of the acid value is made, the concentration of residual cation is between 5 and 1,000, which can be preferably used for defining the amount of alkali.

Methods of synthesizing vinyl polymers that are used when toners are produced by a grinding method include solution polymerization, emulsion polymerization and suspension polymerization.

Of these, the emulsion polymerization is a method in which monomers almost insoluble in water are formed into small particles by emulsifiers and dispersed in an aqueous phase, and polymerization is made using a water soluble polymerization initiator. In this method, the regulation of heat of reaction is easy, the speed of termination reaction is small since the phase in which polymerization is made (oil phase consisting of polymer and monomer) and the aqueous phase are separate, resulting in a higher speed of polymerization, and polymers in a high polymerization degree are obtained. Furthermore, it has advantageous aspects as a method for producing binder resin for toners because the mixture of a colorant, a charge controlling agent and other additives is easy in the production of toners since polymerization process is relatively simple and polymerization products are fine particles.

However, produced polymers tend to be impure due to added emulsifiers and an operation such as salting-out is required to take out polymers, and the suspension polymerization is preferable for avoiding this inconvenience.

The suspension polymerization are preferably made in the ratio of 100 parts or less by weight (preferably 10 to 90 parts by weight) of monomer to 100 parts by weight of aqueous solvent. As dispersants that may be used, polyvinyl alcohol, partially saponificated polyvinyl alcohol and calcium phosphate are used, and they are used generally in the ratio of 0.05 to 1 parts by weight to 100 parts by weight of aqueous solvent. Appropriate temperature for polymerization is 50 to 95° C., but is optionally selected depending on polymerization initiators to be used or polymers to be formed.

In the case where vinyl polymers are produced using suspension polymerization, various multifunctional polymerization initiators as illustrated below are preferably used individually or in combination with monofunctional polymerization initiators.

Examples of multifunctional polymerization initiators having multifunctional structure include multifunctional polymerization initiators having functional groups having two or more polymerization initiating functions such as peroxide groups in one molecular, such as 1,1-di-t-butylperoxy-3,3,5-trimethylcyclohexane, 1,3-bis-(t-butylperoxyisopropyl)benzene, 2,5-dimethyl-2,5-(t-butylperoxy)hexane, 2,5-dimethyl-2,5-di-(t-butylpaeoxy) hexane, tris-(t-butylperoxy)triazine, 1,1-di-t-butylperoxycyclohexane, 2,2-di-t-butylperoxybutane, 4,4-di-t-butylperoxyvalericacid-n-abutylester, di-t-butylperoxyhexahydroterephthalate, di-t-butylperoxyazelate, di-t-butylperoxytrimethyladipate, 2,2-bis-(4,4-di-t-butylperoxycyclohexyl)propane and 2,2-t-butylperoxyoctane; and multifunctional polymerization initiators having both functional groups having polymerization initiating functions such as peroxide groups and polymerizing unsaturated groups in one molecular, such as diallylperoxydicarbonate, t-butylperoxymaleic acid, t-butylperoxyallylcarbonate, and t-butylperoxyisopropylfumarate.

Of these, more preferable are 1,1-di-t-butylperoxy-3,3,5-trimethylcyclohexane, 1,1-di-t-butylperoxycyclohexane, di-t-butylperoxyhexahydroterephthalate, di-t-butylperoxyazelate, 2,2-bis-(4,4-di-t-butylperoxycyclohexyl)propane and t-butylperoxyallylcarbonate.

Preferably, these multifunctional polymerization initiators are used in combination with monofunctional polymerization initiators, in order to satisfy a variety of performances required as binder resin for toners. Particularly, a polymerization initiator of which decomposition temperature for achieving a half-life period of 10 hours is lower than that of the multifunctional polymerization initiator used in combination is preferably used.

Specifically, organic peroxides such as benzoilperoxide, 1,1-di(t-butylperoxy)-3,3,5-trimethylcyclohexane, n-butyl-4,4-di(t-butylperoxy)valerate, dicumylperoxide, α,α'-bis(t-butylperoxydiisopropyl)benzene, t-butylperoxycumene and di-t-butylperoxide, and azo and diazo compounds such as azobisisobutyronitrile and diazoaminoazobenzene.

These monofunctional polymerization initiators may be added in the monomer together with the above described multifunctional polymerization initiators, but in order to properly maintain the efficiency of such multifunctional polymerization initiators, they are preferably added after the half-life period that such multifanctional polymerization initiators show in polymerization process.

In the toner of the present invention, in the case where vinyl polymers which constitute binder resin are produced by solution polymerization, bulk polymerization and the like, they can be produced by usual radical polymerization. In addition, using radical polymerization initiators which have two peroxide groups in a molecule and of which temperature difference of 10 hour half life when the cleavage reaction of each peroxide group takes place is 5° C. or more, preferably 7° C. or more, and further preferably 10° C. or more, polymers produced by changing the reaction temperature difference in the radical polymerization by 5° C. or more, preferably by 7° C. or more, and further preferably by 10° C. or more and adding monomer constituents at each polymerization temperature, may be used.

In terms of efficiency, these polymerization initiators are preferably used in the ratio of 0.05 to 2 parts by weight to 100 parts by weight of monomers.

In this case, vinyl polymers are also preferably crosslinked by cross linking monomers.

As a cross linking monomer, a monomer having two or more double bonds available for polymerization is principally used. Specific examples include aromatic divinyl compounds (for example, divinyl benzene and divinyl naphthalene); diacrylate compounds bound with alkyl chains (for example, ethyleneglycol diacrylate, 1-3-butyleneglycol diacrylate, 1,4-butanediol diacrylate, 1,5-pentanediol diacrylate, 1,6-hexanediol diacrylate, neopentylglycol diacrylate, and the aforesaid compounds with acrylates replaced with methacrylates); diacrylate compounds bound with alkyl chains containing ether linkages (for example, diethyleneglycol diacrylate, trethyleneglycol diacrylate, tetraethyleneglycol diacrylate, polyethyleneglycol #400 diacrylate, polyethyleneglyol #600 diacrylate, dipropyleneglycoldiacrylate, and the aforesaid compounds with acrylates replaced with methacrylates); diacrylate compounds bound with chains containing aromatic groups and ether linkages (for example, polyoxyethylene (2)-2,2-bis(4-hydroxyphenyl)propanediacrylate, polyoxyethylene(4)-2,2-bis(4-hydroxyphenyl)propane diacrylate, and the aforesaid compounds with acrylates replaced with methacrylates); and polyester type diacrylate compounds (for example, product name MANDA (Nippon Kayaku)). Multifunctional crosslinking agents include pentaerysuritol acrylate, trimethylolethane triacrylate, trimethylolpropane triacrylate, tetramethylolpropane triacrylate, tetramethylolmethane tetraacrylate, oligoester acrylate and the aforesaid compounds with acrylates replaced with methacrylates; and triallyl cyanoaurate and triallyl trimellitate.

These crosslinking agents are preferably used in the ratio of 0.0001 to 1 parts by weight, preferably 0.001 to 0.5 parts by weight to 100 parts by weight of other monomers.

Of these cross linking monomers, those which are ideally used in terms of the fixation of toners and offset resistance include aromatic divinyl compounds (for example, divinyl benzene) and diacrylate compounds bound with chains containing aromatic groups and ether linkages.

As other synthesis methods, weightive polymerization and solution polymerization may be used. However, in the bulk polymerization, any polymers can be obtained by effecting polymerization at high temperature to enhance the speed of termination reaction, but there is such a disadvantage that the control of reaction is difficult. With the solution polymerization, in this respect, even low molecular weight polymers can be obtained easily by taking advantage of the difference in chain transfer of radicals by solvents or regulating the amount of polymerization initiators and reaction temperature, which is preferable. Particularly, it is preferable to carry out polymerization under pressurized condition in that the amount of polymerization initiators used is reduced to a minimum and the influence of remaining initiators is reduced as much as possible.

Furthermore, also in the case where toners are produced by direct polymerization, as vinyl monomers constituting vinyl polymers, the aforesaid vinyl monomers can be used directly. Also in this case, a cross linking agent may be used during polymerization in order to intensify the mechanical strength and obtain a stable chargeability.

As crosslinking agents, all of the aforesaid compounds can be used, and they are added in the ratio of preferably 0.05 to 10 parts by weight, and more preferably 0.1 to 5 parts by weight to 100 parts by weight of other vinyl monomers.

In the case where toners are produced by direct polymerization, polar resin such as polyester, epoxy resin, polycarbonate resin, styrene-butadiene copolymer can be contained so long as the chargeability of toners is not affected.

In the case where the toner of the present invention is used as a magnetic toner, magnetic substance is incorporated into the toner. As the magnetic substance for use in the present invention, magnetic iron oxides such as magnetite, maghemite and ferrite containing different kinds of elements, and their mixtures are preferably used.

Of these, preferable are magnetic iron oxides containing one or more elements selected from lithium, beryllium, boron, magnesium, aluminum, silicon, phosphorus, sulfur, germanium, titanium, zirconium, tin, lead, zinc, calcium, barium, scandium, vanadium, chromium, manganese, cobalt, copper, nickel, gallium, indium, silver, palladium, gold, platinum, tungsten, molybdenum, niobium, osmium, strontium, yttrium, technetium, ruthenium, rhodium and bismuth. Particularly preferable are lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. Most preferable are magnetic iron oxides containing as different kinds of elements elements selected from a group consisting of magnesium, aluminum, silicon, phosphorus and zirconium. These elements may be captured in the crystal lattice of the iron oxide, may be captured as oxides in the iron oxide, and may exist as oxides or hydroxides on the surface. Furthermore, configurations in which they are contained as oxides are preferable.

These elements can be captured in the particle by allowing salts of respective elements to coexist and adjusting pH when the magnetic substance is produced. Furthermore, these elements can be precipitated on the surface of particles by adjusting pH, or adding salts of respective elements and adjusting pH after the magnetic substance is produced.

Magnetic substances having these elements are well compatible with binder resin and have very good dispersibility. Furthermore, this good dispersibility can enhance the dispersibility of aluminum compounds of benzilic acid for use in the present invention and can bring out the effect of such compounds sufficiently. The magnetic substances act as dispersion media, the good dispersibility of the magnetic substances supports the dispersibility of aluminum compounds of benzilic acid and enhances the dispersibility of aluminum compounds of benzilic acid. Furthermore, these magnetic substances adsorb molecules of water, and have an effect such that aluminum compounds of benzilic acid give stress to charging by molecules of water more easily. This effect, if utilized together with binder resin having acid value, can be more effectively brought out. Furthermore, these magnetic substances have uniform particle size distribution, which together with the dispersibility of binder resin, can stabilize the chargeability of toners.

The content of these different kinds of elements is preferably 0.05 to 10 percent by weight based on the iron element of the magnetic iron oxide. Further preferable is 0.1 to 7 percent by weight, particularly preferable is 0.2 to 5 percent by weight, and further more preferable is 0.3 to 4 percent by weight. If the content of different kinds of elements is less than 0.05 percent by weight, the effect of containing these elements cannot be obtained, and good dispersibility and uniform electrification cannot be achieved. If the content of different kinds of elements is more than 10 percent by weight, emission of electric charge increases resulting in the lack of electrification, and image concentration may decrease and fogging may increase.

Furthermore, in the existence condition of these different kinds of elements, preferably a large number of elements exist near the surface of the magnetic substance. For example, the dissolution rate of a different kind of element is preferably 20% to 100% of all the different kinds of elements, when the dissolution rate of the iron element of iron oxides is 20%. Further preferable is 25% to 100%, and particularly preferable is 30% to 100%. Dispersion effect and electric diffusion effect can be enhanced more significantly, by increasing surface abundance.

For these magnetic substances, the number average particle size is preferably 0.05 to 1.0 $\mu$m, and further preferably is 0.1 to 0.5 $\mu$m. The magnetic substances of which BET specific surface area is 2 to 40 $m^2/g$ are preferably used (more preferable is 4 to 20 $m^2/g$). The shape is not particularly limited, and magnetic substances of any shape are used. As for magnetic properties, magnetic substances which are preferably used are those having saturation magnetization of 10 to 200 $Am^2/kg$ (more preferably, 70 to 100 $Am^2/kg$), remnant magnetization of 1 to 100 $Am^2/kg$ (more preferably, 2 to 20 $Am^2/kg$) and magnetic force resistance of 1 to 30 kA/m (more preferably, 2 to 15 kA/m) under magnetic field of 795.8 kA/m. These magnetic substances are used in the ratio of 20 to 200 parts by weight to 100 parts by weight of binder resin.

The amount of elements in the magnetic iron oxide can be measured by carrying out X-ray fluorescence analysis in accordance with JIS K0119 General Rule of X-Ray Fluorescence Analysis, using Fluorescent X-Ray Spectrometer SYSTEM 3080 (manufactured by Rigaku Denki Kogyo Ltd.). Distribution of elements can be obtained by determining the amount of atoms being dissolved in hydrochloric acid or hydrofluoric acid using plasma emission spectroscopy (ICP) and calculating its dissolution rate from the ratio of the concentration of each element with each dissolved to the concentration of each element with all dissolved.

Furthermore, the number average diameter of the magnetic substance can be found by using a digitizer or the like to measure photographs of the particles magnified with a transmission electron microscope. Magnetic properties of magnetic substance are values measured under external magnetic field of 795.8 kA/m using "Vibrating Sample Type Magnetometer VSM-3S-15" (manufactured by Toei Kogyo). As for specific surface area, the sample is made to adsorb gaseous nitrogen on the surface using Specific Surface Area Measuring Equipment Autosorp 1 (manufactured by Yuasa Ionics) in accordance with the BET method, and then the BET multipoint method is used to calculate the specific surface area.

As colorant that can be used for the present invention, there may be employed carbon black, titanium white, or other pigments and/or dyes. For example, when the toner is used as a magnetic color toner, the dyes include C.I. Direct Red 1, C.I. Direct Red 4, C.I. Acid Red 1, C.I. Basic Red 1, C.I. Modern Red 30, C.I. Direct Blue 1, C.I. Direct Blue 2, C.I. Acid Blue 9, C.I. Acid Blue 15, C.I. Basic Blue 3, C.I. basic Blue 5, C.I Modern Blue 7, C.I. Direct Green 6, Basic Green 4, and C.I. Basic Green 6. The pigments include Mineral Fast Yellow, Nable Yellow, Naphtol Yellow S, Hanzai Yellow G, Permanent Yellow NCG, Tartradine Rake, Molybdenum Orange, Permanent Orange GTR, Purazolon Orange, Banzidine Orange G, Cadmium Red, Permanent Red 4R, Watching Red Calcium salt, Eosin Rake, Brilliant Carmine 3B, Manganese Purple, Fast Violet B, Methyl Violet Rake, Cobalt Blue, Alkali Blue Rake, Victory Apple Rake, Phthalocyanine Blue, First Sky Blue, Indanthlene Blue BC, Pigment Green B, Marakite Green Rake, and Final Yellow Green G.

Carbon black employed for the present invention is preferably 25 to 80 nm in average particle size of primary particles, and is more preferably 35 to 55 nm.

If the average particle size of primary particles of carbon black is less than 25 nm, toner chargeability are affected. In addition when the size exceeds 80 nm, the coloring power becomes insufficient, and only a printed out image with its low image density can be obtained.

Although the above pigments may be used separately, the dyes and pigments are used together, thereby improving its degree of color sharpness, which is preferable from the viewpoint of full color image quality. The magenta dyes include oil soluble dyes such as C.I. Solvent Reds 1, 3, 8, 23, 24, 25, 27, 30, 49, 81, 82, 83, 84, 100, 109, 121; C.I. Disperse Red 9; C.I. Solvent Violets 8, 13, 14, 21, and 27; and C.I. Disperse Violet 1; and basic dyes such as C.I. Basic Reds 1, 2, 9, 12, 13, 14, 15, 17, 18, 22,23, 24, 27, 29, 32, 34, 35, 36, 37, 38, 39, and 40; C.I. Basic Violets 1, 3, 7, 10, 14, 15, 21, 25, 26, 27, and 28.

Cyan coloring pigments include C.I. Pigment Blues 2, 3, 15, 16, and 17; C.I. Bud Blue 6; C.I. Acid Blue 45; or copper phthalocyanyne pigments in which its phthalocyanine skeleton having the structure represented by the following formula is substituted with one to five phthalimido methyl groups.

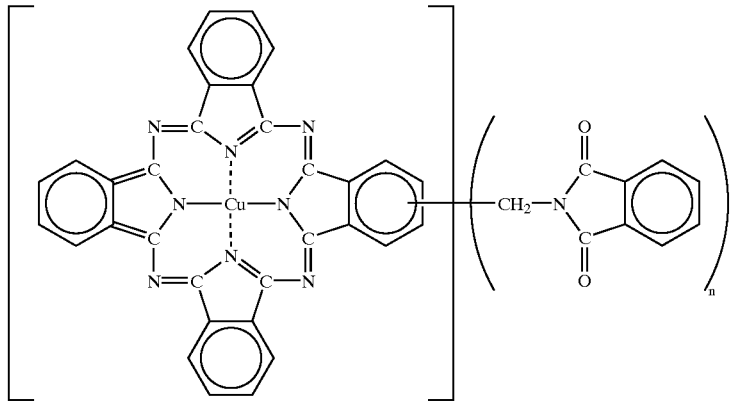

n = 1 to 5

The average particle size of primary particles of the carbon black added in a toner can be obtained from a magnified TEM photograph using a transparent electronic microscope (TEM).

In addition, the carbon black employed for the present invention is preferably 40 to 150 ml/100 g in DBP oil absorption quantity, and is more preferably 50 to 140 ml/100 g.

In the case where the DBP oil absorption quantity is less than 40 ml/100 g, the carbon black structure is short, and the toner charge quantity is prone to decrease. When the DBP oil absorption quantity exceeds 150 ml/100 g, a long, rigid structure is obtained, making it difficult to obtain uniform toner charge.

The DBP oil absorption quantity of carbon black is measured in conformity with ASTM D2414-79.

When the toner of the present invention is used as a two-component full color toner, the following colorant are exemplified. The magenta coloring pigments include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. Pigment Violet 19, and C.I. Bud Reds 1, 2, 10, 13, 15, 23, 29, and 35.

Yellow coloring pigments include C.I. Pigment Yellows 1, 2, 3, 4, 5, 6, 7, 10, 11, 12, 13, 14, 15, 16, 17, 23, 65, 73, 83 and C.I. Bud Yellows 1, 3, and 20.

In a non-magnetic toner, the quantity of colorant is 0.1 to 20 wt. parts, and is preferably 0.2 to 10 wt. parts in a bonding resin of 100 parts by weight.

The toner of the present invention may be used together with the aforementioned aluminum compound of a benzylic acid and other charge control agents.

As a charge control agent that can be used together with the aluminum compound of the benzylic acid, although a known charge control agent can be utilized, it is preferable that a charge control agent has its high charge speed, and is capable of constantly maintaining a constant charge quantity. As specific compounds having their negative frictional charge properties, there can be utilized metal compounds such as salicylic acid, naphthoic acid, dye carbonic acid or its derivative; metal compounds such as azo pigment or its derivative; polymeric compounds having a sulfonic acid and a carbonic acid on side chain; boron compounds, urine compounds, silicon compounds, and kalliksalene. In addition, as specific compounds having positive frictional charge properties, there is preferably employed Nigrosine, triphenyl methane based compounds, quaternary ammonium salts, polymeric compounds having quaternary ammonium salts on their side chains, guanidine compounds, imidazol compounds.

Although these charge control agents of 0.1 to 10 parts by weight, and more preferably 0.5 to 5 parts by weight in binder resin of 100 parts by weight can be used, these agents are not always mandatory.

The toner is preferably 2.5 to 10 μm in weight-average particle size, and is more preferably 2.5 to 6.0 μm.

The toner of 2.5 to 6.0 μm in weight-average particle size is preferable because an image with its very high resolution can be obtained. In the case where the average particle size per weight is less than 2.5 μm, it is not preferable because sufficient image density is hardly obtained. As the particle size of the toner is made smaller, the release of the aluminum compounds of benzylic acid is liable to occur. However, since the toner of the present invention has superior charge uniformity, even if the aluminum compounds of the benzylic acid is released, and sleeve contamination occurs, the toner is hardly affected by such release or contamination.

Containing inorganic fine powder in the toner of the present invention is one of the preferable embodiments in improving the toner charge stability, developing properties, flow properties, and durability.

The inorganic fine powder used in the present invention includes fine powder of inorganic oxides such as silica fine powder, titanium oxide fine powder, and alumina fine powder separately or in combination.

In addition, the inorganic fine powder used in the present invention is intended to provide hydrophobicity, control of charge properties or the like. If necessary, it is also preferable that the inorganic fine powder is treated with silicone vanish, various modified silicone vanishes, silicone oil, various modified silicon oils, silane coupling agents, silane coupling agents having functional groups, or other treatment agents such as organic silicon compounds, optionally, together with various treatment agents. Among them, silicone oil treatment with silicone vanishes, various modified silicone vanisheds, silicone oils, or various modified silicone oils is preferred.

Untreated inorganic fine powder and hydrophobic inorganic fine powder may be employed by mixing them in the toner of the present invention.

For example, as the silica fine powder for the present invention, dry silica called dry process or fumed silica produced by vapor phase oxidization of silicon halogen compounds and wet silica produced from water glass or the like, may be both used, but the dry silica with less silanol groups on the surface and the inside thereof and free of production residues is preferred.

Further, the silica fine powder employed for the present invention is preferably subjected to hydrophobic treatment. In the hydrophobic treatment, the silica fine powder is chemically treated by organic silicon compounds or the like which reacts with, or is physically adsorbed by, that silica fine powder.

Preferable methods include a method in which, after treating the dry silica fine powder produced by vapor phase oxidization of silicon halogen compounds with a silane coupling agent or at the time of the treatment with the silane coupling agent, the fine powder is treated with an organic silicon compound such as silicone oil.

Silane coupling agents used with hydrophobic treatment include, for example, haxamethyldisilazane, trimethylsilane, trimethylchlorsilane, trimethylethoxysilane, dimethylchlorsilane, methyltrichlorsilane, aryldimetghylchlorsilane, arylphenyldichlorsilane, benzyldimethylchlorsilane, brommethyldimethylchlorsilane, α-chlorethyltrichlorsilane, β-chlorethyltrichlorsilane, chlormethyldimethylchlorsilane, triorganosilanemercaptan, trimethylsilylmercaptan, triorganosilylacrylate, vinyldimethylacetoxysilane, dimethylethoxysilane, dimethyldimethoxysilane, diphenyldietoxysilane, hexamethyldisiloxane, 1,3-divinyltetramethyldisiloxane, 1,3-diphenyltetramethylsidiloxane.

Organic silicon compounds include silicone oil. As preferable silicone oil, there is employed an oil whose viscosity is 30 to 1000 $mm^2$ per second (cSt) at 25° C. For example, dimethyl silicone oil, methyl phenyl silicone coil, α-methyl styrene modified silicone oil, chlorphenyl silicone coil, or fluorine modified silicone oil is preferred.

In the silicone oil treatment, for example, the silica fine powder treated with a silane coupling agent and silicone oil may be mixed directly by using a mixing machine such as a Henschel mixer or the like, or silicone oil is ejected to silica being a base body. Alternatively, after silicone oil is dissolved or dispersed in a proper solvent, the dissolved or dispersed oil is mixed with the silica fine powder being a base body, and the solvent is removed, whereby the mixture may be prepared.

When the hydrophobic treatment in the above silica fine powder is applied to titanium oxide fine powder, the fine powder is preferably employed for the toner of the present invention.

Among the inorganic fine powders to which silicone oil treatment is applied as described above, the inorganic fine powder of 5 to 100 nm, and further, 5 to 70 nm in average particle size of primary particles imparts good results to flow properties or charge properties, and the matching with aluminum compounds of the benzylic acid according to the present invention is improved. In a specific surface area according to nitrogen adsorption measured by the BET method, the base body fine powder is preferably in 30 $m^2/g$ or more and is particularly within the range of 60 to 400 $m^2/g$. The surface treated fine powder is preferably in 20 $m^2/g$ or more, and is particularly within the range of 40 to 300 $m^2/g$.

The average particle size of primary particles of the inorganic fine powder added into the toner can be obtained from a SEM photograph using a scanning electronic microscope (SEM). Specifically, among from the toner magnification SEM photograph, 300 particles which can be verified to be primary particles of the inorganic fine powder can be verified are selected. Then, each particle size of the inorganic fine powder is measured, and the average value thereof is defined as the average particle size of the primary particles of the inorganic fine powder.

The inorganic fine powder employed for the present invention is used preferably in 0.03 to 8 parts by weight in the toner of 100 parts by weight, more preferably in 0.1 to 5 parts by weight.

The following addition agents may be employed for the present invention in order to impart various characteristics.

(1) As polishing agents, there are employed metal oxides such as titanium oxide strontium, cerium oxide, aluminum oxide, magnesium oxide, chrome oxide; nitrides such as silicon nitride; carbides such as silicon carbide; calcium sulfate, barium sulfate, and calcium carbonate.

(2) As lubricating agents, there are employed fluorine based resin powders such as vinylidene polyfluoride, polytetrafluoroetylene; aliphatic acid metal salt such as zinc stearate or calcium stearate.

(3) As charge control particles, there are employed metal oxides such as tin oxide, titanium oxide, zinc oxide, silicon oxide, and aluminum oxide; carbon black; and resin fine powder.

These addition agents may be used in 0.05 to 10 parts by weight, preferably in 0.1 to 5 parts by weight in the toner of 100 parts by weight. These addition agents may be employed separately or in combination.

The toner of the present invention may be used as a two-component developing agent by mixing the toner with a carrier. The resistance value of the carrier is preferably set to be $10^6$ to $10^{10}$ Ω·cm by adjusting irregularities on the carrier surface and a quantity of resin applied onto the carrier.

When a carrier having a constitution in which core is coated with a resin is employed, there may be employed, as the resin for coating the carrier surface, styrene-ester acrylate copolymer; styrene-ester methacrylate copolymer; ester acrylate copolymer; ester methacrylate copolymer; silicone resin, fluorine-containing resin; polyamide resin; ionomer resin; polyphenylene sulfide resin; or their mixture.

The quantity of the coating resin is 0.1 to 30 weight %, preferably 0.5 to 20 weight %, based on the carrier cores to be coated. The average particle size of the carrier is 10 to 100 μm, and is preferably 20 to 70 μm.

As magnetic materials of the carrier cores, there can be employed oxides such as ferrite, iron excess type ferrite, magnetite, γ-iron oxide; and metals such as iron, cobalt, or nickel or their alloys. In addition, elements contained in these magnetic materials include iron, cobalt, nickel, aluminum, copper, lead, magnesium, tin, zinc, antimony, beryllium, bismuth, calcium, manganese, selenium titanium, tungsten, and vanadium.

As a method for manufacturing the toner of the present invention, it is preferable that the aforementioned toner constituent elements are well mixed by a ball mill and other mixing machines, is well mulled by employing a thermal mulling machine such as thermal roll kneader or extruder, is mechanically milled after cooling and solidification, and the milled powders are classified, thereby obtaining the toner. In addition, there are a polymerization based toner manufacturing method for mixing predetermined material with monomers which should constitute a bonding resin to obtain an emulsified suspension, following by polymerizing the suspension to obtain the toner; a method for allowing predetermined material to be contained in a core material and/or a shell material in a so called micro capsule toner consisting of the core material and shell material; and a method for dispersing constituent elements in a bonding resin solution, followed by spraying and drying the solution, thereby obtaining the toner. Further, desired addition agents and the toner are well mixed by a mixing machine such as a Henschel Mixer as required, whereby the toner of the present invention can be produced.

An image forming method in which the toner of the present invention is preferably employed will be described below.

First, developing means applicable to the image forming method of the present invention will be described below.

In FIG. 1, an image carrier for carrying an electrostatic images formed by a known process, for example, an electrophotographic photosensitive drum 7 is rotated in the direction indicated by arrow B. A developing sleeve 14 being a developing agent carrier (or developer-carrying member) carries a toner 10 being a single-component developing agent supplied from a hopper 9, and rotates in the direction indicated by arrow A, thereby transporting the toner 10 to a developing section D at which the developing sleeve 14 and the photosensitive drum 7 are opposed to each other. In the developing sleeve 14, in the case where the toner 10 is a magnetic toner, a magnet 11 is disposed in order to cause the toner to be magnetically attracted and held onto the developing sleeve 14. To the toner 10, frictionally electrified charge capable of developing an electrostatic images on the photosensitive drum 7 is imparted by friction with the developing sleeve 14.

In order to restrict the thickness of a layer of the toner 10 carried to the developing section D, in the case where the toner is a magnetic toner, a restricting magnetic blade 8 consisting of a strong magnetic (or ferromagnetic) metal is suspended from the hopper 9 so as to approach to the developing sleeve 14 with a gap width of about 200 to 300 μm from the surface of the developing sleeve 14. Magnetic lines of force from a magnetic pole N1 of the magnet 11 are concentrated on the blade 8, whereby a thin layer of the toner 10 is formed on the developing sleeve 14. As the blade 8, a non-magnetic blade can be used. In addition, in the case where the toner 10 is a non-magnetic toner, a resilient blade such as urethane rubber, silicone rubber, or chip blade is employed.

The thickness of the thin layer of the toner 10 formed on the developing sleeve 14 is preferable to be further thinner than a minimum gap between the developing sleeve 14 at the developing section D and the photosensitive drum 7. The developing method of the present invention is particularly effective to a developing apparatus (i.e., a non-contact type developing apparatus) employing a system of developing an electrostatic images by such a toner thin layer. In addition, at the developing section, the developing method is applicable to a developing apparatus (i.e., a contact type developing apparatus) in which the thickness of the toner layer is equal to or greater than a minimum gap between the developing sleeve 14 and the photosensitive drum 7.

Hereinafter, an example of the non-contact type developing apparatus will be described.

In order to affect the toner 10 carried on the developing sleeve 14, a developing bias voltage is applied to the developing sleeve 14 by means of a power source 15. When a DC voltage is used as this developing bias voltage, the voltage whose value is between an electric potential of a image section of an electrostatic images (a region in which the toner 10 is deposited and visualized) and an electric potential of a background section is preferably applied to the developing sleeve 14. On the other hand, in order to increase the density of a developed image or improve gradation properties, an alternate bias voltage is applied to the developing sleeve 14 so that a oscillating electric field whose orientation is reversed alternately may be formed at the developing section D. In this case, the alternate bias voltage in which a DC voltage component having a value between the electric potential of the above image section and the electric potential of the background section is superimposed is preferably applied to the developing sleeve 14.

In addition, in so called regular developing in which the visualization is carried out by depositing at a high electric potential section of the electrostatic image having a high electric potential section and a low electric potential section, a toner electrified in a polarity opposite to the polarity of the electrostatic image is used. On the other hand, in reversal developing in which a toner is deposited at the low electric potential section of the static charge image, a toner electrified in a polarity identical to the polarity of the electrostatic image. The high electric potential and the low electric potential are based on absolute value. In any case, the toner 10 is electrified in a polarity for developing an electrostatic images due to the friction with the developing sleeve 14.

Figure 2:
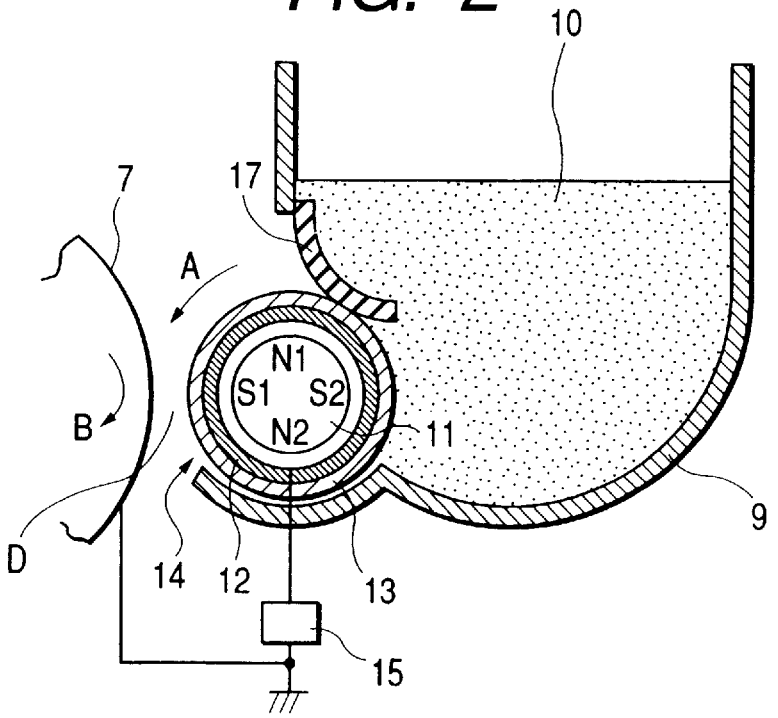
FIG. 2 is a schematic diagram illustrating another example of a developer-supplying developing unit in which a developer carrier is incorporated (using an elastic blade as regulating means)

In the developing apparatus shown in FIG. 2, as a member for restricting the thickness of a layer of the toner 10 on the developing sleeve 14, a resilient plate is used which is formed out of a material having rubber resilience such as urethane rubber or silicone rubber or a material having metal resilience such as phosphorus bronze or stainless steel, wherein this resilient plate 17 is brought into pressure contact with the developing sleeve 14. In such developing apparatus, a thinner toner layer can be further formed on a developing sleeve 8. The other construction of the developing apparatus shown in FIG. 2 is basically identical to the developing apparatus shown in FIG. 1. In FIG. 2, like reference numerals identical to those assigned in FIG. 1 denote like elements.

In the developing apparatus as shown in FIG. 2, in which a toner layer is formed on the developing sleeve 14 as described above, the toner is rubbed and attached on the developing sleeve 14 by means of a resilient plate 17. Thus, the toner frictional electrification quantity is increased, and the image density is improved. In addition, in a non-magnetic one-component toner, such developing apparatus is employed.

Figure 3:
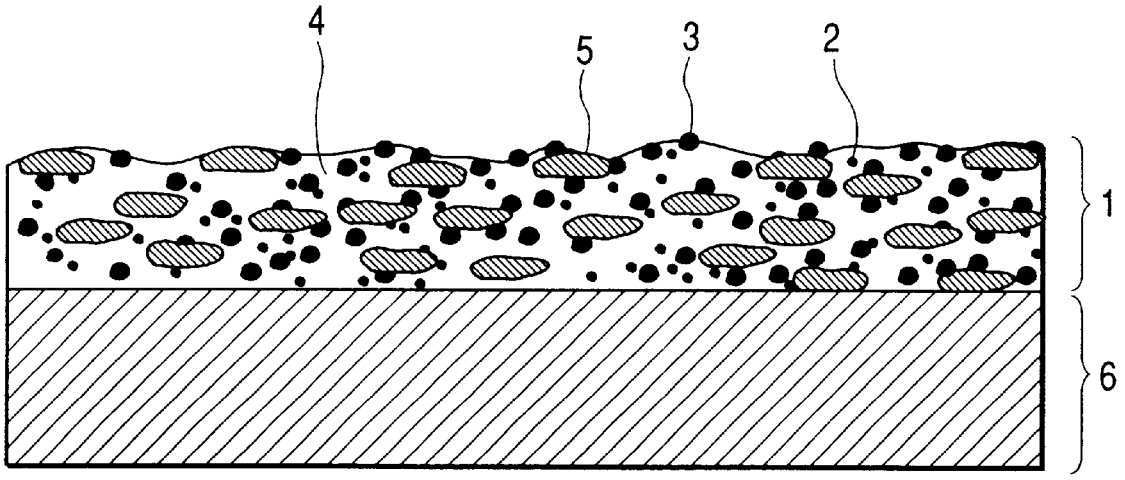
FIG. 3 is a schematic diagram illustrating a cross-section of part of the developer carrier.

A developing sleeve that is a developing agent carrier employed for the present invention preferably has a cylindrical base body 12; and a coat layer 13 (a resin layer) with which the surface of the base body is coated. The construction is shown in FIG. 3. The resin layer 1 contains a binder resin 4, and may optionally contains a electrically conductive substance 2, a filling agent 3, and a solid lubricating agent 5.

The resin layer is applied onto the cylindrical base body 6. In the case where the electrically conductive substance 2 is contained, the resin layer 1 is electrically conductive, and thus, excessive electrification of the toner can be prevented. In addition, in the case where the filling agent 3 is contained, the wear of the resin layer 1 due to the toner is prevented. Further, toner electrification can be preferably controlled by the electrification imparting properties of the filling agent 3. Furthermore, in the case where the solid lubricating agent 5 is contained, the release properties between the toner and the sleeve is improved. As a result, the fusion of the toner onto the sleeve can be prevented.

In the sleeve of the present invention, in the case where an electrically conductive substance is contained in a resin layer, the volume resistance of the resin layer is 106 Ω·cm or less, and is preferably 103 Ω·cm or less. In the case where the volume resistance of the resin layer exceeds 106 Ω·cm, toner charge-up is prone to occur, which may cause the occurrence of blotch or the degradation of developing properties.

In addition, the surface roughness of the resin layer is preferably within the range of 0.2 to 3.5 μm in an average roughness (Ra) of the JIS center line. If Ra is less than 0.2 micron, the electrification quantity of the toner in the vicinity of the sleeve is too high. Then, the toner is attracted onto the sleeve by mirroring force, electrification from the sleeve cannot be imparted to a new toner, so that developing properties are lowered. If the Ra exceeds 3.5 μm, the toner coat quantity on the sleeve increases excessively. Thus, the toner cannot obtain a sufficient electrification quantity, and non-uniform electrification occurs, causing lowered image density or density non-uniformity.

Each of the materials constituting the resin layer 1 will be described below.

In FIG. 3, an electrically conductive substance 2 includes, for example, metal powders such as aluminum, copper, nickel, or silver; metal oxides such as antimony oxide, indium oxide, or tin oxide; and carbon allotropes such as carbon fiber, carbon black, or graphite. Among them, carbon black is preferably employed particularly because it has superior electrical conductivity, and imparts electrical conductivity when it is filled in a polymer material, and because an arbitrary degree of electrical conductivity can be obtained to some extent through controlling an amount of such addition. The average particle size of carbon black particles used for the present invention is 0.001 to 1.0 micron, and is preferably 0.01 micron to 0.8 micron. When the average particle size of carbon black particles exceeds 1 micron, the volume resistance of the resin layer is hardly controlled, which is not preferable.

The quantity of an electrically conductive substance is preferably 0.1 to 300 parts by weight, and is more preferably 1 to 100 parts by weight, based on 100 parts by weight of binder resin.

As the filling agent 3, there may be added a known conventional toner negative or positive electrification charge control agent. The other substances include inorganic compounds such as alumina, asbestos, glass fiber, calcium carbonate, magnesium carbonate, barium carbonate, barium sulfate, silica, calcium silicate; nitrogen-containing compounds such as phenol resin, epoxy resin, melanin resin, silicone resin, PMMA, terpolymer of methacrylate (for example, polystyrene/n-butyl methacrylate/silane terpolymer), styrene-butadiene based copolymer, polycaprolactone, polycaprolactam, polyvinyl pyridine, polyamide; highly halogenated polymers such as polyfluorinated vinylidene, polyvinyl chloride, polytetrafluoroethylene, polytetrachlorofluoroethylene, perfluoroalkoxylated ethylene, polytetrafluoroalkoxyethylene, fluorinated ethylene propylene-polytetrafluoroethylene copolymer, trifluorochloroethylene-vinyl chloride copolymer; polycarbonate, or polyester. Among them, silica and alumina are preferably employed because they have their own hardness and electrification control properties for toner.

The quantity of the filling agent is preferably 0.1 to 500 parts by weight, and more preferably 1 to 200 parts by weight, based on 100 parts by weight of binder resin.

The solid lubricating agent 5 includes, for example, molybdenum disulfide, boron nitride, graphite, fluorinated graphite, silver-niobium selenide, calcium chloride-graphite, and talc. Among them, graphite is preferably employed because it has lubricating properties and electrical conductivity, decrease a toner having excessively high charge, and acts to provide an electrification quantity preferable to developing.

The quantity of the solid lubricating agent is preferably 0.1 to 300 parts by weight, and is more preferably 1 to 150 parts by weight, based on 100 parts by weight of binder resin.

Optionally, as the binder resin 4 in which the electrically conductive substance 2, the filling agent 3 or the solid lubricating agent 5 is dispersed, there may be employed resins such as phenol based resin, epoxy based resin, polyamide based resin, polyester based resin, polycarbonate based resin, polyolefin based resin, silicone based resin, fluorine based resin, styrene based resin, or acryl based resin. In particular, a thermosetting or optically curing resin is preferred.

In addition, in order to preferably surface-expose an electrically conductive substance in a resin layer on the sleeve surface, a filling agent or a solid lubricating agent or in order to produce a surface with uniform irregularities by performing surface-smoothing treatment, a surface is treated to be smoothened by means such as polishing treatment described later, thereby making it possible to impart further preferable performance. In particular, this smoothing treatment is effective in a longitudinal streak phenomenon that occurs with solid black or half-tone images, or rising of initial image density. In particular, the advantageous effect is significant in a high temperature and high humidity environment. Polishing processing with felt or an abrasive machined, band-shaped polishing material is applied, whereby the irregularities on the sleeve surface can be finished uniformly, and thus, the toner coat quantity on the sleeve is uniformed. As a result, only the toner subjected to frictional electrification with the sleeve is carried into a developing area. Therefore, the aforementioned advantageous effect is achieved.

After the smoothing treatment has been applied as described above, the surface of the coat layer preferably maintains irregularities within the range of 0.2 to 3.5 $\mu$m in average roughness Ra of JIS B 0601, and more preferably maintains about 0.3 to 2.5 $\mu$m for the reason as stated above.

As a cylindrical base body 6, there is preferably employed a non-magnetic metal cylinder tube or a resin cylinder. For example, there are employed non-magnetic cylinder tubes such as a stainless steel cylinder tube, an aluminum cylinder tube, a copper alloy cylinder tube. Methods for producing such cylinder tubes include drawing or extrusion. Further, in the case where dimensional accuracy of the cylinder tube itself is increased, cutting or polishing is applied to obtain predetermined dimensional accuracy. The degree of straightness of the cylinder tube is preferably 30 $\mu$m or less, and further, is more preferably 20 $\mu$m or less, whereby high quality images are obtained. A rough surface may be formed by sand blast or polishing in order to impart proper irregularities on the surface as required. Abrasive powders employed for such blast may be regularly shaped particles or irregularly shaped particles.

Figure 4:
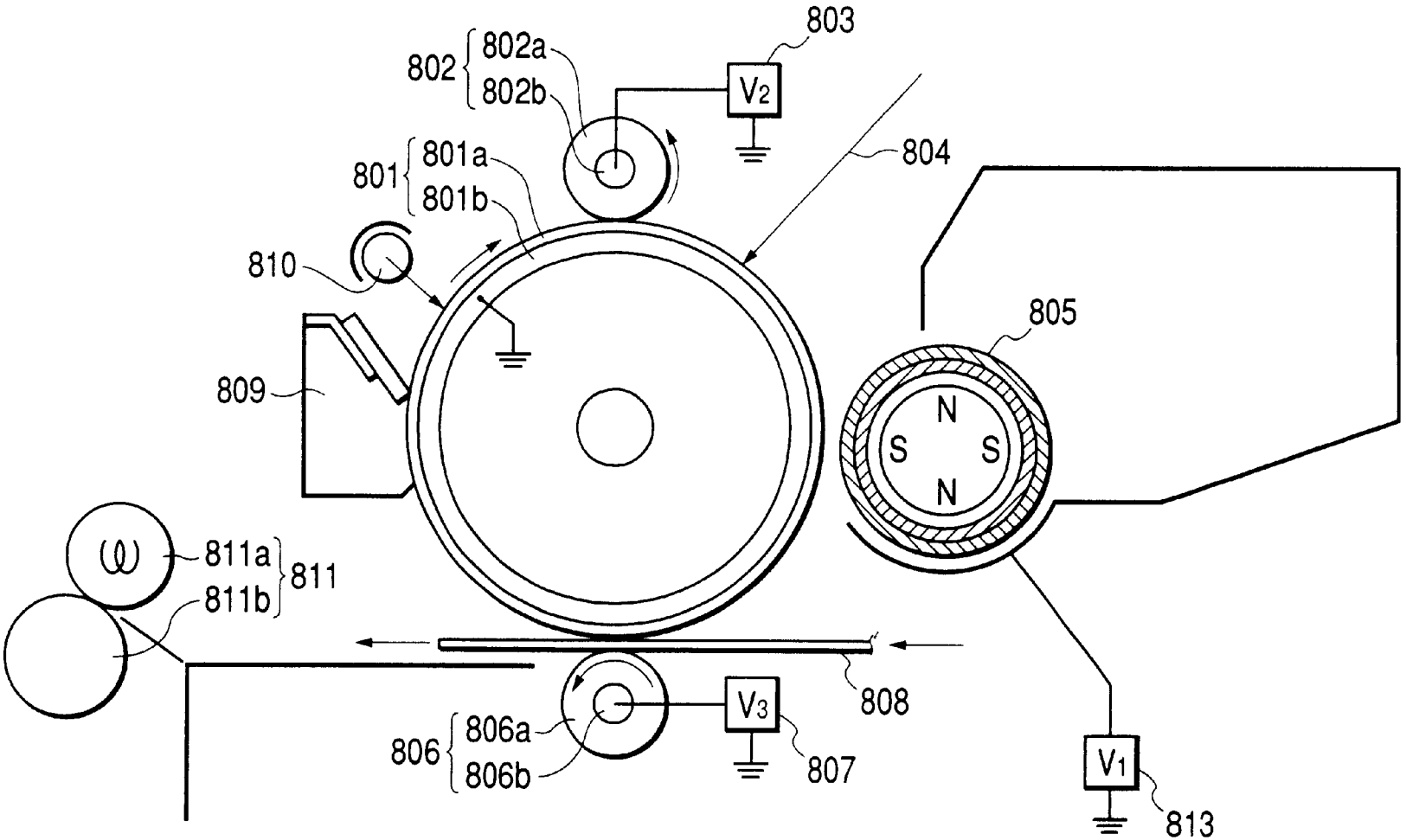
FIG. 4 is a schematic diagram illustrating the image forming method.

An image forming method to which the developing method of the present invention is applicable will be described with reference to an image forming apparatus having contact electrification means and contact transfer means schematically illustrated in FIG. 4. The developing method of the present invention is applicable to an image forming method using a corona electrification system and/or a corona transfer system.

A rotation drum shaped photosensitive element 801 having an photo conductive layer 801*a* and a electrically conductive base layer 801*b* is rotated at a predetermined peripheral speed (process speed) in the rotation direction of the needles of a clock on the drawing. A bias is applied to an electrification roller 802 having an electrically conductive resilience layer 802*a* and a cored bar (or mandrel) 802*b* by an electrification bias power source 803. The electrification roller 802 is brought into pressure contact with the photosensitive element 801 by pressurization force, and is rotated together with rotation of the photosensitive element 801.

A bias $V_2$ is applied to the electrification roller 802, whereby the surface of the photosensitive element 801 is electrified with a predetermined polarity and electric potential. Then, electrostatic images are formed by image exposure 804, and is sequentially visualized as a toner image by developing means 805.

A bias $V_1$ is applied to a developing sleeve constituting the developing means 805 by developing bias applying means 813. The toner image formed on a image carrier by the development is electrostatically transferred to a transfer member 808 by a transfer roller 806 (electrically conductive resilience layer 806*a* or a cored bar 806*b*) being contact transfer means in which a transfer bias $V_3$ is applied by a transfer bias power source 807. Then, the toner image on the transfer member is fixed to be heated and pressurized by heating and pressurizing means 811 having a heating roller 811*a* and a pressurizing roller 811*b*. On the surface of the photosensitive element 801 after toner image has been transferred, deposited contaminated substances such as transferred toner residue are surface-cleaned by a cleaning device 809 comprising a resilient cleaning blade brought into pressure contact with the photosensitive element 801 in the counter direction. Further, electricity is decharged by an electricity decharge exposure device 810, and images are repeatedly produced.

Although the primary electrification means has been described above by means of the example of the electrification roller 802 as contact electrification means, there may be employed contact electrification means such as an electrification blade or electrification brush, and further, there may be employed non-contact corona electrification means. The contact electrification means is preferable because it reduces the generationi of ozone in the electrification step more significantly. Although the transfer means has been described above by means of the example of the transfer roller 806, there may be employed contact electrification means such as a transfer blade or transfer belt, and further, there may be employed non-contact corona transfer means. The contact transfer means is preferable because it reduces the generation of ozone in the transfer process more significantly.

Figure 5:
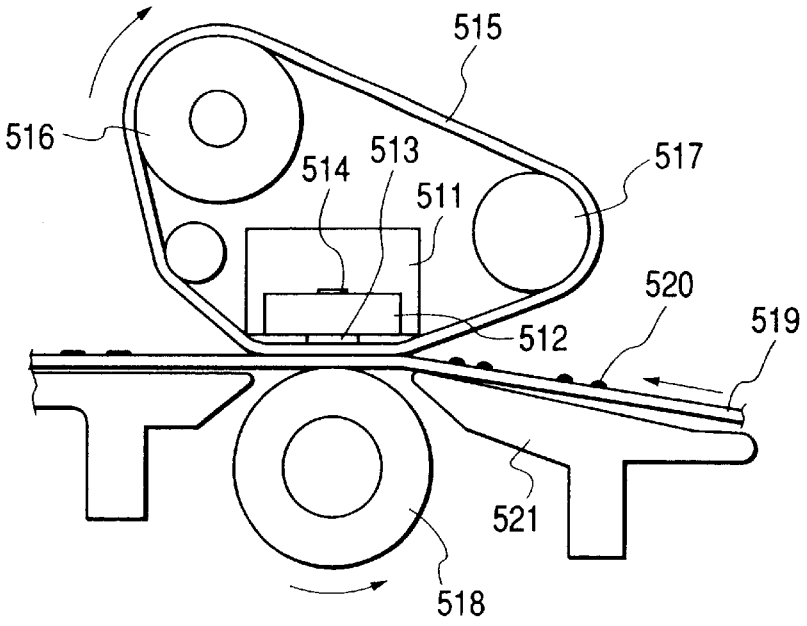
FIG. 5 is a schematic diagram illustrating a fixing apparatus that can be applied to the image forming method.

Furthermore, another fixing method applicable to the image forming method of the present invention will be described by means of an example of the fixing means shown in FIG. 5. FIG. 5 shows a means for heating a recording material 511 on which a toner image is formed by using a fixedly supported heating element 511, and fixing the recording material to the heating element by a pressurizing roller 518 which brings the recording material into pressure contact with the heating element and brings the recording material into contact with the heating element via a film 515.

In the fixing device shown in FIG. 5, the heating element 511 has small heat capacity than a conventional heat roll, and has a linear heating section. The maximum temperature of the heating section is preferably 100 to 300° C.

In addition, a fixing film 515 positioned between the heating element 511 and a pressurization roller 518 being a pressurization member is preferably a heat resistance sheet having of 1 to 100 $\mu$m in thickness. As these heat resistance sheet, there are employed polymer sheets such as high heat-resistance polyester, PET (polyethylene telephthalate), PFA (tetrafluoroethylene-perfluoroalkylvinylether copolymer), PTFE (polytetrafluoroethylene), polyimide, or polyamide; metal sheets such as aluminum; and a laminate sheet comprised of the metal sheet and polymer sheet.

A more preferable fixing film structure is such that these heat resistance sheets each have a release layer and/or a low resistance layer.

Reference numeral 511 denotes a linear heating element with its low heat capacity fixedly supported by the apparatus. As an example, a resistance material 513 of 1.0 mm in width is applied to an alumina substrate 512 of 1.0 mm in thickness, 10 mm in width, and 240 mm in longitudinal length, and electricity is applied thereto both ends in the longitudinal direction. In supplying power, pulses having a pulse shaped waveform of 20 msec in 100 DCV controlled by a temperature detecting element 514, are imparted by changing their pulse width according to a desired temperature or energy radiation quantity. The substantial pulse width is 0.5 millisecond to 5 milliseconds. Thus the fixing film 515 is moved in the direction indicated by the arrow in the figure in contact with the heating element 511 whose energy and temperature are controlled.

An example of this fixing film is an endless film coated with a release layer by 10 μm in which an electrical conducting agent is applied to a heat resistance film of 20 μm in thickness (for example, polyimide, polyether imide, PES, PFA, and fluorine resins such as PTFE or PAF applied to at least a face coming into contact with images). The total thickness is generally less than 100 μm, and is more preferably less than 40 μm. The film is driven by means of a driving roller 516 and a follower roller 517 or due to tension without causing wrinkles in the direction indicated by the arrow.

Reference numeral 518 denotes a pressurization roller having a rubber resilience layer with its good release properties such as silicone rubber, wherein the roller pressurizes a heating element at a total pressure of 4 to 20 kg via a film, and rotates in pressure contact with the film. An unfixed toner 520 on a recording material 519 is guided to a fixing section by an inlet guide 521, and a fixed image is obtained by the aforementioned heating.

Although the fixing film 515 has been described by means of example of an endless belt, the fixing film may be an film with its ends using a sheet feeding shaft and a winding shaft.

A developing apparatus using a two-component based developing agent will be described below.

Figure 6:
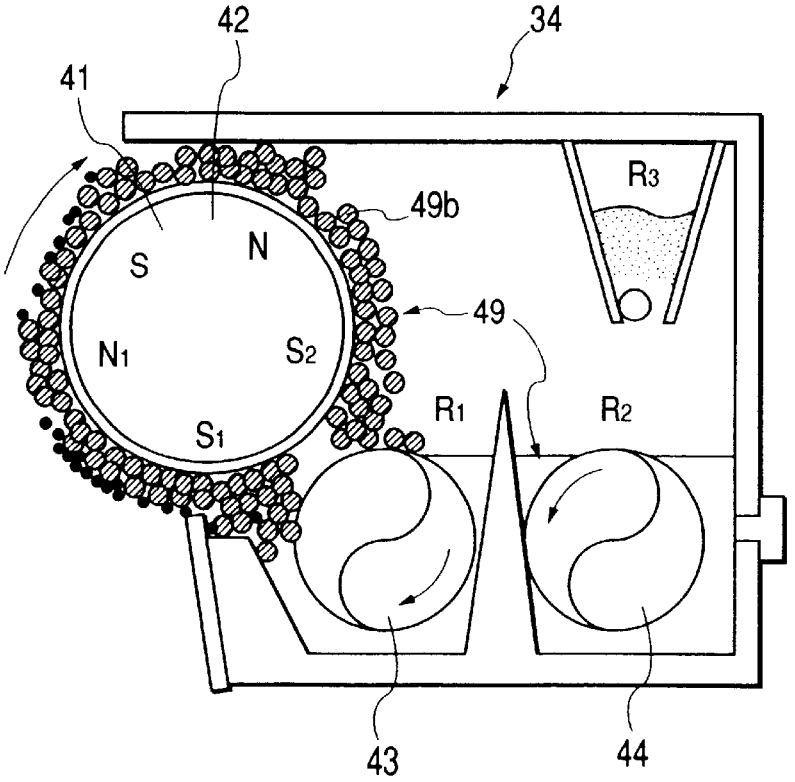
FIG. 6 is schematic diagram illustrating a developing apparatus using a two-component developing agent.

FIG. 6 is a schematic view illustrating a developing apparatus using a two-component based developing agent, wherein a two-component based developing agent 49 obtained by mixing a toner and a magnetic carrier is put in a developing agent chamber $R_1$ and a stirring chamber $R_2$. The two-component based developing agent 49 is carried while it is mixed and stirred by screws 43 and 44, and circulates the developing agent chamber $R_1$ and the stirring chamber $R_2$. A toner storage chamber $R_3$ having a replenishment toner is provided at the upper part of the stirring chamber $R_2$. Together with the rotation of the developing sleeve 41, the two-component based developing agent transported to the developing agent chamber $R_1$ is carried onto the surface of a developing sleeve 41 by magnetic force that a magnet roller 42 has, whereby a magnetic brush 49*b* is formed. Then, the magnetic brush is brought into contact with the surface of a photosensitive drum, whereby the electrostatic images carried on the surface of the photosensitive drum are developed.

A method for measuring physical properties of the toner according to the present invention will be described below.

(1) Measurement of Acid Value

An acid value is measured in conformance with a measuring method described in JIS K0070.

Measuring instrument: Potential difference automatic titration instrument AT-400 (available from Kyoto Electronics Co., Ltd.)

Equipment calibration: A mixture solvent of 120 ml toluene and 30 ml ethanol is used.

Measuring temperature: 25° C.

Preparation of samples: 1.0 g toner is added to 120 ml toluene, and the added solution is stirred by means of a magnetic stirrer at room temperature (about 25° C.) for about 10 hours to be dissolved. Further, 30 ml ethanol is added to make a sample solution.

Measuring steps:

1) When a sample is used, additives other than binder resin (a polymer component) is removed in advance or the acid value and contents of components other than binder resin and cross-linked binder resin are obtained in advance. A milled sample of 0.5 to 2.0 (g) is precisely measured, and the weight of the polymer component is defined as W (g). For example, in the case where the acid value of the binder resin is measured for the toner, the acid value and contents of a coloring agent, magnetic material, etc., are measured separately. Then, the acid value of the binder resin is obtained by calculation.

2) A sample is placed in a 300 (ml) beaker, and a 150 (ml) mixture solution of toluene/ethanol (4/1) is added to be dissolved.

3) Titration is carried out by using an ethanol solution of 0.1 mol/l KOH and a potential difference titration instrument (for example, automatic titration can be carried out by using potential difference titration instrument AT-400 (win workstation) available from Kyoto Electronics Co., Ltd. and the ABP-410 electrically driven burette).

4) At this time, the quantity of the KOH solution is defined as S (ml). At the same time, a blank is measured, and the quantity of the KOH solution is defined as B (ml).

5) An acid value is calculated by the following formula, wherein f denotes a factor of KOH.

$$\text{Acid value (mgKOH/g)}=\{(S-B)\times f\times 5.61\}/W$$

(2) Measuring Molecular Weight of THF Soluble Matter

A molecular weight distribution of the THF soluble matter of a binder resin or a toner is measured by GPC using THF (tetrahydrofran) as a solvent under the following conditions, in which a molecular weight of 1,000 or more is measured.

A column is stabilized in a heat chamber of 40° C., THF is poured as a solvent at a flow rate of 1 ml per minute into the column at this temperature, and the THF sample solution is poured by about 100 μl to be measured. In measuring the molecular weight of the sample, the molecular weight distribution that the sample has was calculated based on a relationship between the logarithmic value of a calibration curve prepared by several kinds of monodispersed polystyrene standard samples and the count value thereof. As a standard polystyrene sample for preparing the calibration curve, for example, there is employed a sample whose molecular weight measured by the measuring instruments available from Toso Co., Ltd. or Showa Denko Co., Ltd. is about $10^2$ to $10^7$. Properly, at least 10 standard polystyrene samples are employed. In addition, an RI (Reference Index) detector is employed as a detector. As a column, a plurality of commercially available polystyrene gel columns are preferably used in combination. For example, there can be exemplified combinations such as a combination of shodex GPC KF-801, 802, 803, 804, 805, 806, 807, and 800P available from Showa Denko Co., Ltd. or a combination of TSKgel G1000H (HXL), G2000H (HXL), G3000H (HXL), G4000H (HXL), G5000H (HXL), G6000H (HXL), G7000H (HXL), and TSKgurd column.

From the GPC molecular weight distribution obtained by the above method, there are obtained the content of the component of each molecular weight region; a main peak molecular weight; and a sub-peak or shoulder position.

A sample is produced in the following manner.

A sample is placed in THF, and is left standing for several hours. Then, the sample is well stirred to be well mixed with the THF (until the integration of the sample has been eliminated), and further, is statically left for 12 hours or more. At this time, it should be retained in the THF for 24 hours or more. Thereafter, the sample is filtrated through a sample treatment filter (pore size: 0.2 to 0.5 micron, for example, Maishori Disk H-25-2 (available from Toso Co., Ltd.) or the like) to make the GPC sample. In addition, the concentration of the sample is adjusted so that the resin component is 0.5 to 5 mg/ml.

(3) Measuring THF Insoluble Component

A 0.5 to 1.0 g toner sample is measured ($W_1$ g), cylinder filtration paper (for example, No. 86R available from Toyo Roshi Co., Ltd.) is placed in the sample to be subjected to a Soxhlet extractor. Then, 200 ml THF is employed as a solvent to carry out extraction for 10 hours. Then, a soluble component solution extracted by the solvent is evaporated, and then, is vacuum-dried at 100° C. for several hours. The quantity of the THF soluble resin component is measured ($W_2$ g). The weight of components other than the resin component in the toner is obtained ($W_3$ g). The THF insoluble component is obtained by the Equation below.

$$THF \text{ insoluble component} = \frac{(W_1 - (W_3 + W_2))}{W_1 - W_3} \times 100 \text{ (weight \%)}$$

Alternatively, the extracted component ($W_4$ g) is measured, and the THF insoluble component may be obtained by the formula below.

$$THF \text{ insoluble component} = \frac{W_4 - W_3}{W_1 - W_3} \times 100 \text{ (weight \%)}$$

(4) Measuring the Melting Point of Wax

The melting point of wax is measured in conformance with ASTM D3418-82 using a differential scanning calorimeter (DSC measuring instrument) DSC-7 (Available from Parkin Elmer Co., Ltd.).

A target sample of 2 to 10 mg and preferably 5 mg is precisely measured.

The measured sample is placed in an aluminum pan, and an empty aluminum pan is employed as a reference, and measurement is carried out under normal temperature and humidity at a temperature rise velocity of 10° C. per minute within the measurement temperature range of 30 to 200° C.

In this temperature rise process, an endothermic peak that is the main peak of a DSC curve within the temperature range of 30 to 200° C. is obtained. The melting point of wax is defined by this temperature of the endothermic main peak.

(5) Measuring the Toner DSC Curve

A DSC curve in the toner temperature rise process is measured in a manner similar to the above measurement of the melting point of wax.

(6) Measuring the Glass Transition Temperature (Tg) of a Binder Resin

The glass transition temperature is measured in conformance with ASTM D3418-82 using a differential scanning calorimeter (DSC measuring instrument) DSC-7 (available from Parkin Elmer Co., Ltd.).

A target sample of 5 to 20 mg and preferably 10 mg is precisely measured.

The measured sample is placed in an aluminum pan, and an empty aluminum pan is employed as a reference, and measurement is carried out under normal temperature and humidity at a temperature rise velocity of 10° C. per minute within the temperature range of 30 to 200° C. In this temperature rise process, an endothermic peak being the main peak within the temperature range of 40 to 100° C. is obtained.

An intersection of a line of an intermediate point of the base lines before and after the endothermic peak appears and a differential thermal curve is defined as a glass transition temperature Tg in the present invention.

(7) Measuring a Wax Molecular Weight Distribution

GPC measuring instrument: GPC-150C (Available from Waters Co., Ltd.)

Column: GMH-HT 30 cm tandem column (Available from Toso Co., Ltd.)

Temperature: 135° C.

Solvent: o-dichlorobenzene (0.1% ionol is added)

Flow rate: 1.0 ml per minute

Sample: 0.15% sample of 0.4 ml is poured

In the measurement under the above conditions and calculation of the molecular weight of a sample, there is used a molecular weight calibration curve prepared by a monodispersion polystyrene standard sample. Further, this value is calculated by polystyrene conversion using a conversion formula derived from the Mark-Houwink viscosity formula to convert it into polystyrene.

(8) Measuring the Contact Angle of the Toner to Water

Measuring temperature: FACE contact angle measuring instrument (available from Kyowa Kaimen Kagaku Co., Ltd.)

Measuring temperature: 23 to 25° C.

Measuring humidity: 40 to 60% in relative humidity

Preparation of sample: A toner of about 10 g is compressed and molded for 2 minutes under a pressure of 200 kgf/cm$^2$, and a disc shaped sample of 25 mm in diameter and about 10 mm in thickness is prepared. This sample is placed in a glass based sample bottle of about 27 mm in inner diameter (for example, snap-cup No. 30), and a pressure of 5 to 10 kgf/cm$^2$ is applied thereto for about 5 to 10 minutes on a hot plate heated at 100 to 120° C. via a Teflon based sheet. When the toner is softened and fused, it is cooled to room temperature. Then, the glass based sample bottle is destroyed, and the toner fused and molded materials are removed. These materials are sequentially polished by using polishing agents #280, #800, and #1500, thereby making a disc shaped sample of 25 mm in diameter and 5 mm in thickness. A measurement face of a contact angle is finished so as to be free of being damaged through visual check. For measurement, ion exchange water or commercially available refined water is used, five contact angles are measured for each sample, and the contact angle of the toner to water is obtained by calculating the average value of these measured angles.

(9) Measuring Toner Particle Size Distribution

In measuring the toner particle size distribution, Coulter Counter TA-II model or Coulter Multisizer (available from Coulter Co., Ltd.) is employed. For an electrolyte, 1% NaCl aqueous solution is prepared using class 1 NaCl. For example, ISOTON R-II (available from Coulter Scientific Japan Co., Ltd.) can be used. In measuring the distribution, a surface active agent or preferably alkyl benzene sulfonic acid salt of 0.1 to 5 ml is added as a dispersion agent into the electrolytic solution of 100 to 150 ml, and further, a measurement sample of 2 to 20 mg is added. An electrolyte having the sample suspended thereby is subjected to dispersion treatment for about 1 to 3 minutes by using a ultrasonic dispersion device. By using the measuring instrument, a 100 micron aperture is employed as an aperture, whereby the particle volume and quantity of the toner of 2 μm or more are measured for each channel, and the volume distribution and the quantity distribution are calculated. From the volume distribution of the obtained toner particles, the weight average toner particle size (D4) is obtained. In addition, from the quantity distribution, the quantity average particle size (D1) is obtained.

As measurement channels, there are employed 13 channels each of which is equal to 2.00 μm and less than 2.52 μm; is equal to 2.52 μm and less than 3.17 μm; is equal to 3.17 μm and less than 4.00 μm; is equal to 4.00 μm and less than 5.04 μm; is equal to 5.04 μm and less than 6.35 μm; is equal to 6.35 μm and less than 8.00 μm; is equal to 8.00 μm and less than 10.08 μm; is equal to 10.08 μm and less than 12.70

μm; is equal to 12.70 μm and less than 16.00 μm; is equal to 16.00 μm and less than 20.20 μm; is equal to 20.20 μm and less than 25.40 μm; is equal to 25.40 μm and less than 32.00 μm; and is equal to 32.00 μm and less than 40.30 μm.

(10) Measuring the Dielectric Dissipation Factor of the Toner

Calibration is carried out at a frequency of 1 kHz and 1 MHz using a 4284A Precision LCR Meter (available from Hewlet Packard), and the dielectric dissipation factor (tan $\delta = \in''/\in'$) is calculated from the measured values of the complex permittivity at a frequency of 100 kHz.

A toner of 0.5 to 0.7 g is measured, and a load of 400 $Kgf/cm^2$ is molded for 2 minutes to make a disc shaped, measured sample of 25 mm in diameter and 1 mm or less in thickness (preferably, 0.5 to 0.9 mm). This measured sample is changed on ARES (Leometric Scientific FE Co., Ltd.) on which a permittivity measuring jig of 25 mm in diameter (electrode) is mounted, and is heated to a temperature of 150° C. to be fused and fixed. Thereafter, the sample is cooled to a temperature of 25° C. and a load of 500 g is applied to the cooled sample. In this situation, the particle size distribution is obtained by measuring the sample within the frequency range of 100 Hz to 1 MHz inclusive of 100 kHz.

EMBODIMENT

The present invention is described below with reference to production examples and embodiments.

[Production of a low molecular weight polyester resin]

Production Example 1

| | |
|---|---|
| Terephthalic acid | 42 mol % |
| Isophthalic acid | 3 mol % |
| Adipic acid | 2 mol % |
| A derivative of bisphenol A expressed by the Equation (3) (R: ethylene group, x + y = 2.2) | 53 mol % |

An esterifying catalyst was added to the carboxylic acid and alcohol as described above to carry out polycondensation, obtaining a polyester resin (L-1) containing substantially no THF-insoluble matter and having the acid value of 11 mgKOH/g.

Production Example 2

A low molecular weight polyester (L-2) was obtained by the same method as in Production example 1 excluding addition of a wax (3), presented in Table 3, of which quantity became 10 parts by weight, when the sum quantity of an acid component and alcohol component was assumed as 100 parts by weight.

Production Example 3

| | |
|---|---|
| Terephthalic acid | 42 mol % |
| Isophthalic acid | 3 mol % |
| Adipic acid | 2 mol % |
| A derivative of bisphenol A expressed by the formula (3) (R: ethylene group, x + y = 2.2) | 50 mol % |

· Wax (2), of which quantity makes three parts by weight, when the sum quantity of such acid component and alcohol component as described above is assumed as 100 parts by weight.

(Average value of a is 40)

A low molecular weight polyester (L-3) was obtained by the same method as that of manufacturing example 1, as described above, based on the formulation as described above.

Production Example 4

| | |
|---|---|
| Terephthalic acid | 5 mol % |
| Fumaric acid | 35 mol % |
| trimellitic acid | 17 mol % |
| A derivative of bisphenol A expressed by the formula (3) (R: ethylene group, x + y = 2.2) | 18 mol % |
| A derivative of bisphenol A expressed by the formula (3) (R: propylene group, x + y = 2.2) | 25 mol % |

A polyester resin (L-4) containing substantially no THF-insoluble matter and having the acid value of 36 mgKOH/g was obtained by the same method as that of the manufacturing example 1 excluding the use of such carboxylic acid and alcohol as described above.

Production Example 5

| | |
|---|---|
| Terephthalic acid | 30 mol % |
| Adipic acid | 20 mol % |
| Trimellitic acid | 3 mol % |
| A derivative of bisphenol A expressed by the formula (3) (R: propylene group, x + y = 2.2) | 47 mol % |

The polyester resin (L-5) containing substantially no THF-insoluble matter and having the acid value of 16 mgKOH/g was obtained by the same method as that of the manufacturing example 1 excluding the use of such carboxylic acid and alcohol as described above.

[Production of a High Molecular Weight Polyester Resin]

Production Example 6

| | |
|---|---|
| Terephthalic acid | 23 mol % |
| Adipic acid | 10 mol % |
| trimellitic acid | 19 mol % |
| A derivative of bisphenol A expressed by the formula (3) (R: propylene group, x + y = 2.2 | 48 mol % |

A high molecular weight polyester resin (H-1) having the acid value of 9 mgKOH/g and about 38 weight % of THF-insoluble matter was obtained by polycondensation of such carboxylic acid and an alcohol as described above.

Production Example 7

A high molecular weight polyester (H-2) was obtained by the same method as in Production example 6 excluding addition of the wax (3) of which quantity became 10 parts by weight, when the sum quantity of the acid component and the alcohol component was assumed as 100 parts by weight.

Production Example 8

| | |
|---|---|
| Terephthalic acid | 20 mol % |
| Adipic acid | 18 mol % |
| Trimellitic acid | 11 mol % |
| A derivative of bisphenol A expressed by the formula (3) (R: propylene group, x + y = 2.2) | 32 mol % |
| A derivative of bisphenol A expressed by the formula (3) (R: ethylene group, x + y = 2.2) | 16 mol % |

· Wax (2) of which quantity makes 3 parts by weight, when the sum quantity of such acid component and alcohol component as described above is assumed as 100 parts by weight.

(Average value of a is 40)

The high molecular weight polyester (H-3) was obtained by the same method as that of manufacturing example 6, as described above, based on the formulation as described above.

Production Example 9

A high molecular weight polyester (H-4) was obtained by the same method as in Production example 8 excluding replacement of the wax to the wax (3) of which quantity became 10 parts by weight, when the sum quantity of such acid component and alcohol component as described above was assumed as 100 parts by weight.

Production Example 10

A high molecular weight polyester (H-5) was obtained by the same method as in Production example 8 excluding replacement of the wax (2) to the wax (1) of which quantity makes 10 parts by weight, when the sum quantity of such acid component and alcohol component as described above was assumed as 100 parts by weight.

Production Example 11

A high molecular weight polyester (H-6) was obtained by the same method as in Production example 8 excluding replacement of the wax (2) to the wax (5) of which quantity became 10 parts by weight, when the sum quantity of such acid component and alcohol component as described above was assumed as 100 parts by weight.

Production Example 12

| | |
|---|---|
| Fumaric acid | 39 mol % |
| Trimellitic acid | 17 mol % |
| A derivative of bisphenol A expressed by the formula (3) (R: propylene group, x + y = 2.2) | 26 mol % |
| A derivative of bisphenol A expressed by the formula (3) (R: ethylene group, x + y = 2.2) | 18 mol % |

The polyester resin (H-7) having a 27 weight % of THF-insoluble matter and the acid value of 32 mgKOH/g was obtained by the same method as that of the manufacturing example 6, excluding the use of such carboxylic acid and alcohol as described above.

Production Example 13

A high molecular weight polyester (H-8) was obtained by the same method as in Production example 12 excluding addition of the wax (3) of which quantity became 10 parts by weight, when the sum quantity of such acid component and alcohol component as described above was assumed as 100 parts by weight.

Production Example 14

| | |
|---|---|
| Fumaric acid | 35 mol % |
| Trimellitic acid | 20 mol % |
| A derivative of bisphenol A expressed by the formula (3) (R: ethylene group, x + y = 2.2) | 15 mol % |
| A derivative of bisphenol A expressed by the formula (3) (R: propylene group, x + y = 2.2) | 25 mol % |

The polyester resin (H-9) having about 42 weight % of THF-insoluble matter and the acid value of 34 mgKOH/g was obtained by the same method as that of the manufacturing example 6 excluding the use of such carboxylic acid and alcohol as described above.

Production Example 15

A high molecular weight polyester (H-10) was obtained by the same method as in Production example 14 excluding addition of the wax (4) of which quantity became 10 parts by weight, when the sum quantity of such acid component and alcohol component as described above was assumed as 100 parts by weight.

Comparative Manufacturing Example 1

| | |
|---|---|
| Terephthalic acid | 30 mol % |
| trimellitic acid | 15 mol % |
| Stearyle alcohol | 25 mol % |
| 1, 2, 3-propane triol | 25 mol % |

The polyester resin (1) for comparison use having about 82% part insoluble in THF and the acid value of 1 mgKOH/g was obtained by polycondensation of such carboxylic acid and alcohol as described above.

Comparative Manufacturing Example 2

A polyester resin (2) for comparison use, was obtained by the same method as that of the manufacturing example 1 excluding addition of a wax (6) of which quantity became 5 parts by weight, when the sum quantity of such acid component and alcohol component as described above was assumed as 100 parts by weight.

Comparative Manufacturing Example 3

| | |
|---|---|
| Terephthalic acid | 35 mol % |
| trimellitic acid | 15 mol % |
| Ethylene glycol | 45 mol % |

The polyester resin (3) for comparison use containing substantially no THF-insoluble matter and having the acid value of 46 mgKOH/g was obtained by polycondensation of such carboxylic acid and alcohol as described above.

Embodiment 1

| | |
|---|---|
| Low molecular weight polyester (L - 1) | 50 parts by weight |
| High molecular weight polyester (H - 1) | 50 parts by weight |
| Magnetic material | 90 parts by weight |
| (Average particie diameter 0.22 um, coercive force 9.6 kA/m, saturation magnetization 83 $Am^2/kg$, residual magnetization 15 $Am^2/kg$) | |
| Wax (3) | 5 parts by weight |
| Aluminium compound of benzilic acid | 3 parts by weight |

(A Compound Consisting of 2 mol of Benzilic Acid Having No Substituent and 1 Atom of Aluminium)

A mixture of raw materials as described above was melted and kneaded by using a double-screw muller-extruder heated to 130° C. Mulled material was left standing to be cooled, crushed by a cutter mill and pulverized, preparing a very fine powder by a jet mill. The very fine powder obtained was classified with a pneumatic classifier to yield a magnetic toner with a weight-average particle size of 7.3 $\mu$m.

To this magnetic toner of 100 parts by weight, hydrophobic dry silica (BET specific surface area 220 $m^2/g$) of 1.0 parts by weight was externally added and mixed by means of a Henschel mixer, producing a magnetic toner (1).

The THF-insoluble matter content of the toner, as shown in Table 4, was determined to be 37% by weight based on the binder resin. Measurement of the molecular weight of the THF-soluble matter shows a peak molecular weight of 7,200 and contained 11 weight % of the component of the molecular weight ranging from 100,000 or higher to less than 10,000,000, 63 weight % of the component of the molecular weight ranging from 5,000 or higher to less than 100,000, and 21 weight % of the component of the molecular weight ranging from 1,000 or higher to less than 5,000. On the other hand, measurement of the toner shows the acid value of 20 mgKOH/g. Table 4 shows respective physical properties of the toner and the binder resin contained in the toner.

Imaging characteristics and a condition of the toner attaching to a fixing member were evaluated by using this toner in Canon-made copying machines GP-215 and NP-6085 in an environment of normal temperature and normal humidity (23.5° C./60% RH). The results obtained were good as shown in Table 5.

Next, an instrument for testing a fixing performance was fabricated by removing the fixing apparatus of the NP-6085 followed by fitting an external driving machine, an apparatus regulating the temperature of the fixing apparatus, and a machine controlling the pressure of a roller. A test of fixing at a low temperature was carried out by setting a rolling speed of the roller to 150 mm/sec and total pressure to 40 kgf and using an unfixed image developed with the toner to give a image density of 1.2, and setting the surface temperature of the roller to 150° C. In addition, a high-temperature resistant offset performance was evaluated by setting the surface temperature of the roller to 220° C. The good results of these tests are presented in Table 5.

Embodiments 2–14

Magnetic toner (2) to (14) of the present invention were prepared and evaluated in the same method as in Embodiment 1 excluding the use of polyester and the wax shown in Table 4.

Embodiment 15

Magnetic toner (15) of the present invention was prepared and evaluated in the same method as in Embodiment 1 excluding replacement of the aluminum compound of benzilic acid to a compound comprised of 2 mol benzilic acid having a t-butyl group at para position of each aromatic ring and 1 mol of aluminum atom.

Comparative Example 1

| | |
|---|---|
| Polyester resin for comparison (1) | 100 parts by weight |
| Magnetic material | 90 parts by weight |
| (Average particle size 0.22 $\mu$m, coercive force 9.6 kA/m, saturation magnetization 83 $Am^2/kg$, and residual magnetization 15 $Am^2/kg$) | |
| Wax (6) | 5 parts by weight |
| Boron compound of benzilic acid | 3 parts by weight |

(A Compound Consisting of 2 mol of Benzilic Acid Having No Substituent and One Mol of Boron Atom)

The magnetic toner (1) for comparison use was prepared by the same method as that of the embodiment 1 excluding the use of the polyester resin, the wax etc. as described above. The result of evaluation is shown in Table 5.

Comparative Example 2

The magnetic toner (2) for comparison use was prepared by the same method as in the Comparative example 1 excluding replacement of the binder resin to 105 parts by weight of the polyester (2) for comparison and no use of the wax (6). The result of evaluation is shown in Table 5.

Comparative Example 3

The magnetic toner (3) for comparison use was prepared by the same method as in the Comparative example 1 excluding replacement of the binder resin to 100 parts by weight of the polyester (3) for comparison and replacement of the wax to a wax (7). The result of evaluation is shown in Table 5.

Comparative Example 4

The magnetic toner (4) for comparison use was prepared by the same method as in the Comparative example 1 excluding replacement of the boron compound of benzilic acid to an aluminium compound of benzilic acid (a compound consisting of 2 mol of benzilic acid having no substituent and 1 mol of aluminium), and evaluated.

Comparative Example 5

The magnetic toner (5) for comparison use was prepared by the same method as in Comparative example 3 excluding replacement of the boron compound of benzilic acid to an aluminium compound of benzilic acid (a compound consisting of 2 mol of benzilic acid having no substituent and 1 mol of aluminium) and evaluated.

Ranks of fixing performance at low temperatures (rubbed by adding a load of 50 $g/cm^2$).

- Rank 5: ratio of concentration (or density) decreased by rubbing is less than 5%.
- Rank 4: ratio of concentration decreased by rubbing is less than 10%.
- Rank 3: ratio of concentration decreased by rubbing is less than 15%.
- Rank 2: ratio of concentration decreased by rubbing is less than 20%.
- Rank 1: ratio of concentration decreased by rubbing is no less than 20%.

Ranks of hot offset
- Rank 5: never occurred.
- Rank 4: very small offset, but allowable practically.
- Rank 3: easily viewable offset occurred.
- Rank 2: distinct offset occurred.
- Rank 1: a paper rolled around the roller.

Ranks of stain (or contamination) of the heating member of the fixing apparatus by the toner
- Rank 5: stain with the toner was never observed.
- Rank 4: light stain was observed, but allowable practically.
- Rank 3: easily viewable stain occurred.
- Rank 2: distinct stain occurred.
- Rank 1: staining toner attached to the surface and back surface of paper.

Evaluation on blocking of the toner (evaluation was carried out after standing in a 50° C. environment for 72 h).
- Rank 5: no change was observed in fluidity of the toner.
- Rank 4: fluidity of the toner slightly decreased.
- Rank 3: aggregated particles of the toner were observed, but easily broken.
- Rank 2: aggregated particles, having cores, of the toner were observed, and not completely broken.
- Rank 1: caking was observed.

Production Example 16

| | |
|---|---|
| Terephthalic acid | 28 mol% |
| Isophthalic acid | 21.5 mol% |
| Fumaric acid | 2.5 mol% |
| A derivative of bisphenol A expressed by the formula (3) (R: ethylene group, x + y = 2.2 | 48 mol% |

An unsaturated polyester resin (U-1) which constitutes polyester units of a hybrid resin component, containing substantially no THF-insoluble matter and having an acid value of 7 mgKOH/g, a glass transition temperature (Tg) of 61° C., and a peak molecular weight of 9500, was obtained by polycondensation through addition of an esterifying catalyst to such carboxylic acid and an alcohol as described above.

Next, xylene of 200 parts by weight was put in a reaction container comprising a reflux tube, a mixer, a thermometer, a nitrogen introducing tube, a dropping apparatus and a pressure reducing apparatus, and then, the above described unsaturated polyester resin (U-1) of 100 parts by weight was added and the internal temperature of the reaction container was raised up to 115 to 120° C. while introducing nitrogen. Subsequently, a radical polycondensation reaction was carried out for 8 hours by using a monomer mixture consisting of styrene of 84 parts by weight, and butyl acrylate of 16 parts by weight, which made up vinyl-based polymer units, with addition of di-t-butyl peroxide of one parts by weight as an initiator of polymerization. The measurement of the molecular weight and acid value of the hybrid resin composition yielded by removing xylene shows that a main peak appeared in a molecular weight of 5500, the glass transition temperature (Tg) was 67.3° C., the acid value was 5.4 mgKOH/g, and a THF-insoluble matter was about 21 parts by weight. This is defined as the hybrid resin composition (Y-1) of the present invention.

Production Example 17

A hybrid resin component (Y-2) having a main peak molecular weight of 7500, the glass transition temperature (Tg) of 64.7° C., the acid value of 12.9 mgKOH/g, and about 21 parts by weight of THF-insoluble matter was yielded by the same as in production example 16 method excluding the use of a monomer mixture consisting of styrene of 77 parts by weight, butyl acrylate of 24 parts by weight, and methacrylic acid of 3 parts by weight which made up vinyl-based polymer units.

Production Example 18

A hybrid resin component (Y-3) having a main peak molecular weight of 13,000, the glass transition temperature (Tg) of 64.7° C., the acid value of 14.2 mgKOH/g, and about 35 parts by weight of THF-insoluble matter was yielded by the same method as in Production example 16 excluding the use of a monomer mixture consisting of styrene of 74 parts by weight, butyl acrylate of 24 parts by weight, and acrylic acid of 3 parts by weight which made up vinyl-based polymer units.

Production Example 19

A hybrid resin component (Y-4) having the wax was yielded by the same method as in Production example 16, except that after the polymerization reaction of the vinyl-based polymer, 5 parts by weight of the wax (2) shown in Table 3 was added to xylene.

Production Example 20

A hybrid resin component (Y-5) having the wax was yielded by the same method as in the manufacturing example 16, except that after the polymerization reaction of the vinyl-based polymer, the wax (3) (shown in Table 3) of 5 parts by weight was added to xylene.

Production Example 21

A hybrid resin component (Y-6) having the wax was yielded by the same method as in the manufacturing example 16, except that after the polymerization reaction of the vinyl-based polymer, the wax (5) (shown in Table 3) of 5 parts by weight was added to xylene.

Production Example 22

A hybrid resin component (Y-7) having the wax was yielded by the same method as in the manufacturing example 16, except that after the polymerization reaction of the vinyl-based polymer, the wax (5) (shown in Table 3) of 2.5 parts by weight was added to xylene.

Production Example 23

| | |
|---|---|
| Terephthalic acid | 42 mol% |
| Isophthalic acid | 3 mol% |
| Fumaric acid | 1.5 mol% |
| A derivative of bisphenol A expressed by the formula (3) (R: ethylene group, x + y = 2.2 | 53.5 mol% |

An unsaturated polyester resin (U-2) which constitutes polyester units of a hybrid resin composition, containing substantially no THF-insoluble matter, and having the acid value of 6 mgKOH/g, a glass transition temperature (Tg) of 61° C., and a peak molecular weight of 6500 was obtained by polycondensation through addition of an esterifying catalyst to such carboxylic acid and an alcohol as described above.

The above described polyester resin of 100 parts by weight was dissolved in a monomer mixture consisting of styrene of 73 parts by weight, butyl acrylate of 27 parts by weight, and divinyl benzene of 0.3 parts by weight, with addition of benzoyl peroxide of 0.5 parts by weight as an initiator of polymerization, and put and suspended in a reaction container, in which polyvinyl alcohol of 2 parts by weight and deaerated ion exchange water of 200 parts by weight were put, comprising a reflux tube, a mixer, a thermometer, and a nitrogen introducing tube. Polymerization reaction was completed by heating to 77° C. while introducing nitrogen, keeping the temperature for 20 hours, further heating to 95° C., and keeping the temperature for 2 hours. The suspension solution after completion of the reaction was filtered , washed, and dried to yield the hybrid resin composition (Y-8), in which its Tg was 56.5° C., its acid value was about 11 mgKOH/g, and the content of its THF-insoluble matter was about 36 parts by weight.

Production Example 24

A hybrid resin component (Y-9) having the wax was yielded by the same method as that of the manufacturing example 23, excluding the addition of the unsaturated polyester resin (U-2) of 100 parts by weight and the wax (2) of 5 parts by weight.

Production Example 25

A hybrid resin component (Y-10) having the wax was yielded by the same method as that of the manufacturing example 23, excluding the addition of the unsaturated polyester resin (U-2) of 100 parts by weight and the wax (3) of 5 parts by weight.

Production Example 26

A hybrid resin component (Y-11) having the wax was yielded by the same method as that of the manufacturing example 23, excluding the addition of the unsaturated polyester resin (U-2) of 100 parts by weight and the wax (5) of 5 parts by weight.

Production Example 27

A hybrid resin component (Y-12) having the wax was yielded by the same method as that of the manufacturing example 23, excluding the addition of the unsaturated polyester resin (U-2) of 100 parts by weight and the wax (3) of 2.5 parts by weight and the wax (5) of 2.5 parts by weight.

Comparative Manufacturing Example 4

| | |
|---|---|
| Terephthalic acid | 24 mol% |
| Isophthalic acid | 22 mol% |
| 1,4-cyclohexane diol | 54 mol% |

An hybrid resin (R-1) for comparison having a main peak of molecular weight of 1700, an acid value of 45 mgKOH/g, and about 0.5 parts by weight of THF-insoluble matter was obtained using the polyester resin consisting of such carboxylic acid and alcohol as described above by the same method as that of the manufacturing example 16, excluding the use of a monomer mixture consisting of styrene of 84 parts by weight, and butyl acrylate of 16 parts by weight, with addition of di-t-butyl peroxide of 10 parts by weight as an initiator of polymerization.

Comparative Manufacturing Example 5

| | |
|---|---|
| Terephthalic acid | 24 mol% |
| Isophthalic acid | 22 mol% |
| Fumaric acid | 2 mol% |
| 1,4-cyclohexane diol | 52 mol% |

An hybrid resin (R-2) for comparison having a main peak of molecular weight of 18,000, an acid value of about 0.5 mgKOH/g, and 55 parts by weight of THF-insoluble matter was obtained using the polyester resin consisting of such carboxylic acid and an alcohol as described above by the same method as that of the manufacturing example 16, excluding the use of a monomer mixture consisting of styrene of 65 parts by weight, butyl acrylate of 34.5 parts by weight, and divinyl benzene of 0.5 parts by weight, with addition of benzoyl peroxide of 0.2 parts by weight as an initiator of polymerization.

Embodiment 16

| | |
|---|---|
| Hybrid resin (Y - 1) | 100 parts by weight |
| Magnetic material (Average particle diameter 0.22 $\mu$m, coercive force 9.6 kA/m, saturation magnetization 83 $Am^2/kg$, remanent magnetization 15 $Am^2/kg$) | 90 parts by weight |
| Wax (3) | 5 parts by weight |
| Aluminium compound of benzilic acid | 3 parts by weight |

(A Compound Consisting of 2 mol of Benzilic Acid Having No Substituent and 1 mol of Aluminium)

A mixture of raw materials as described above is melted and kneaded by using the double-screw muller-extruder heated to 130° C. Mulled material is left standing to be cooled, crushed by a cutter mill and pulverized, preparing a very fine powder by a jet mill. The very fine powder obtained was classified by a pneumatic classifier to yield the magnetic toner with a weight-average particle size of 7.4 $\mu$m.

To this magnetic toner of 100 parts by weight, hydrophobic dry silica (BET specific surface area 200 $m^2/g$) of 1.0 parts by weight was externally added and mixed by means of a Hencshel mixer, producing a magnetic toner (16).

The THF-insoluble matter content of was determined to be 13 weight % based on the binder resin. Measurement of the molecular weight of the THF-soluble matter shows a peak molecular weight of 5,200 and contained 9 weight % of the component of the molecular weight ranging from 100,000 or higher to less than 10,000,000, 64 weight % of the component of the molecular weight ranging from 5,000 or higher to less than 100,000, and 25 weight % of the component of the molecular weight ranging from 1,000 or higher to less than 5,000. On the other hand, measurement of the toner shows the acid value of 4 mgKOH/g. A sample prepared by dissolving and removing the magnetic material from the toner with hydrochloric acid was measure for $^{13}$C-NMR spectrum and shown the presence of the hybrid resin component on the basis of a new signal in about 168 ppm.

Evaluation as same as that of the embodiment 1 was carried out by using this toner. The result is presented in Table 7.

Embodiments 17–27

The magnetic toner (17) to (27) of the present invention was prepared and evaluated by the same method as in Embodiment 16, excluding the use of the hybrid resin and the wax shown in Table 6.

It was confirmed by measuring $^{14}$C-NMR that all the hybrid resins contained hybrid resin components.

Embodiment 28

The magnetic toner (28) of the present invention was prepared and evaluated by the same method as in Embodiment 16, excluding replacement of the aluminium compound of benzilic acid to a compound composed of 2 mol of benzilic acid having a t-butyl group at para position of each aromatic ring and 1 mol of aluminium.

Comparative Example 6

| | |
|---|---|
| Hybrid resin (R - 1) for comparison | 100 parts by weight |
| Magnetic material (Average particle diameter 0.22 $\mu$m, coercive force 9.6 kA/m, saturation magnetization 83 Am$^2$/kg, residual magnetization 15 Am$^2$/kg) | 90 parts by weight |
| Wax (8) | 5 parts by weight |
| Boron compound of benzilic acid | 3 parts by weight |

(A Compound Consisting of 2 mol of Benzilic Acid Having No Substituent and 1 mol of Boron The magnetic toner (6) for comparison was prepared by the same method excluding the use of the hybrid resin for comparison, the wax, etc. as described above. The result of evaluation is shown in Table 6.

Comparative Example 7

The magnetic toner (7) for comparison was prepared by the same method as in Comparative example 16, excluding the use of the wax (9) of five parts by weight replaced to the wax (8). The result of evaluation is shown in Table 7.

Comparative Example 8

In the Comparative example 6, the magnetic toner (8) for comparison was prepared by the same method as in Comparative example 6, excluding the use of 100 parts by weight of the hybrid resin (R-2) for comparison as a binder resin. The result of evaluation is shown in Table 7.

Comparative Example 9

The magnetic toner (9) for comparison was prepared by the same method as in Comparative example 8, excluding the use of the wax (9) of five parts by weight replaced to the wax (8). The result of evaluation is shown in Table 7.

Comparative Example 10

The magnetic toner (10) for comparison use was prepared and evaluated in the same method as in Comparative example 6, excluding replacement of the boron compound of benzilic acid to aluminium compound of benzilic acid (a compound consisting of 2 mol of benzilic acid having no substituent and 1 mol of aluminium).

Comparative Example 11

The magnetic toner (11) for comparison use was prepared and evaluated in the same method as in Comparative example 8, excluding replacement of the boron compound of benzilic acid to aluminium compound of benzilic acid (a compound consisting of 2 mol of benzilic acid having no substituent and 1 mol of aluminium).

{Production of a Low Molecular Vinyl-based Polymer}

Production Example 28

Xylene of 200 parts by weight was put in a reaction container comprising a reflux tube, a mixer, a thermometer, a nitrogen introducing tube, a monomer dropping apparatus, and a pressure reducing apparatus to be heated up to a reflux temperature. When xylene was refluxed, styrene of 73 parts by weight, butyl acrylate of 25 parts by weight, and monobutyl maleate of 2 parts by weight, and 3 parts by weight of di-t-butyl peroxide as an initiator of polymerization were dropped for 2 hours, and further continuing reflux for 8 hours. A low molecular vinyl-based polymer (L-6) was yielded by reducing the pressure to remove xylene.

L-6 shows a peak molecular weight (Mp) of 9500, where the weight average molecular weight (Mw) was 11,000, the ratio of the weight-average molecular weight and number-average molecular weight (Mw/Mn) was 2.4, the acid value (Av) was 7.2 mgKOH/g, the glass transition temperature (Tg) was 60.2° C.

Production Example 29

A low molecular vinyl-based polymer (L-7) of which Mp is 7200, Mw is 7700, Mw/Mn is 2.6, Av is 14.5 mgKOH/g, and Tg is 58.3° C., was yielded by the same method as in manufacturing example 28, excluding the use of the styrene of 70 parts by weight, butyl acrylate of 21 parts by weight, and monobutyl maleate of 4 parts by weight, and di-t-butyl peroxide of 4 parts by weight as an initiator of polymerization.

Production Example 30

In the manufacturing example 28, a low molecular vinyl-based polymer (L-8), of which Mp is 18,000, Mw is 19500, Mw/Mn is 2.5, Av is 3.3 mgKOH/g, and Tg is 61.6° C., was yielded by the same method excluding the use of the styrene of 76 parts by weight, butyl acrylate of 23 parts by weight, and monobutyl maleate of 1 parts by weight, and di-t-butyl peroxide of 2 parts by weight as an initiator of polymerization.

Production Example 31

A low molecular vinyl-based polymer (L-9) of which Mp is 7500, Mw is 8100, Mw/Mn is 2.5, Av is 30.8 mgKOH/g, and Tg is 57.4° C., was yielded by the same method as in manufacturing example 28, excluding the use of the styrene of 67 parts by weight, butyl acrylate of 25 parts by weight, and monobutyl maleate of 7 parts by weight, and di-t-butyl peroxide of 5 parts by weight as an initiator of polymerization.

Production Example 32

Xylene of 200 parts by weight was put in a reaction container comprising a reflux tube, a mixer, a thermometer, a nitrogen introducing tube, a monomer dropping apparatus, and a pressure reducing apparatus and heated up to a 107° C. As the first step of polymerization reaction, styrene of 34 parts by weight, butyl acrylate of 13 parts by weight, and monobutyl maleate of 3 parts by weight, and 2.5 parts by weight of 1,1-bis (t-butyl peroxy)-2-methylcyclohexane as an initiator of polymerization were dropped over 1 hour, and further maintaining the temperature for 3 hours. Subsequently, as the second step of polymerization reaction, the temperature was raised up to 112° C., a monomer composition consisting of styrene of 37 parts by weight, butyl acrylate of 13 parts by weight, and xylene 30 parts by weight was dropped over 1 hour, and the temperature was kept for 5 hours to complete the polymerization reaction. The low molecular vinyl-based polymer (L-10), in which Mp is 16700, Mw is 18800, Mw/Mn is 2.1, Av is 4.1 mgKOH/g, and Tg is 60.2° C., was yielded by reducing the pressure to remove xylene.

Production Example 33

A low molecular vinyl-based polymer (L-11) of which Mp is 21,000, Mw is 22800, Mw/Mn is 2.3, Av is 2.9 mgKOH/g, and Tg is 61.1° C., was yielded by the same method as in manufacturing example 5, excluding the use of 2 parts by weight of the initiator of polymerization.

Production of a high molecular vinyl-based polymer

Production Example 34

Polyvinyl alcohol of 2 parts by weight and deaerated ion exchange water of 200 parts by weight were put in a reaction container comprising a reflux tube, a mixer, a thermometer, and a nitrogen introducing tube and heated up to 77° C. while passing nitrogen. Subsequently, styrene of 70 parts by weight, 2-ethylhexyl acrylate of 8 parts by weight, and monobutyl maleate of 2 parts by weight, and 0.7 parts by weight of 2,2-bis (4,4-di-t-butyl peroxycyclohexyl) propane as an initiator of polymerization were added and suspended. The temperature was kept for 20 hours, and subsequently, benzoyl peroxide of 0.5 parts by weight was added, kept for 4 hours, and heated to 95° C. for 2 hours to complete the polymerization reaction.

The high molecular vinyl-based polymer (H-11) in which Mp is 883,000, Mw is 1.26 million, Mw/Mn is 3.2, Av is 5.3 mgKOH/g, and Tg is 56.7° C., was yielded by filtering the suspension after completion of the reaction, washed, and dried.

Production Example 35

A high molecular vinyl-based polymer (H-12) of which Mp is 1.44 million, Mw is 1.38 million, Mw/Mn is 3.4, Av is 4.7 mgKOH/g, and Tg is 57.3° C., was yielded by the same method as in the manufacturing example 34, excluding the addition of the 0.4 parts by weight of 2,2-bis (4,4-di-t-butyl peroxycyclohexyl) propane as the initiator of polymerization.

Production Example 36

A high molecular vinyl-based polymer (H-13), of which Mp is 338,000, Mw is 364,000, Mw/Mn is 2.7, Av is 6.2 mgKOH/g, and Tg is 56.3° C., was yielded by the same method as in the manufacturing example 34, excluding the addition of the 2 parts by weight of benzoyl peroxide as the initiator of polymerization.

{Production of the Binder Resin}

Production Example 37

Xylene of 200 parts by weight was put in a reaction container comprising a reflux tube, a mixer, a thermometer, and a nitrogen introducing tube and the low molecular weight polymer (L-6) of 70 parts by weight, the high molecular weight polymer (H-11) of 30 parts by weight, and 5 parts by weight of the wax (12) shown in Table 8 were added and heated up to the reflux temperature. Subsequently, stirring was continued for 2 hours followed by removing xylene under the reduced pressure to yield a vinyl-based polymer containing five parts by weight of wax (12). In the vinyl-based polymer (1), the main peak was in molecular weight of 11,000, a subpeak was in 876 thousands, and Av was 5.1 mgKOH/g.

Production Example 38

A vinyl polymer (2) was prepared by the same method as in the manufacturing example 37, excluding no use of the wax.

Production Examples 39 to 43

A vinyl polymer (3) to (7) was prepared by the same method as in the manufacturing example 37, excluding the addition of the wax shown in Table 9, replaced by the wax (12).

Production Examples 44 to 49

A vinyl polymer (8) to (13) was prepared by the same method as in the manufacturing example 37, excluding the use of the low molecular weight polymer and the high molecular weight polymer shown in Table 9.

Production Example 48

A vinyl polymer (14) was prepared by the same method as in the manufacturing example 37, excluding the change of the quantity of the wax (12) to 10 parts by weight.

Production Example 50

A vinyl polymer (15) was prepared by the same method as in the manufacturing example 37, excluding the change of the quantity of the wax (12) to 3 parts by weight.

Comparative Manufacturing Example 6

A vinyl-based low molecular weight polymer (RL-1) for comparison, in which Mp is 4500, Mw is 4700, Mw/Mn is 2.8, the acid value is 48.6 mgKOH/g, and Tg is 57.7° C., was obtained by the same method as that of the manufacturing example 28, excluding the use of a monomer mixture consisting of styrene of 58 parts by weight, butyl acrylate of 20 parts by weight, monobutyl maleate of 22 parts by weight, and di-t-butyl peroxide of 8 parts by weight.

Comparative Manufacturing Example 7

A vinyl-based low molecular weight polymer (RL-2) for comparison, in which Mp is 4100, Mw is 4200, Mw/Mn is 2.7, the acid value is 0.2 mgKOH/g, and Tg is 58.3° C., was obtained by the same method as that of the manufacturing example 28, excluding the use of a monomer mixture consisting of styrene of 78 parts by weight, butyl acrylate of 22 parts by weight, and di-t-butyl peroxide of 10 parts by weight.

Comparative Manufacturing Example 8

A vinyl-based low molecular weight polymer (RL-3) for comparison, in which Mp is 31,500, Mw is 34,000, Mw/Mn is 3.4, the acid value is 0.3 mgKOH/g, and Tg is 61.1° C., was obtained by the same method as that of the manufacturing example 28, excluding the use of a monomer mixture consisting of styrene of 80 parts by weight, butyl acrylate of 20 parts by weight, and di-t-butyl peroxide of 1.2 parts by weight.

Comparative Manufacturing Example 9

A vinyl-based low molecular weight polymer (RL-4) for comparison, in which Mp is 3400, Mw is 3600, Mw/Mn is 3.9, the acid value is 44.3 mgKOH/g, and Tg is 58.1° C., was obtained by the same method as that of the manufacturing example 28, excluding the use of a monomer mixture consisting of styrene of 52 parts by weight, butyl acrylate of 26 parts by weight, monobutyl maleate of 22 parts by weight, and benzoyl peroxide of 4 parts by weight.

Comparative Manufacturing Example 10

A vinyl-based high molecular weight polymer (RH-1) for comparison, in which Mp is 191,000, Mw is 1,930,000, Mw/Mn is 4.1, the acid value is 0.4 mgKOH/g, and Tg is 62.0° C., was obtained by the same method as that of the manufacturing example 34, excluding the use of a monomer mixture consisting of styrene of 82 parts by weight, butyl acrylate of 18 parts by weight, and di-t-butyl peroxide of 3 parts by weight.

Comparative Manufacturing Example 11

A vinyl-based high molecular weight polymer (RH-2) for comparison, in which Mp is 178,000, Mw is 182,000, Mw/Mn is 3.7, the acid value is 42.1 mgKOH/g, and Tg is 60.5° C., was obtained by the same method as that of the manufacturing example 34, excluding the use of a monomer mixture consisting of styrene of 52 parts by weight, butyl acrylate of 28 parts by weight, monobutyl maleate of 20 parts by weight, and benzoyl peroxide of 1.8 parts by weight.

{Production of the Binder Resin for Comparison}

Comparative Manufacturing Example 12

A vinyl-based polymer (1) for comparison was obtained by the same method as in the manufacturing example 37, excluding the addition of 70 parts by weight of the vinyl-based low molecular weight polymer (RL-1) for comparison, 70 parts by weight of the vinyl-based high molecular weight polymer (RH-1) for comparison, and 5 parts by weight of the wax (15). The vinyl-based polymer (1) for comparison had the main peak in the molecular weight of 4,200 and the subpeak in the molecular weight of 86,000, and the acid value was 44.3 mgKOH/g.

Comparative Manufacturing Example 13 to 16

A vinyl-based polymer (2) to (5) for comparison was obtained by the same method as in manufacturing example 37, excluding the use of the vinyl-based low molecular weight polymer and the vinyl-based high molecular weight polymer shown in Table 9.

Embodiment 29

| | |
|---|---|
| Vinyl-based polymer | 105 parts by weight |
| Magnetic material (Average particle diameter 0.22 μm, coercive force 9.6 kA/m, saturation magnetization 83 $Am^2/kg$, residual magnetization 15 $Am^2/kg$) | 90 parts by weight |
| Aluminium compound of benzilic acid | 3 parts by weight |

(A Compound Consisting of 2 mol of Benzilic Acid Having No Substituent and 1 mol of Aluminium)

A mixture of raw materials as described above was melted and kneaded by using a double-screw muller-extruder heated to 130° C. Mulled material was left standing to be cooled, crushed by a cutter mill and pulverized, preparing the very fine powder by the jet mill. The very fine powder obtained was classified by a pneumatic classifier to yield magnetic toner with a weight-average particle size of 7.6 μm.

To this magnetic toner of 100 parts by weight, hydrophobic dry silica (BET specific surface area 200 $m^2/g$) of 1.0 parts by weight was externally added and mixed by means of a Hencshel mixer, producing a magnetic toner (27).

The THF-insoluble matter content of the toner (29) was determined to be 5 weight % based on the binder resin, and the THF-soluble matter had a peak in the molecular weight of 111,000, a subpeak in the molecular weight of 876,000, and no shoulder. The acid value of the toner was 6 mgKOH/g. The measurement of the toner shows a dielectric dissipation factor of $3.2\times10^{-3}$ in 100 kHz frequency and the contact angle was 125 degree by measurement using commercial purified water.

The same evaluation as that of embodiment 1 was carried out by using this toner. The result is presented in Table 10. The fixing test was carried out by using the NP-6085 with the total pressure of the roller being changed to 30 kgf.

Embodiments 30 to 43

Magnetic toners (30) to (43) of the present invention were prepared and evaluated in the same method as in Embodiment 29, excluding the use of the binder resin and the wax shown in Table 9.

Embodiment 44

A magnetic toner (44) of the present invention was prepared and evaluated in the same method as in Embodiment 29, excluding replacement of the aluminium compound of benzilic acid to a compound composed of 2 mol of benzilic acid having a t-butyl group at para position of each aromatic ring and 1 mol of aluminium.

Comparative Example 12

| | |
|---|---|
| Vinyl-based polymer for comparison | 100 parts by weight |
| Magnetic material (Average particle diameter 0.22 μm, coercive force 9.6 kA/m, saturation magnetization 83 $Am^2/kg$, residual magnetization 15 $Am^2/kg$) | 90 parts by weight |
| wax (15) | 5 parts by weight |
| Boron compound of benzilic acid | 2 parts by weight |

(A Compound Consisting of 2 mol of Benzilic Acid Having No Substituting Group and One mol of Boron)

The magnetic toner (12) for comparison use was prepared by the same method as that of the embodiment 29, excluding the use of the binder resin and the wax as described above. The result of evaluation is shown in Table 10.

Comparative Examples 13 to 16

Magnetic toners (13) to (16) for comparison use were prepared by the same method as in Comparative example 12, excluding the use of the binder resin and the wax as shown in Table 9.

Comparative Example 17

Magnetic toner (17) for comparison was prepared and evaluated by the same method as in Comparative example 12, excluding replacement of the boron compound of benzilic acid to the aluminium compound of benzilic acid (benzilic acid of 2 mol, having not substituent, and 1 mol of aluminium).

Comparative Example 18

Magnetic toner (18) for comparison was prepared and evaluated by the same method as in Comparative example 14, excluding replacement of the boron compound of benzilic acid to the aluminium compound of benzilic acid (benzilic acid of 2 mol, having no substituent, and 1 mol of aluminium).

Comparative Example 19

Magnetic toner (19) for comparison was prepared and evaluated in the same method as in Comparative example 15, excluding replacement of the boron compound of benzilic acid to the aluminium compound of benzilic acid (benzilic acid of 2 mol, having no substituent, and 1 mol of aluminium).

Embodiment 45

| | |
|---|---|
| Binding resin (styrene - butyl acrylate - divinyl benzene copolymer, Tg = 60° C., peak molecular weight = 18 thousands, Mw/Mn = 10) | 100 parts by weight |
| Magnetic material (Globular magnetite. average size = 0.25 $\mu$m, coercive force = 10 kA/m, saturation magnetization = 80 $Am^2/kg$, residual magnetization = 15 $Am^2/kg$) | 90 parts by weight |
| Wax component (long chain alcohol wax, mp = 70° C., Tonset (onset temp. in starting point of endothermic peak) = 55° C.) | 4 parts by weight |
| Aluminium compound of benzilic acid | 3 parts by weight |

(A Compound Consisting of 2 mol of Benzilic Acid Having No Substituent and 1 mol of Aluminium)

A mixture of raw materials as described above is melted and kneaded by using a double-screw extruder, kneaded material is left standing to be cooled, crushed by a hammer mill and pulverized, preparing a very fine powder by a jet mill. The very fine powder yielded was classified to yield the toner.

The toner of 100 parts by weight was subjected to dry-mixing with the very fine powder of hydrophobic, oil-treated silica (average particle size of primary particle= 15 nm) of 2.0 parts by weight by a Henschel mixer (Mitsui Mining and Smelting Co., Ltd. made) to make a magnetic toner (42). The toner (45) shows that a weight-average particle size ($D_4$) was 6.1 $\mu$m and a variation coefficient of number distribution was 22%. The physical properties of the toner yielded are presented in Table 11.

Triboelectric charge and electrification rate of the magnetic toner (45) as described above were evaluated in a normal temperature and normal humidity (N/N; 25° C./60% RH) environment, a high temperature and high humidity (H/H; 30° C./80% RH) environment and a low temperature and low humidity (L/L; 15° C./10% RH) environment.

In addition, a print-out test was carried out for 5,000 sheets of paper by using a modified processing cartridge of a commercial laser beam printer LBP-930 (Canon made) in a high temperature and high humidity environment to evaluate the images printed.

The evaluation result will be shown in Table 12.

Embodiment 46

The magnetic toner (46) was prepared and evaluated by the same method as that of the Embodiment 45 excluding replacement of the aluminium compound of benzilic acid to 4 parts by weight of a compound consisting of benzilic acid of 3 mol and 1 mol of aluminium.

The physical properties of the magnetic toner (46) and the evaluation result will be presented in Table 11 and Table 12, respectively.

Comparative Example 20

The magnetic toner (20) for comparison was prepared and evaluated by the same method as that of Embodiment 45 excluding replacement of the aluminium compound of benzilic acid to 3 parts by weight of the boron compound of benzilic acid (a compound consisting of 2 mol of benzilic acid having no substituent and 1 mol of boron).

The physical properties of the magnetic toner (20) for comparison and the evaluation result will be presented in Table 11 and Table 12, respectively.

Embodiment 47

| | |
|---|---|
| Binding resin (styrene - butyl acrylate - monobutyl maleate copolymer, Tg = 65° C., peak molecular weight = 24 thousands, Mw/Mn = 6) | 100 parts by weight |
| Carbon black (Average particle size = 35 nm and oil absorbing quantity = 65 ml/100 g) | 7 parts by weight |
| Aluminium compound of benzilic acid | 3 parts by weight |

(A Compound Consisting of 2 mol of Benzilic Acid Having No Substituent and 1 mol of Aluminium)

The raw materials as described above were processed by the same method as that of Embodiment 45 to yield a toner.

The toner of 100 parts by weight was dry-mixed with a fine powder of hydrophobic, oil-treated titanium oxide (average particle size of primary particle =10 nm) of 1.5 parts by weight by the Henschel mixer (Mitsui Mining and Smelting Co., Ltd. made) to make a nonmagnetic toner (47) of the present invention.

The nonmagnetic toner (47) shows that a weight average particle size ($D_4$) was 6.9 $\mu$m and a variation coefficient of number distribution was 23%.

Triboelectric charge and electrification rate of the nonmagnetic toner (47) which were obtained by the method as described above, were evaluated by same method as that of Embodiment 45.

In addition, a two-component developer was prepared by mixing 5 parts by weight of the nonmagnetic toner (47) yielded by the method as described above with 95 parts by weight of a magnetic ferrite carrier (average particle size=45 $\mu$m) coated with 1 weight % of silicon resin. A test of printing 5,000 sheets was carried out in mono color mode by using a commercially available full-color digital copying machine CLC-800 (Canon Corp. made) of which contrast electric potential was set to −250 V while successively supplying the nonmagnetic toner (47) in a low temperature and low humidity environment. The image printed was evaluated.

Table 13 and Table 14 show the physical properties and the evaluation result of the nonmagnetic toner (47).

Comparative Example 21

Nonmagnetic toner (21) for comparison and a two-component developer for comparison were prepared and evaluated by the same method as that of Embodiment 47 except that 2 parts by weight of boron compound of benzilic acid (a compound consisting of 2 mol of benzilic acid having no substituent and 1 mol of boron) was substituted for the aluminium compound of benzilic acid.

The physical properties of the nonmagnetic toner (21) for comparison and the evaluation result will be presented in Table 13 and Table 14.

Embodiment 48

Ion exchange water of 650 parts by weight and a 0.1 mol/liter $Na_3PO_4$ aqueous solution of 500 parts by weight were put in a 2-liter four-neck flask provided with a TK type homomixer (Tokushu Kikako made; a high speed mixing apparatus) whose rotation was adjusted to 12,000 rpm, and heated to 70° C. In this apparatus, a 1.0 mol/liter $CaCl_2$ aqueous solution of 70 parts by weight was gradually added to prepare an aqueous dispersing medium containing a microscopic dispersant, $Ca_3(PO_4)_2$, hardly dissolved in water.

On the other hand, a mixture containing as dispersoid

| | |
|---|---|
| Styrene monomer | 77 parts by weight |
| 2-ethyhexyl acrylate monomer | 23 parts by weight |
| divinyl benzene monomer | 0.2 parts by weight |
| colorant (carbon black, average particle size = 70 nm and oil absorbing quantity = 65 ml/100 g) | 8 parts by weight |
| polyester resin (A condensation polymer consisting of propoxylated bisphenol A and terephthalic acid, peak molecular weight = 8,000) | 5 parts by weight |
| wax component (a higher ester wax, mp = 65° C., $T_{onset}$ = −60° C.) | 10 parts by weight |
| Aluminum compound of benzilic acid | 1 parts by weight |

(A Compound Consisting of 2 mol of Benzilic Acid Having No Substituent and 1 mol of Aluminum) was dispersed for 3 hours by using an atliter (Mitsui Mining and Smeltering Co., Ltd. made) and 2,2'-azo bis (2,4-dimethyl) valero nitrile of 10 parts by weight was added to prepare a polymeric monomer composition.

Subsequently, the polymeric monomer composition was put in the above described aqueous dispersing medium, mixed in the $N_2$ atmosphere with an internal temperature of 60° C. for 15 minutes while keeping the rotation of the high speed mixer at 12,000 rpm to granulate of the polymeric monomer composition. Following these steps, the mixer was replaced with a paddle stirrer, the temperature was maintained for 5 hours with stirring at 50 rpm and raised to 85° C. which was kept for 10 hours to complete polymerization.

Next, after cooling, a diluted hydrochloric acid was added to dissolve the dispersant hardly dissolved in water, a drying process was carried out under heating and reduced pressure for 6 hours to produce the toner.

Concerning the molecular weight distribution by GPC of the binder resin of the toner, a peak molecular weight was 19 thousands and Mw/Mn was 15.

The aluminum compound of benzilic acid (the same as used for the above described polymeric monomer composition) of 0.1 parts by weight was adhered and carried onto 100 parts by weight of this toner by using Hybridizer (manufactured by Nara Kikai, K. K), and subjected to dry-mixing together with the very fine powder of hydrophobic titanium oxide (primary particle size=7 nm) of 1 parts by weight and the very fine powder of the hydrophobic oil-treated silica (primary particle size=20 nm) of 0.5 parts by weight by using a Henschel mixer (Mitsui Mining and Smeltering Co., Ltd. made) to prepare the nonmagnetic toner (48).

Triboelectric charge and electrification rate of the nonmagnetic toner (48) obtained by the above described method were evaluated by the same method as that of Embodiment 45.

In addition, a printing test was carried out for 3,000 sheets of paper by using a commercially available laser beam printer LBP-2040 (Canon made) in a monochromatic mode in a normal temperature and normal humidity environment to evaluate the image printed.

The physical properties of the nonmagnetic toner (48) will be presented in Tables 15 and 16, and the result of evaluation of the toner will be shown in Table 17.

Embodiments 49 to 51

Nonmagnetic toner (49) to (51) were prepared and evaluated by the same method as that of the above described Embodiment 48 except that different kinds and amounts of aluminum compound of benzilic acid and a different kind and amount of the colorant were used.

The kinds and amounts of aluminum compound of benzilic acid, the kind and amount of the colorant, and the physical properties of the toner in the respective Embodiments will be presented in Tables 15 and 16, and the evaluation result of the toner will be presented in Table 17.

Comparative Examples 22 to 25

Nonmagnetic toners (22) to (25) for comparison were prepared and evaluated by the same method as that of the above described Embodiment 48 to 51, except that the aluminum compound of benzilic acid was replaced by the boron compound of benzilic acid (a compound consisting of 2 mol of benzilic acid having no substituent and 1 mol of boron).

The kinds and amounts of boron compound of benzilic acid, the kinds and amounts of colorant, and the physical properties of the toner in the respective Comparative examples will be presented in Tables 15 and 16, and the evaluation result of the toner will be presented in Table 17.

The followings are explanation of evaluation items described in the above described Embodiments and Comparative examples and standards thereof.

[Evaluation of Triboelectric Charge Quantity and Electrification Rate]

In the present invention, triboelectric charge and electrification rate of the toner was measured by aspiration. First, 0.5 g of the toner and 9.5 g of a carrier (EFV-200/300, Powderteck made) were weighed, put in a polyethylene container of 50 ml, and left stand under environment for measurement for 2 days. Subsequently, the container was sealed under respective environments and shaken in a Turbler mixer (WAB Co. made) for 5 minutes to prepare a mixture sample made of the toner and the carrier.

Figure 7:
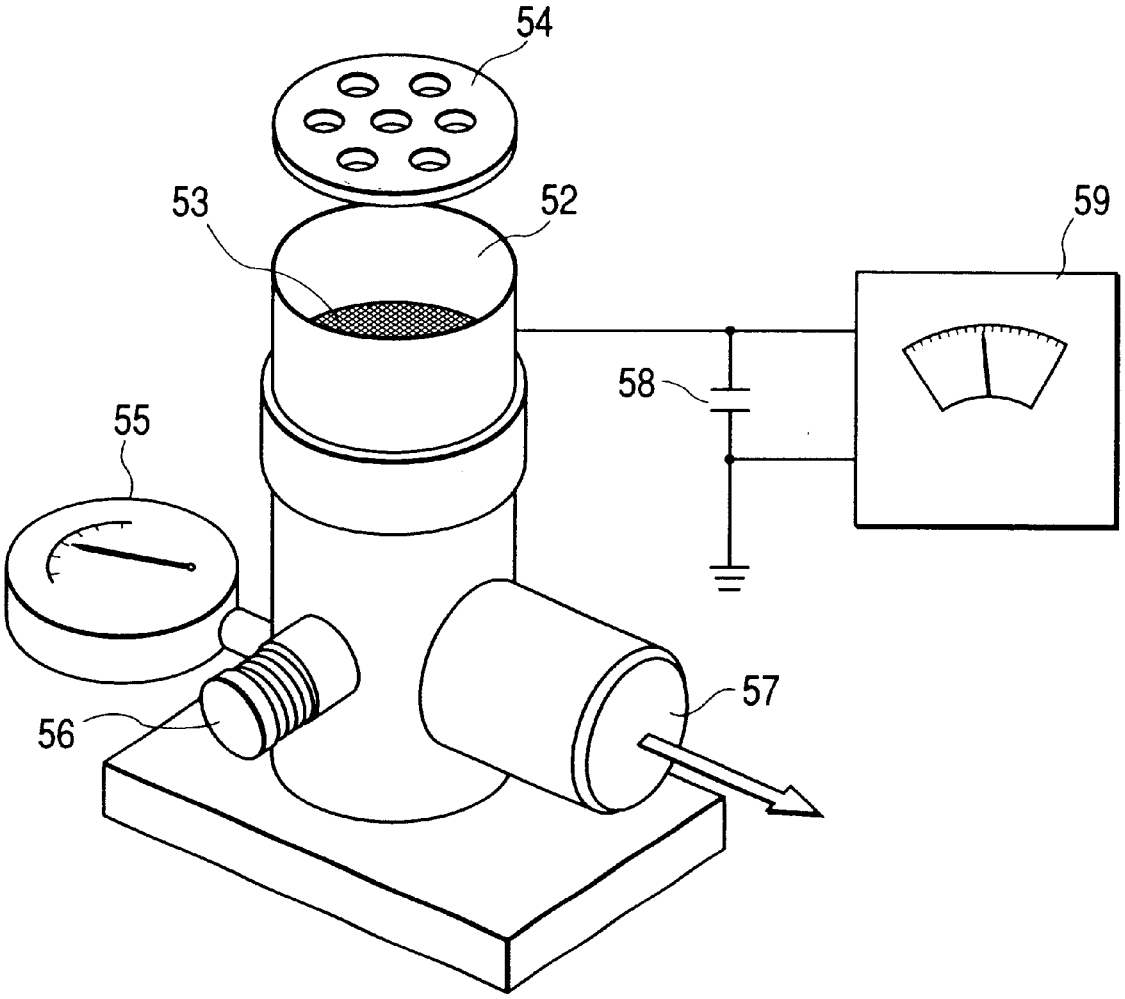
FIG. 7 is a schematic diagram illustrating a measuring instrument for the evaluation of the charging properties of the toner.

The instrument for measuring the charge quantity, used in the present invention, is shown in FIG. 7. The above described mixture sample (1 g) was weighed and put in a metal measuring container 52 of which bottom has an electroconductive screen 53 of the opening of 25 μm (500 mesh) having an aperture allowing capturing the carrier and removing only the toner by aspiration, and a metal lid 54 is put on. Next, aspiration is carried out for 2 minutes from an aspiration mouth 57 by using an aspirator, connected to the measuring container 52 through an insulating part, regulating a vacuum meter 55 to 250 $mmH_2O$ by using an air volume regulator 56. In this time, triboelectric charge Q(μC/g) is defined as the value yielded by dividing the electric charge, which is calculated from a voltage value (V) indicated by a electric potential meter 59 and a static capacity C (μF) of a capacitor 58, by the quantity (g) of the toner removed by aspiration.

Triboelectric charge was evaluated on the basis of the following standard.

A: $Q \leqq -45$ μC/g

B: $-45$ μC/g$<Q\leqq-35$ μC/g

C: $-35$ μC/g$<Q\leqq-20$ μC/g

D: $-20$ μC/g$<Q$

On the other hand, the electrification rate for evaluation was obtained from a change of the triboelectric charge quantity against the period of time of shaking a sample prepared by mixing the toner and the carrier using the Turbler mixer.

A: excellent, B: good, and C: moderately inferior, D: inferior

[Evaluation of the Printed Image]

(1) Density of the Image

Evaluation was carried out for the density of the image at the completion of printing of a predetermined number of sheets of plain paper (75 $g/m^2$) used for the normal copying machine. For the density of the image, a relative density to the white area, of which a manuscript density was 0.00, of the printed image was measured by using "MacBeth Reflection densitometer RD918" (MacBeth Co. made).

A: 1.40 or higher

B: 1.35 and higher and less than 1.40

C: 1.00 and higher and less than 1.35

D: less than 1.00

(2) Scattering Around Image

Figure 8A:
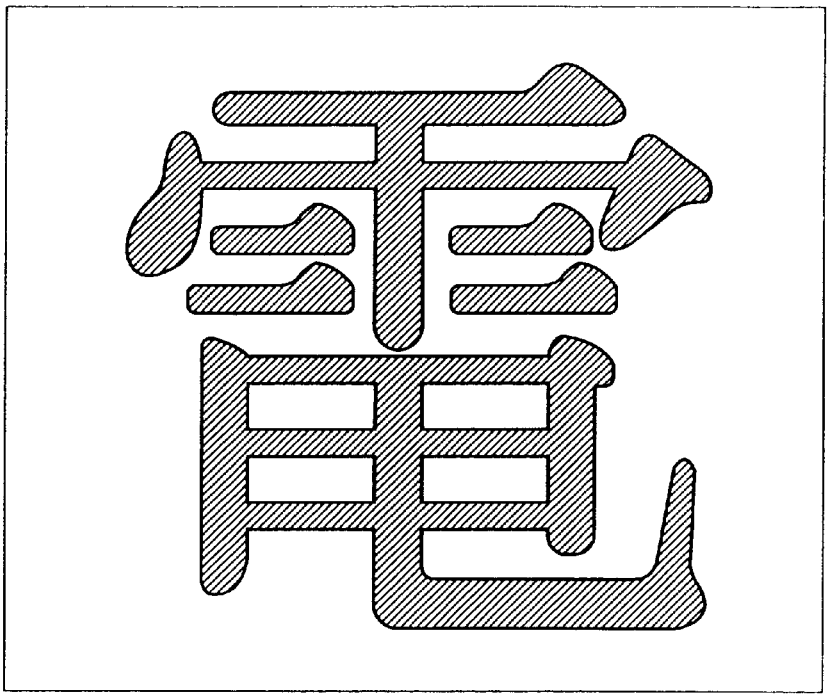
FIGS. 8A and 8B are diagrams illustrating the scattering state of a character image.
Figure 8B:
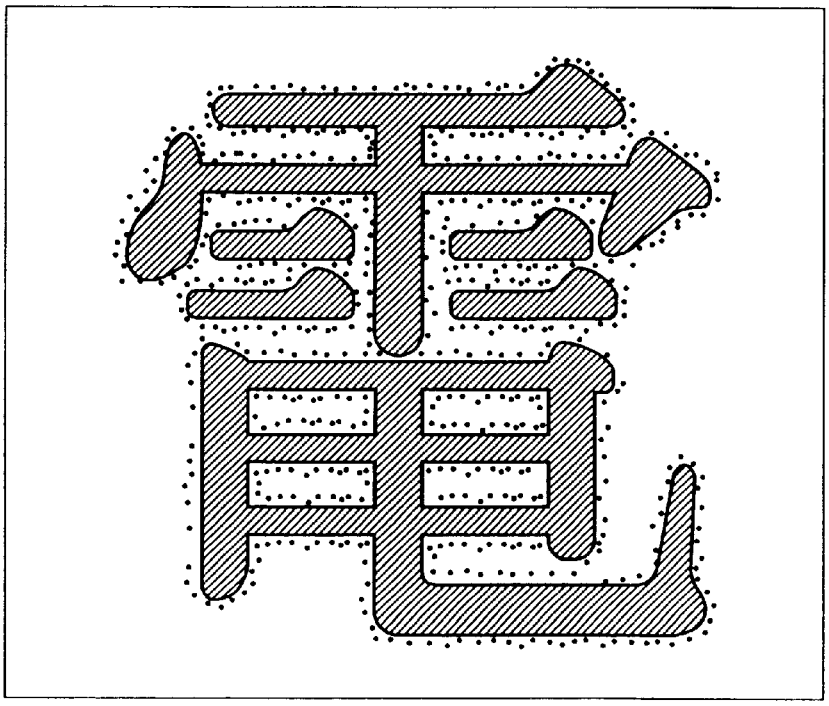

When the character pattern shown in FIG. 8A was printed on plain paper (75 $g/m^2$), black spots (the condition of FIG. 8B) of the toner powder around the character was visually observed to evaluate, A: almost no occurrence B: slight spattering is observed C: light spattering is observed D: distinct spattering is observed (3) Fogging of the Image The toner remained on a photosensitive member at the time of formation of a white solid image was removed by taping using a Myler tape to measure the reflection density of the tape adhered to a paper by using "MacBeth reflection densitometer RD 918." Evaluation was carried out on the basis of the value yielded by subtracting the reflection density, when the Myler tap was adhered to the paper as it is, from the reflection density yielded. A small value means suppression of image fogging.

A: less than 0.03

B: 0.03 or higher and less than 0.07

C: 0.07 or higher and less than 0.15

D: 0.15 or higher (4) Dot Reproducibility

Figure 9:
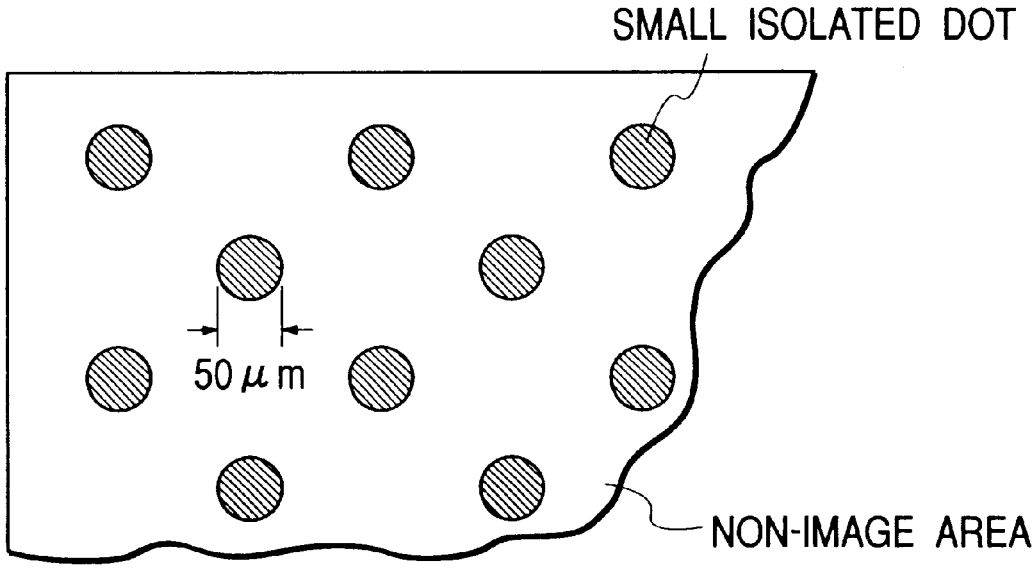
FIG. 9 is a diagram illustrating a isolated dot pattern for checking the developing properties of the toner.

The image of an isolated dot pattern with a small diameter (50 μm), as shown in FIG. 9, of which electric field is easy to close and difficult to be reproduced because of a latent electric field was printed to evaluate dot reproducibility thereof.

A: 2 or less defects in 100 dots

B: 3–5 defects in 100 dots

C: 6–10 defects in 100 dots

D: defects of 11 or more in 100 dots

Embodiment 52

Printing test was carried out by the same method as that of the embodiment 4 except that the toner used was the nonmagnetic toners (48) to (51) and printing was carried out in the full color mode. Neither unevenness of image density nor black spots around image occurred, and a very fine full color image excellent for color reproducibility was yielded.

Comparative Example 26

Printing test was carried out by the same method as that of Embodiment 52, using the nonmagnetic toners (22) to (25) for comparison. Unevenness of image density and black spots around images occurred in the full color image obtained, so that and color reproducibility was insufficient.

TABLE 1

| | Wax of low peak molecular weight | Wax of high peak molecular weight |
|---|---|---|
| Example (1) | Wax having Mp of 1000, Mw/Mn of 1.5 and melting point of about 105° C.. | Polypropylene wax having Mp of 3000, Mw/Mn of 9 and melting point of about 130° C.. |
| Example (2) | Hydrocarbon wax having Mp of 800, Mw/Mn of 2.0 and melting point of about 110° C., which can be represented by Formula (1) having a hydroxyl group. | Polypropylene wax having Mp of 3000, Mw/Mn of 9 and melting point of about 130° C.. |
| Example (3) | Hydrocarbon wax having Mp of 1000, Mw/Mn of 1.5 and melting point of about 105° C.. | Maleic acid modified polypropylene wax having Mp of 4000, Mw/Mn of 9.5, melting point of about 120° C. and acid value of 2 mgKOH/g. |
| Example (4) | Wax having Mp of 800, Mw/Mn of 2.0 and melting point of about 110° C., which can be represented by Formula (1) having a hydroxyl group. | Maleic acid modified polypropylene wax having Mp of 4000, Mw/Mn of 9.5, melting point of about 120° C. and acid value of 2 mgKOH/g. |
| Example (5) | Hydrocarbon wax having Mp of 1000, Mw/Mn of 1.5 and melting point of about 105° C.. | Maleic acid modified polypropylene wax having Mp of 3000, Mw/Mn of 5.5, melting point of about 110° C. and acid value of 2 mgKOH/g. |
| Example (6) | Wax having Mp of 800, Mw/Mn of 2.0 and melting point of about 110° C., which can be represented by Formula (1) having a hydroxyl group. | Maleic acid modified polypropylene wax having Mp of 3000, Mw/Mn of 5.5, melting point of about 110° C. and acid value of 2 mgKOH/g. |
| Example (7) | Hydrocarbon wax having Mp of 500, Mw/Mn of 1.3 and melting point of about 80° C.. | Maleic acid modified polypropylene wax having Mp of 3000, Mw/Mn of 9 and melting point of about 130° C.. |

TABLE 2

| | Result of $^{13}$C-NMR Measurement | | | |
|---|---|---|---|---|
| | Signal newly detected (about 168 ppm) | Signal of carboxyl group of aliphatic carboxylic acid | | Signal of carboxylic group of acrylic ester (about 176 ppm) |
| | | about 172 ppm | about 174 ppm | |
| Low cross-linked polyester unit | — | ○ | ○ | — |
| Vinyl polymer unit | — | — | — | ○ |
| Hybrid resin | ○ | ○ | ○ | ○ |

TABLE 3

| | Wax species | Peak molecular weight | Mw/Mn | Endothermic main peak temperature |
|---|---|---|---|---|
| Wax (1) | Hydrocarbon-based wax | 660 | 1.7 | 84° C. |
| Wax (2) | Wax having a hydroxyl group expressed by the formula (2) (Mean of a is 40) | 1200 | 2.0 | 114° C. |
| Wax (3) | Hydrocarbon-based wax | 1100 | 1.1 | 109° C. |
| Wax (4) | Polypropylene denatured by maleic acid | 2300 | 6.7 | 117° C. |
| Wax (5) | Polypropylene | 3700 | 9.3 | 128° C. |
| Wax (6) | Polypropylene | 5900 | 24 | 133° C. |
| Wax (7) | Hydrocarbon-based wax | 300 | 1.2 | 65° C. |
| Wax (8) | Polypropylene | 6300 | 24 | 135° C. |
| Wax (9) | Hydrocarbon-based wax | 300 | 1.2 | 67° C. |

TABLE 4

| | Polyester | Wax added in manufacture of toner | Acid value of binding resin of toner (mgKOH/g) | Component, insoluble in THF, of binding resin of toner (weight %) | Peak molecular weight | Component of molecular weight ranging from 100 thousands or higher to less than 10 million (weight %) | Component of molecular weight ranging from 5000 or higher to less than 100 thousands (weight %) | Component of molecular weight ranging 1000 or higher to less than 5000 (weight %) | Dielectric tangent ($\times 10^{-3}$) | Contacting angle of toner (°) |
|---|---|---|---|---|---|---|---|---|---|---|
| Embodiment 1 | L-1:50 Parts by weight H-1:50 Parts by weight | Wax (3), 5 parts by weight | 8 | 26 | 7200 | 11 | 63 | 19 | 12.6 | 105 |
| Embodiment 2 | L-2:60 Parts by weight H-1:50 Parts by weight | — parts by weight | | | Same as the Embodiment 1 | | | | 11.4 | 108 |
| Embodiment 3 | L-1:50 Parts by weight H-2:60 Parts by weight | — parts by weight | | | | | | | 7.3 | 115 |
| Embodiment 4 | L-3:50 Parts by weight H:150 Parts by weight | Wax (3), 5 parts by weight | 7 | 23 | 7500 | 11 | 66 | 19 | 10.1 | 106 |
| Embodiment 5 | L-1:50 Parts by weight H-3:50 Parts by weight | Wax (3), 5 parts by weight | 7 | 26 | 7200 | 15 | 63 | 19 | 6.4 | 116 |
| Embodiment 6 | L-1:50 Parts by weight H-4:60 Parts by weight | — parts by weight | 7 | 29 | 7700 | 10 | 70 | 18 | 5.7 | 120 |

TABLE 4-continued

| | Poly-ester | Wax added in manu-facture of toner | Acid value of binding resin of toner (mgKOH/g) | Component, insoluble in THF, of binding resin of toner (weight %) | Peak molecular weight | Component of molecular weight rang-ing from 100 thousands or higher to less than 10 million (weight %) | Component of molecular weight rang-ing from 5000 or higher to less than 100 thousands (weight %) | Component of molecular weight ranging 1000 or higher to less than 5000 (weight %) | Dielectric tangent ($\times 10^{-3}$) | Contacting angle of toner (°) |
|---|---|---|---|---|---|---|---|---|---|---|
| Embodiment 7 | L-1:50 Parts by weight H-5:60 Parts by weight | — parts by weight | | | Same as the Embodiment 1 | | | | 10.3 | 114 |
| Embodiment 8 | L-1:50 Parts by weight H-6:60 Parts by weight | — parts by weight | | | | | | | 4.9 | 126 |
| Embodiment 9 | L-1:50 Parts by weight H-2:30 Parts by weight H-5:30 Parts by weight | — parts by weight | | | | | | | 7.7 | 115 |
| Embodiment 10 | L-1:50 Parts by weight H-2:30 Parts by weight H-6:30 Parts by weight | — parts by weight | | | | | | | 5.3 | 123 |
| Embodiment 11 | L-4:50 Parts by weight H-7:50 Parts by weight | Wax (3), 5 parts by weight | 34 | 43 | 12000 | 26 | 59 | 13 | 24.6 | 103 |
| Embodiment 12 | L-4:50 Parts by weight H-8:60 Parts by weight | — parts by weight | | | Same as the Embodiment 11 | | | | 19.3 | 110 |
| Embodiment 13 | L-5:50 Parts by weight H-9:50 Parts by weight | Wax (3), 5 parts by weight | 17 | 31 | 4500 | 7 | 72 | 20 | 14.5 | 105 |
| Embodiment 14 | L-5:50 Parts by weight H-10:60 Parts by weight | — parts by weight | | | Same as the Embodiment 13 | | | | 13.9 | 114 |
| Embodiment 15 | L-1:50 Parts by weight H-1:50 Parts by weight | Wax (3), 5 parts by weight | | | Same as the Embodiment 1 | | | | 12.4 | 105 |
| Comparative example 1 | Parts by weight for compar-ison (1) 100 | Wax (3), 5 parts by weight | 1 | 52 | 16000 | 33 | 48 | 10 | 2.5 | 131 |

TABLE 4-continued

| | Poly-ester | Wax added in manu-facture of toner | Acid value of binding resin of toner (mgKOH/g) | Component, insoluble in THF, of binding resin of toner (weight %) | Peak molecular weight | Component of molecular weight rang-ing from 100 thousands or higher to less than 10 million (weight %) | Component of molecular weight rang-ing from 5000 or higher to less than 100 thousands (weight %) | Component of molecular weight ranging 1000 or higher to less than 5000 (weight %) | Dielectric tangent ($\times 10^{-3}$) | Contacting angle of toner (°) |
|---|---|---|---|---|---|---|---|---|---|---|
| Comparative example 2 | Parts by weight for compar-ison (2) 105 | — | Same as the Comparative example 1 | | | | | | 2.3 | 136 |
| Comparative example 3 | Parts by weight for compar-ison (3) 100 | Wax (7), 5 parts by weight | 44 | Below 1 weight % | 1800 | 0 | 45 | 50 | 32.4 | 91 |
| Comparative example 4 | Parts by weight for compar-ison (1) 100 | Wax (6), 5 parts by weight | Same as the Comparative example 1 | | | | | | 3.7 | 133 |
| Comparative example 5 | Parts by weight for compar-ison (3) 100 | Wax (7), 5 parts by weight | Same as the Comparative example 3 | | | | | | 32.5 | 92 |

TABLE 5

| | Evaluation of developing performance using GP-215 | | | Evaluation of developing performance using NP-6085 | | | Result of fixing test | | |
|---|---|---|---|---|---|---|---|---|---|
| | Initial concentration | Concentra-tion after endurance test | Attaching condition of toner | Initial concentration | Concentra-tion after endurance test | Attaching condition of toner | Fixing performance under low temp. | Offset performance resistant against high temp. | Evalua-tion of blocking |
| Embodiment 1 | 1.33 | 1.33 | 3 | 1.33 | 1.33 | 4 | 3 | 4 | 4 |
| Embodiment 2 | 1.35 | 1.35 | 4 | 1.34 | 1.36 | 4 | 4 | 4 | 5 |
| Embodiment 3 | 1.35 | 1.37 | 4 | 1.34 | 1.37 | 4 | 4 | 4 | 5 |
| Embodiment 4 | 1.36 | 1.34 | 3 | 1.35 | 1.36 | 4 | 4 | 4 | 4 |
| Embodiment 5 | 1.36 | 1.36 | 4 | 1.36 | 1.36 | 4 | 4 | 4 | 5 |
| Embodiment 6 | 1.36 | 1.39 | 4 | 1.38 | 1.36 | 4 | 5 | 4 | 4 |
| Embodiment 7 | 1.34 | 1.33 | 3 | 1.35 | 1.33 | 3 | 5 | 3 | 3 |
| Embodiment 8 | 1.38 | 1.39 | 4 | 1.39 | 1.40 | 5 | 4 | 5 | 5 |
| Embodiment 9 | 1.36 | 1.39 | 4 | 1.38 | 1.40 | 4 | 5 | 3 | 4 |
| Embodiment 10 | 1.38 | 1.41 | 5 | 1.39 | 1.42 | 5 | 4 | 5 | 5 |
| Embodiment 11 | 1.36 | 1.32 | 4 | 1.34 | 1.34 | 4 | 5 | 3 | 3 |
| Embodiment 12 | 1.38 | 1.34 | 4 | 1.35 | 1.38 | 4 | 4 | 5 | 4 |
| Embodiment 13 | 1.32 | 1.33 | 3 | 1.34 | 1.32 | 4 | 4 | 4 | 4 |
| Embodiment 14 | 1.34 | 1.36 | 4 | 1.35 | 1.33 | 4 | 4 | 5 | 4 |
| Embodiment 15 | 1.33 | 1.34 | 3 | 1.33 | 1.35 | 4 | 3 | 4 | 4 |

TABLE 5-continued

| | Evaluation of developing performance using GP-215 | | | Evaluation of developing performance using NP-6085 | | | Result of fixing test | | |
|---|---|---|---|---|---|---|---|---|---|
| | Initial concentration | Concentration after endurance test | Attaching condition of toner | Initial concentration | Concentration after endurance test | Attaching condition of toner | Fixing performance under low temp. | Offset performance resistant against high temp. | Evaluation of blocking |
| Comparative example 1 | 0.67 | 0.56 | 2 | 0.58 | 0.59 | 2 | 1 | 2 | 2 |
| Comparative example 2 | 0.71 | 0.68 | 2 | 0.61 | 0.63 | 2 | 1 | 2 | 2 |
| Comparative example 3 | 0.77 | 0.36 | 1 | 0.82 | 0.44 | 1 | 2 | 1 | 1 |
| Comparative example 4 | 0.89 | 0.95 | 2 | 0.93 | 0.88 | 2 | 2 | 2 | 2 |
| Comparative example 5 | 0.93 | 0.92 | 1 | 0.83 | 0.80 | 1 | 2 | 1 | 1 |

TABLE 6

| | Hybrid resin | Wax added in manufacture of toner | Acid value of binding resin of toner (mgKOH/g) | Component, insoluble in THF, of binding resin of toner (weight %) | Peak molecular weight | Component of molecular weight ranging from 100 thousands or higher to less than 10 million (weight %) | Component of molecular weight ranging from 5000 or higher to less than 100 thousands (weight %) | Component of molecular weight ranging 1000 or higher to less than 5000 (weight %) | Dielectric tangent ($\times 10^{-3}$) | Contacting angle of toner (°) |
|---|---|---|---|---|---|---|---|---|---|---|
| Embodiment 16 | Y-1:100 Parts by weight | Wax (3), 5 parts by weight | 4 | 13 | 5200 | 9 | 64 | 25 | 10.2 | 107 |
| Embodiment 17 | Y-2:100 Parts by weight | Wax (3), 5 parts by weight | 12 | 22 | 7200 | 23.5 | 51 | 19 | 8.4 | 109 |
| Embodiment 18 | Y-3:100 Parts by weight | Wax (3), 5 parts by weight | 13 | 36 | 12800 | 36 | 45 | 12 | 6.6 | 109 |
| Embodiment 19 | Y-4:105 Parts by weight | — | | | Same as the Embodiment 16 | | | | 7.5 | 113 |
| Embodiment 20 | Y-5:105 Parts by weight | — | | | | | | | 8.4 | 116 |
| Embodiment 21 | Y-6:105 Parts by weight | — | | | | | | | 7.7 | 115 |
| Embodiment 22 | Y-7:105 Parts by weight | — | | | | | | | 8.3 | 114 |
| Embodiment 23 | Y-8:100 Parts by weight | Wax (3), 5 parts by weight | 10 | 32 | 6500 | 6 | 57 | 23 | 9.9 | 112 |
| Embodiment 24 | Y-9:105 Parts by weight | — | | | Same as the Embodiment 23 | | | | 7.7 | 115 |
| Embodiment 25 | Y-10: 105 Parts by weight | — | | | | | | | 5.8 | 119 |
| Embodiment 26 | Y-11: 105 Parts by weight | — | | | | | | | 4.9 | 122 |
| Embodiment 27 | Y-12: 105 Parts by weight | — | | | | | | | 5.5 | 120 |
| Embodiment 28 | Y-1:100 Parts by weight | Wax (3), 5 parts by weight | | | Same as the Embodiment 16 | | | | 10.0 | 108 |
| Comparative example 6 | R-1:100 Parts by weight | Wax (8), 5 parts by weight | 43 | 0 | 1800 | 1 | 35 | 52 | 33.3 | 90 |

TABLE 6-continued

| | Hybrid resin | Wax added in manufacture of toner | Acid value of binding resin of toner (mgKOH/g) | Component, insoluble in THF, of binding resin of toner (weight %) | Peak molecular weight | Component of molecular weight ranging from 100 thousands or higher to less than 10 million (weight %) | Component of molecular weight ranging from 5000 or higher to less than 100 thousands (weight %) | Component of molecular weight ranging 1000 or higher to less than 5000 (weight %) | Dielectric tangent ($\times 10^{-3}$) | Contacting angle of toner (°) |
|---|---|---|---|---|---|---|---|---|---|---|
| Comparative example 7 | R-1:100 Parts by weight | Wax (9), 5 parts by weight | Same as the Comparative example 6 | | | | | | 34.5 | 92 |
| Comparative example 8 | R-2:100 Parts by weight | Wax (8), 5 parts by weight | 0.5 | 49 | 17500 | 42 | 38 | 7 | 2.6 | 133 |
| Comparative example 9 | R-2:100 Parts by weight | Wax (9), 5 parts by weight | Same as the Comparative example 8 | | | | | | 2.6 | 136 |
| Comparative example 10 | R-1:100 Parts by weight | Wax (8), 5 parts by weight | Same as the Comparative example 6 | | | | | | 33.2 | 93 |
| Comparative example 11 | R-2:100 Parts by weight | Wax (8), 5 parts by weight | Same as the Comparative example 8 | | | | | | 3.9 | 134 |

TABLE 7

| | Evaluation of developing performance using GP-215 | | | Evaluation of developing performance using NP-6085 | | | Result of fixing test | | |
|---|---|---|---|---|---|---|---|---|---|
| | Initial concentration | Concentration after endurance test | Attaching condition of toner | Initial concentration | Concentration after endurance test | Attaching condition of toner | Fixing performance under low temp. | Offset performance resistant against high temp. | Evaluation of blocking |
| Embodiment 16 | 1.35 | 1.36 | 4 | 1.36 | 1.35 | 4 | 4 | 4 | 4 |
| Embodiment 17 | 1.36 | 1.38 | 4 | 1.38 | 1.39 | 4 | 4 | 5 | 5 |
| Embodiment 18 | 1.38 | 1.38 | 4 | 1.41 | 1.40 | 4 | 4 | 5 | 5 |
| Embodiment 19 | 1.39 | 1.40 | 4 | 1.37 | 1.40 | 4 | 4 | 5 | 4 |
| Embodiment 20 | 1.38 | 1.38 | 5 | 1.36 | 1.41 | 4 | 4 | 4 | 4 |
| Embodiment 21 | 1.38 | 1.39 | 5 | 1.37 | 1.38 | 4 | 4 | 5 | 5 |
| Embodiment 22 | 1.35 | 1.37 | 4 | 1.37 | 1.38 | 3 | 5 | 4 | 4 |
| Embodiment 23 | 1.37 | 1.39 | 4 | 1.38 | 1.40 | 5 | 4 | 5 | 4 |
| Embodiment 24 | 1.38 | 1.39 | 5 | 1.42 | 1.40 | 4 | 5 | 5 | 5 |
| Embodiment 25 | 1.38 | 1.41 | 5 | 1.39 | 1.40 | 5 | 5 | 5 | 5 |
| Embodiment 26 | 1.38 | 1.40 | 5 | 1.41 | 1.42 | 4 | 4 | 5 | 5 |
| Embodiment 27 | 1.39 | 1.42 | 5 | 1.38 | 1.38 | 4 | 5 | 5 | 4 |
| Embodiment 28 | 1.36 | 1.38 | 4 | 1.36 | 1.36 | 4 | 4 | 4 | 4 |
| Comparative example 6 | 0.61 | 0.46 | 1 | 0.58 | 0.35 | 1 | 1 | 1 | 1 |
| Comparative example 7 | 0.63 | 0.58 | 2 | 0.61 | 0.56 | 2 | 2 | 2 | 2 |
| Comparative example 8 | 0.77 | 0.36 | 1 | 0.72 | 0.64 | 2 | 1 | 2 | 2 |
| Comparative example 9 | 0.78 | 0.85 | 2 | 0.74 | 0.70 | 2 | 2 | 2 | 2 |
| Comparative example 10 | 0.89 | 0.88 | 2 | 0.76 | 0.74 | 2 | 1 | 2 | 2 |
| Comparative example 11 | 0.92 | 0.90 | 3 | 0.89 | 0.87 | 3 | 2 | 3 | 3 |

TABLE 8

| | Wax species | Peak molecular weight | Mw/Mn | Endothermic main peak temperature |
|---|---|---|---|---|
| Wax (10) | Hydrocarbon-based wax | 630 | 1.4 | 79° C. |
| Wax (11) | Wax having a hydroxy group expressed by the formula (2) (Mean of a is 40) | 1150 | 2.3 | 109° C. |
| Wax (12) | Hydrocarbon-based wax | 1100 | 1.7 | 110° C. |
| Wax (13) | Polypropylene denatured by maleic acid | 2400 | 6.6 | 124° C. |
| Wax (14) | Polypropylene | 3900 | 9.5 | 145° C. |
| Mixture of equal quantity of wax (10) and wax (12) | — | 780 | 2.1 | 102° C. |
| Mixture of equal quantity of wax (12) and wax (14) | — | 2250 | 6.9 | 137° C. |
| Wax (15) | Polypropylene | 6300 | 25 | 154° C. |
| Wax (16) | Hydrocarbon-based wax | 300 | 1.2 | 65° C. |

TABLE 9

| Embodiment | Resin species | | | Wax added in resin preparation | peak molecular weight | subpeak molecular weight |
|---|---|---|---|---|---|---|
| Embodiment 29 | Vinyl-based polymer 1 | L-6 70 Parts | H-11 30 Parts | wax (12), 5 parts by weight | 11000 | 876 thousands |
| Embodiment 30 | Vinyl-based polymer 2 | L-6 70 Parts | H-11 30 Parts | (–) | Same as the embodiment 29 | |
| Embodiment 31 | Vinyl-based polymer 3 | L-6 70 Parts | H-11 30 Parts | wax (11), 5 parts by weight | | |
| Embodiment 32 | Vinyl-based polymer 4 | L-6 70 Parts | H-11 30 Parts | wax (13), 5 parts by weight | | |
| Embodiment 33 | Vinyl-based polymer 5 | L-6 70 Parts | H-11 30 Parts | wax (14), 5 parts by weight | | |
| Embodiment 34 | Vinyl-based polymer 6 | L-6 70 Parts | H-11 30 Parts | wax (10), 2.5 parts by weight wax (12), 2.5 parts by weight | | |
| Embodiment 35 | Vinyl-based polymer 7 | L-6 70 Parts | H-11 30 Parts | wax (12), 2.5 parts by weight wax (14), 2.5 parts by weight | | |
| Embodiment 36 | Vinyl-based polymer 8 | L-6 70 Parts | H-13 30 Parts | wax (12), 5 parts by weight | 11000 | 327 thousands |
| Embodiment 37 | Vinyl-based polymer 9 | L-6 70 Parts | H-11 30 Parts | wax (12), 5 parts by weight | 7900 | 871 thousands |
| Embodiment 38 | Vinyl-based polymer 10 | L-8 70 Parts | H-13 30 Parts | wax (12), 5 parts by weight | 19300 | 329 thousands |
| Embodiment 39 | Vinyl-based polymer 11 | L-9 70 Parts | H-12 30 Parts | wax (12), 5 parts by weight | 7700 | 1076 thousands |
| Embodiment 40 | Vinyl-based polymer 12 | L-10 70 Parts | H-13 30 Parts | wax (12), 5 parts by weight | 20800 | 332 thousands |
| Embodiment 41 | Vinyl-based polymer 13 | L-11 70 Parts | H-13 30 Parts | wax (12), 5 parts by weight | 22400 | 337 thousands |
| Embodiment 42 | Vinyl-based polymer 14 | L-6 70 Parts | H-11 30 Parts | wax (12), 10 parts by weight | Same as the embodiment 29 | |
| Embodiment 43 | Vinyl-based polymer 15 | L-6 70 Parts | H-11 30 Parts | wax (12), 3 parts by weight | | |
| Embodiment 44 | Vinyl-based polymer 1 | L-6 70 Parts | H-11 30 Parts | wax (12), 6 parts by weight | | |
| Comparative example 12 | Vinyl-based polymer for comparison use 1 | RL-1 70 Parts | RH-1 30 Parts | wax (16), 5 parts by weight | 4200 | 176 thousands |
| Comparative example 13 | Vinyl-based polymer for comparison use 2 | RL-2 70 Parts | RH-1 30 Parts | (–) | 4200 | 176 thousands |
| Comparative example 14 | Vinyl-based polymer for comparison use 3 | RL-1 70 Parts | RH-2 30 Parts | wax (15), 2.5 parts by weight wax (16), 2.5 parts by weight | 4700 | 188 thousands |
| Comparative example 15 | Vinyl-based polymer for comparison use 4 | RL-4 70 Parts | RH-2 30 Parts | wax (15), 2.5 parts by weight wax (16), 2.5 parts by weight | 33000 | 188 thousands |
| Comparative example 16 | Vinyl-based polymer for comparison use 5 | RL-3 70 Parts | RH-1 30 Parts | (–) | 31000 | 176 thousands |
| Comparative example 17 | Vinyl-based polymer for comparison use 1 | RL-1 70 Parts | RH-1 30 Parts | wax (16), 5 parts by weight | Same as the Comparative example 12 | |
| Comparative example 18 | Vinyl-based polymer for comparison use 3 | RL-1 70 Parts | RH-2 30 Parts | wax (15), 2.5 parts by weight | Same as the Comparative example 14 | |

TABLE 9-continued

| | | | | | |
|---|---|---|---|---|---|
| Comparative example 19 | Vinyl-based polymer for comparison use 4 | RL-4 70 Parts | RH-2 30 Parts | wax (16), 2.5 parts by weight wax (15), 2.5 parts by weight wax (16), 2.5 parts by weight | Same as the Comparative example 15 |

| Embodiment | Molecular weight of shoulder | Acid value of toner | Insoluble in THF, (weight %) | Dielectric tangent | Contacting angle of toner (°) |
|---|---|---|---|---|---|
| Embodiment 29 | (–) | 6 | 5 | $3.2 \times 10^{-3}$ | 125 |
| Embodiment 30 | Same as the embodiment 29 | | | $4.5 \times 10^{-3}$ | 107 |
| Embodiment 31 | | | | $4.2 \times 10^{-3}$ | 109 |
| Embodiment 32 | | | | $4.4 \times 10^{-3}$ | 121 |
| Embodiment 33 | | | | $4.0 \times 10^{-3}$ | 127 |
| Embodiment 34 | | | | $3.5 \times 10^{-3}$ | 114 |
| Embodiment 35 | | | | $3.3 \times 10^{-3}$ | 128 |
| Embodiment 36 | (–) | 6 | 2 | $3.2 \times 10^{-3}$ | 116 |
| Embodiment 37 | (–) | 10 | 20 | $7.9 \times 10^{-3}$ | 120 |
| Embodiment 38 | (–) | 4 | 2 | $2.8 \times 10^{-3}$ | 110 |
| Embodiment 39 | 2300 thousands | 21 | 35 | $1.2 \times 10^{-2}$ | 128 |
| Embodiment 40 | (–) | 4 | 2 | $2.6 \times 10^{-3}$ | 128 |
| Embodiment 41 | (–) | 4 | 2 | $2.5 \times 10^{-3}$ | 129 |
| Embodiment 42 | Same as the embodiment 29 | | | $2.9 \times 10^{-3}$ | 128 |
| Embodiment 43 | | | | $3.6 \times 10^{-3}$ | 108 |
| Embodiment 44 | | | | $4.2 \times 10^{-3}$ | 125 |
| Comparative example 12 | (–) | 0 | 0 | $2.3 \times 10^{-2}$ | 102 |
| Comparative example 13 | (–) | 0 | 0 | $2.6 \times 10^{-2}$ | 93 |
| Comparative example 14 | (–) | 42 | 0 | $3.3 \times 10^{-2}$ | 101 |
| Comparative example 15 | (–) | 0 | 0 | $2.4 \times 10^{-2}$ | 97 |
| Comparative example 16 | (–) | 42 | 0 | $2.9 \times 10^{-2}$ | 99 |
| Comparative example 17 | Same as the Comparative example 12 | | | $2.4 \times 10^{-3}$ | 102 |
| Comparative example 18 | Same as the Comparative example 14 | | | $3.4 \times 10^{-3}$ | 101 |
| Comparative example 19 | Same as the Comparative example 15 | | | $2.4 \times 10^{-3}$ | 97 |

TABLE 10

| | Evaluation of developing performance using GP-215 | | | Evaluation of developing performance using NP-6085 | | | Result of fixing test | | |
|---|---|---|---|---|---|---|---|---|---|
| | Initial concentration | Concentration after endurance test | Attaching condition of toner | Initial concentration | Concentration after endurance test | Attaching condition of toner | Fixing performance under low temp. | Offset performance resistant against high temp. | Evaluation of blocking |
| Embodiment 29 | 1.37 | 1.38 | 5 | 1.39 | 1.40 | 4 | 4 | 4 | 5 |
| Embodiment 30 | 1.36 | 1.33 | 3 | 1.36 | 1.35 | 3 | 3 | 4 | 4 |
| Embodiment 31 | 1.38 | 1.37 | 3 | 1.39 | 1.35 | 3 | 4 | 3 | 4 |
| Embodiment 32 | 1.35 | 1.37 | 4 | 1.33 | 1.36 | 4 | 3 | 4 | 4 |
| Embodiment 33 | 1.36 | 1.37 | 4 | 1.37 | 1.37 | 5 | 3 | 5 | 5 |
| Embodiment 34 | 1.37 | 1.37 | 3 | 1.35 | 1.35 | 4 | 5 | 3 | 5 |
| Embodiment 35 | 1.38 | 1.39 | 5 | 1.40 | 1.40 | 5 | 4 | 5 | 5 |
| Embodiment 36 | 1.36 | 1.39 | 3 | 1.37 | 1.40 | 4 | 5 | 4 | 4 |
| Embodiment 37 | 1.34 | 1.36 | 3 | 1.41 | 1.35 | 3 | 5 | 3 | 4 |
| Embodiment 38 | 1.37 | 1.38 | 4 | 1.40 | 1.39 | 4 | 3 | 5 | 5 |
| Embodiment 39 | 1.33 | 1.36 | 3 | 1.34 | 1.36 | 3 | 3 | 5 | 5 |

TABLE 10-continued

| | Evaluation of developing performance using GP-215 | | | Evaluation of developing performance using NP-6085 | | | Result of fixing test | | |
|---|---|---|---|---|---|---|---|---|---|
| | Initial concentration | Concentration after endurance test | Attaching condition of toner | Initial concentration | Concentration after endurance test | Attaching condition of toner | Fixing performance under low temp. | Offset performance resistant against high temp. | Evaluation of blocking |
| Embodiment 40 | 1.38 | 1.38 | 5 | 1.39 | 1.38 | 5 | 3 | 5 | 5 |
| Embodiment 41 | 1.41 | 1.39 | 5 | 1.38 | 1.40 | 5 | 3 | 5 | 5 |
| Embodiment 42 | 1.41 | 1.36 | 5 | 1.40 | 1.37 | 5 | 4 | 4 | 4 |
| Embodiment 43 | 1.37 | 1.36 | 3 | 1.37 | 1.38 | 3 | 3 | 3 | 5 |
| Embodiment 44 | 1.39 | 1.38 | 5 | 1.39 | 1.39 | 5 | 4 | 4 | 5 |
| Comparative example 12 | 1.01 | 1.03 | 2 | 0.88 | 0.85 | 2 | 1 | 2 | 2 |
| Comparative example 13 | 0.78 | 0.63 | 1 | 0.57 | 0.55 | 1 | 1 | 1 | 2 |
| Comparative example 14 | 0.86 | 0.87 | 2 | 0.73 | 0.62 | 2 | 2 | 1 | 2 |
| Comparative example 15 | 0.94 | 0.89 | 2 | 0.73 | 0.62 | 2 | 2 | 2 | 2 |
| Comparative example 16 | 0.88 | 0.76 | 1 | 0.77 | 0.83 | 2 | 2 | 1 | 2 |
| Comparative example 17 | 1.20 | 1.22 | 2 | 1.23 | 1.09 | 2 | 1 | 2 | 3 |
| Comparative example 18 | 0.94 | 0.99 | 2 | 1.06 | 1.05 | 2 | 2 | 2 | 2 |
| Comparative example 19 | 1.18 | 1.20 | 2 | 1.08 | 0.93 | 2 | 3 | 2 | 3 |

TABLE 11

| | Weight average particle size ($\mu$m) | Variation coefficient of number distribution | Peak molecular weight | Subpeak molecular weight | Molecular weight of shoulder | Acid value of toner | Component insoluble in THF (weight %) | Dielectric tangent ($\times 10^{-3}$) | Contacting angle of toner (°) |
|---|---|---|---|---|---|---|---|---|---|
| Magnetic toner (45) | 6.1 | 22 | 18,000 | 200,000 | 1,500,000 | 2 | 5 | 5.6 | 108 |
| Magnetic toner (46) | 5.9 | 19 | 18,000 | 200,000 | 1,400,000 | 3 | 7 | 6.0 | 112 |
| Magnetic toner (20) for comparison | 6.2 | 21 | 18,000 | 200,000 | 1,700,000 | 2 | 6 | 3.0 | 103 |

TABLE 12

| | | Evaluation of electrification characteristics | | | | | | Evaluation of printed image | | | |
|---|---|---|---|---|---|---|---|---|---|---|---|
| | | Triboelectric charge | | | Electrification rate | | | Concentration | Spatter | Fogging | Reproducibility |
| | Toner No. | N/N | L/L | H/H | N/N | L/L | H/H | of image | of image | of image | of dot |
| Embodiment 45 | Magnetic toner (45) | A | A | A | A | A | A | A | A | A | A |
| Embodiment 46 | Magnetic toner (46) | A | A | B | A | B | B | A | A | B | B |
| Comparative example 20 | Magnetic toner (20) for comparison | B | B | D | C | C | D | B | C | D | D |

TABLE 13

| | Weight average particle size (μm) | Variation coefficient of number distribution | Peak molecular weight | Subpeak molecular weight | Molecular weight of shoulder | Acid value of toner | Component insoluble in THF (weight %) | Dielectric tangent ($\times 10^{-3}$) | Contacting angle of toner (°) |
|---|---|---|---|---|---|---|---|---|---|
| Nonmagnetic toner (47) | 6.9 | 23 | 23,000 | 300,000 | — | 6 | 2 | 4.2 | 106 |
| Nonmagnetic toner (21) for comparison | 7.1 | 18 | 23,000 | 300,000 | 5,100,000 | 6 | 2 | 1.5 | 100 |

TABLE 14

| | | Evaluation of electrification characteristics | | | | | | Evaluation of printed image | | | |
|---|---|---|---|---|---|---|---|---|---|---|---|
| | | Triboelectric charge | | | Electrification rate | | | Concentration | Spatter | Fogging | Reproducibility |
| | Toner No. | N/N | L/L | H/H | N/N | L/L | H/H | of image | of image | of image | of dot |
| Embodiment 47 | Nonmagnetic toner (47) | A | A | A | A | A | A | A | A | A | A |
| Comparative example 21 | Nonmagnetic toner (21) for comparison | B | C | D | C | C | D | B | D | D | D |

TABLE 15

| | Coloring agent | | Benzilic acid-based compound | | |
|---|---|---|---|---|---|
| | Name | Quantity added (part by weight) | Category | Internal added (part by weight) | External added quantity (part by weight) |
| Nonmagnetic toner (48) | Carbon black | 8 | Compound consisting of benzilic acid (2 mol) and Al atom (1 mol). | 1 | 0.1 |
| Nonmagnetic toner (49) | C.I. pigment red 37 | 5 | Compound consisting of benzilic acid (3 mol) and Al atom (1 mol). | 3 | 0.05 |
| Nonmagnetic toner (50) | C.I. pigment blue 10 | 5 | Compound consisting of benzilic acid (3 mol) and Al atom (2 mol). | 5 | 0 |
| Nonmagnetic toner (51) | C.I. pigment yellow 3 | 5 | Compound consisting of benzilic acid (2 mol) and Al atom (1 mol). | 7 | 0 |
| Nonmagnetic toner (22) for comparison | Carbon black | 8 | Compound consisting of benzilic acid (2 mol) and B atom (1 mol). | 1 | 0.1 |
| Nonmagnetic toner (23) for comparison | C.I. pigment red 37 | 5 | Compound consisting of benzilic acid (2 mol) and B atom (1 mol). | 3 | 0.05 |
| Nonmagnetic toner (24) for comparison | C.I. pigment blue 10 | 5 | Compound consisting of benzilic acid (2 mol) and B atom (1 mol). | 5 | 0 |
| Nonmagnetic toner (25) for comparison | C.I. pigment yellow 3 | 5 | Compound consisting of benzilic acid (2 mol) and B atom (1 mol). | 7 | 0 |

Benzilic acid used was always that having no substitution group.

TABLE 16

| | Weight average particle size (μm) | Variation coefficient of number distribution | Peak molecular weight | Subpeak molecular weight | Molecular weight of shoulder | Acid value of toner | Component insoluble in THF (weight %) | Dielectric tangent ($\times 10^{-3}$) | Contacting angle of toner (°) |
|---|---|---|---|---|---|---|---|---|---|
| Nonmagnetic toner (48) | 5.7 | 14 | 19,000 | — | 1,300,000 | 3 | 25 | 8.8 | 108 |
| Nonmagnetic toner (49) | 5.5 | 13 | 19,000 | — | 1,400,000 | 4 | 23 | 7.5 | 113 |
| Nonmagnetic toner (50) | 5.6 | 15 | 19,000 | — | 1,300,000 | 5 | 23 | 8.2 | 110 |
| Nonmagnetic toner (51) | 5.9 | 16 | 18,000 | — | 1,500,000 | 5 | 19 | 7.0 | 119 |
| Nonmagnetic toner (22) for comparison | 6.4 | 19 | 19,000 | — | 2,300,000 | 0.5 | 25 | 3.2 | 93 |
| Nonmagnetic toner (23) for comparison | 6.1 | 17 | 19,000 | — | 2,400,000 | 0.5 | 24 | 3.5 | 91 |
| Nonmagnetic toner (24) for comparison | 6.3 | 18 | 19,000 | — | 2,400,000 | 0.5 | 23 | 3.1 | 93 |
| Nonmagnetic toner (25) for comparison | 6.6 | 19 | 18,000 | — | 2,500,000 | 0.5 | 20 | 2.5 | 97 |

TABLE 17

| | | Evaluation of electrification characteristics | | | | | | Evaluation of printed image | | | |
|---|---|---|---|---|---|---|---|---|---|---|---|
| | | Triboelectric charge | | | Electrification rate | | | Concentration | Spatter | Fogging | Reproducibility |
| | Toner No. | N/N | L/L | H/H | N/N | L/L | H/H | of image | of image | of image | of dot |
| Embodiment 48 | Nonmagnetic toner (48) | A | A | A | A | A | A | A | A | A | A |
| Embodiment 49 | Nonmagnetic toner (49) | A | B | B | A | A | B | A | B | B | A |
| Embodiment 50 | Nonmagnetic toner (50) | A | A | B | B | B | B | A | B | B | B |
| Embodiment 51 | Nonmagnetic toner (51) | A | A | B | A | B | B | A | A | B | B |
| Comparative example 22 | Nonmagnetic toner (22) for comparison | C | C | D | C | C | D | B | C | C | D |
| Comparative example 23 | Nonmagnetic toner (23) for comparison | C | C | C | C | C | C | C | C | D | D |
| Comparative example 24 | Nonmagnetic toner (24) for comparison | C | C | C | D | C | C | C | C | D | D |
| Comparative example 25 | Nonmagnetic toner (25) for comparison | C | C | C | C | D | C | B | C | D | C |

What is claimed is:

1. A toner containing at least a binder resin, a colorant, a wax, and an organic aluminum compound, wherein the toner has a contact angle to water of 105 to 130 degrees and i) said binder resin has an acid value of 1 to 40 mgKOH/g, ii) said binder resin contains 2 to 50% by weight of a tetrahydrofuran (THF)-insoluble matter based on the binder resin, iii) the tetrahydrofuran-soluble matter of said binder resin has the main peak in the molecular weight range of from 2,000 to 30,000 in a chromatogram by gel permeation chromatography (GPC), and iv) said organic aluminum compound is an aluminum complex compound and/or an aluminum complex salt having three coordinated molecules of a substituted or unsubstituted benzilic acid represented by the following chemical formula (1)

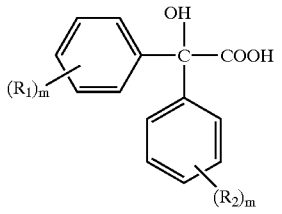

wherein $R_1$ and $R_2$, which may be identical or different, are each a substituent selected from the group consisting of linear or branched alkyl groups, alkenyl groups, alkoxy groups, halogen atoms, nitro groups, cyano groups, amino groups, carboxyl groups, and hydroxyl groups; and, m and n are each an integer of 0 to 5.

2. The toner according to claim 1, wherein the binder resin is a resin mainly composed of polyester, and has an acid value of 2 to 40 mgKOH/g.

3. The toner according to claim 1, wherein the binder resin is a resin mainly composed of polyester, and has an acid value of 5 to 35 mgKOH/g.

4. The toner according to claim 1, wherein the binder resin is a resin mainly composed of polyester that contains 5 to 40% by weight of a tetrahydrofuran (THF)-insoluble matter based the binder resin.

5. The toner according to claim 1, wherein the binder resin is a resin mainly composed of polyester that contains 7 to 30% by weight of tetrahydrofuran (THF)-insoluble matter based on the binder resin.

6. The toner according to claim 1, wherein the binder resin is a resin mainly composed of polyester, and the tetrahydrofuran-soluble matter of the binder resin has the main peak in the molecular weight range of from 2,000 to 15,000 in the chromatogram by gel permeation chromatography (GPC).

7. The toner according to claim 1, wherein the binder resin is a resin mainly composed of polyester, and the tetrahydrofuran-soluble matter of the binder resin has the main peak in the molecular weight range of from 4,000 to 12,000 in the chromatogram by gel permeation chromatography (GPC).

8. The toner according to claim 1, wherein the binder resin is a resin mainly composed of polyester, and the tetrahydrofuran-soluble matter of the binder resin has 5 to 30% by weight of components having a molecular weight of 100,000 or more to less than 10,000,000.

9. The toner according to claim 1, wherein the binder resin is a resin mainly composed of polyester, and the tetrahydrofuran-soluble component of the binder resin has 50 to 80% by weight of components having a molecular weight of 5,000 or more to less than 100,000.

10. The toner according to claim 1, wherein the binder resin is a resin mainly composed of polyester, and the tetrahydrofuran-soluble matter of the binder resin has 10 to 30% by weight of components having a molecular weight of 1,000 or more to less than 5,000.

11. The toner according to claim 1, wherein the binder resin is a resin mainly composed of polyester, and said toner has a dielectric dissipation factor (tan δ) of $1\times10^{-3}$ to $3\times10^{-2}$ measured at a frequency of 100 kHz.

12. The toner according to claim 1, wherein the binder resin is a resin mainly composed of polyester, and said toner has a dielectric dissipation factor (tan δ) of $5\times10^{-3}$ to $3\times10^{-2}$ measured at a frequency of 100 kHz.

13. The toner according to claim 1, wherein the binder resin is a resin containing a hybrid resin component having polyester units and vinyl polymer units, and has an acid value of 2 to 40 mgKOH/g.

14. The toner according to claim 1, wherein the binder resin is a resin containing a hybrid resin component having polyester units and vinyl polymer units, and has an acid value of 5 to 35 mgKOH/g.

15. The toner according to claim 1, wherein the binder resin is a resin containing a hybrid resin component having polyester units and vinyl polymer units that contains 5 to 40% by weight of tetrahydrofuran (THF)-insoluble matter based on the binder resin.

16. The toner according to claim 1, wherein the binder resin is a resin containing a hybrid resin component having polyester units and vinyl polymer units that contains 7 to 30% by weight of tetrahydrofuran (THF)-insoluble matter based on the binder resin.

17. The toner according to claim 1, wherein the binder resin is a resin containing a hybrid resin component having polyester units and vinyl polymer units, and the tetrahydrofuran-soluble matter of the binder resin has the main peak in the molecular weight range of from 2,000 to 15,000 in the chromatogram by gel permeation chromatography (GPC).

18. The toner according to claim 1, wherein the binder resin is a resin containing a hybrid resin component having polyester units and vinyl polymer units, and the tetrahydrofuran-soluble matter of the binder resin has the main peak in the molecular weight range of from 3,000 to 10,000 in the chromatogram by gel permeation chromatography (GPC).

19. The toner according to claim 1, wherein the binder resin is a resin containing a hybrid resin component having polyester units and vinyl polymer units, and the tetrahydrofuran-soluble matter of the binder resin has 5 to 40% by weight of components having a molecular weight of 100,000 or more to less than 10,000,000.

20. The toner according to claim 1, wherein the binder resin is a resin containing a hybrid resin component having polyester units and vinyl polymer units, and the tetrahydrofuran-soluble matter of the binder resin has 40 to 70% by weight of components having a molecular weight of 5,000 or more to less than 100,000.

21. The toner according to claim 1, wherein the binder resin is a resin containing a hybrid resin component having polyester units and vinyl polymer units, and the tetrahydrofuran-soluble matter of the binder resin has 10 to 30% by weight of components having a molecular weight of 1,000 or more to less than 5,000.

22. The toner according to claim 1, wherein the binder resin is a resin containing a hybrid resin component having polyester units and vinyl polymer units, and said toner has a dielectric dissipation factor (tan δ) of $1\times10^{-3}$ to $3\times10^{-2}$ measured at a frequency of 100 kHz.

23. The toner according to claim 1, wherein the binder resin is a resin containing a hybrid resin component having polyester units and vinyl polymer units, and said toner has a dielectric dissipation factor (tan δ) of $3\times10^{-3}$ to $3\times10^{-2}$ measured at a frequency of 100 kHz.

24. The toner according to claim 1, wherein the binder resin is a resin mainly composed of a vinyl polymer, and has an acid value of 2 to 30 mgKOH/g.

25. The toner according to claim 1, wherein the binder resin is a resin mainly composed of a vinyl polymer, and has an acid value of 5 to 20 mgKOH/g.

26. The toner according to claim 1, wherein the binder resin is a resin mainly composed of a vinyl polymer that contains 3 to 50% by weight of tetrahydrofuran (THF)-insoluble matter based on the binder resin.

27. The toner according to claim 1, wherein the binder resin is a resin mainly composed of a vinyl polymer that contains 5 to 30 percent by weight of tetrahydrofuran (THF)-insoluble matter based on the binder resin.

28. The toner according to claim 1, wherein the binder resin is a resin mainly composed of a vinyl polymer, and the tetrahydrofuran-soluble matter of the binder resin has the main peak in the molecular weight range of from 5,000 to 30,000 in the chromatogram by gel permeation chromatography (GPC).

29. The toner according to claim 1, wherein the binder resin is a resin mainly composed of a vinyl polymer, and the tetrahydrofuran-soluble matter of the binder resin has the main peak in the molecular weight range of from 7,000 to 25,000 in the chromatogram by gel permeation chromatography (GPC).

30. The toner according to claim 1, wherein the binder resin is a resin mainly composed of a vinyl polymer, and the tetrahydrofuran-soluble matter of the binder resin has at least one sub-peak and/or shoulder in the molecular weight range of from 200,000 to 1,500,000.

31. The toner according to claim 1, wherein the binder resin is a resin mainly composed of a vinyl polymer, and the tetrahydrofuran-soluble matter of the binder resin has at least one sub-peak and/or shoulder in the molecular weight range of from 300,000 to 1,200,000.

32. The toner according to claim 1, wherein the binder resin is a resin mainly composed of a vinyl polymer, and said toner has a dielectric dissipation factor (tan δ) of $1\times10^{-3}$ to $3\times10^{-2}$ measured at a frequency of 100 kHz.

33. The toner according to claim 1, wherein the binder resin is a resin mainly composed of a vinyl polymer, and said toner has a dielectric dissipation factor (tan δ) of $1\times10^{-3}$ to $2\times10^{-2}$ measured at a frequency of 100 kHz.

34. The toner according to claim 1, wherein the toner has an contact angle to water of 107 to 127 degrees.

35. The toner according to claim 1, wherein the toner contains 0.1 to 5% by weight of an organic aluminum compound.

36. The toner according to claim 1, wherein the toner contains 0.5 to 3% by weight of an organic aluminum compound.

37. The toner according to claim 1, wherein the toner contains 0.7 to 2% by weight of an organic aluminum compound.

38. The toner according to claim 1, wherein the organic aluminum compound is a mixture of aluminum complex compounds and/or aluminum complex salts having two or three coordinated molecules of benzilic acid represented by Formula (1).

39. The toner according to claim 1, wherein the wax has the main peak in the molecular weight range of from 500 to 20,000 in the chromatogram by gel permeation chromatography (GPC).

40. The toner according to claim 1, wherein the wax has the ratio of the weight average molecular weight (Mw) and the number average molecular weight (Mn), (Mw/Mn) of 1.0 to 20.

41. The toner according to claim 1, wherein the wax has the main peak in the molecular weight range of from 500 to 20,000 in the chromatogram by gel permeation chromatography (GPC), and has the ratio of the weight average molecular weight (Mw) and the number average molecular weight (Mn), (Mw/Mn) of 1.0 to 20.

42. The toner according to claim 1, wherein the wax has the main peak in the molecular weight range of from 600 to 15,000 in the chromatogram by gel permeation chromatography (GPC), and has the ratio of the weight average molecular weight (Mw) and the number average molecular weight (Mn), (Mw/Mn) of 1.1 to 18.

43. The toner according to claim 1, wherein the wax has the main peak in the molecular weight range of from 700 to 10,000 in the chromatogram by gel permeation chromatography (GPC), and has the ratio of the weight average molecular weight (Mw) and the number average molecular weight (Mn), (Mw/Mn) of 1.2 to 10.

44. The toner according to claim 1, wherein the wax has the main endothermic peak in a temperature range of from 40 to 140° C. in the DSC curve measured by a differential scanning calorimeter (DSC).

45. The toner according to claim 1, wherein the wax has the main endothermic peak in a temperature range of from 70 to 140° C. in the DSC curve measured by a differential scanning calorimeter (DSC).

46. The toner according to claim 1, wherein the wax has the main endothermic peak in a temperature range of from 75 to 135° C. in the DSC curve measured by a differential scanning calorimeter (DSC).

47. The toner according to claim 1, wherein the wax is a hydrocarbon-based wax, a polyethylene-based wax, or a polypropylene-based wax.

48. The toner according to claim 1, wherein the wax contains two different types of wax.

49. The toner according to claim 1, wherein the wax contains wax represented by the following Formula (2)

$$CH_3\text{-}(CH_2\text{—}CH_2)_a CH_2\text{—}CH_2\text{—}A \qquad (2)$$

wherein A represents a hydroxyl group or a carboxyl group, and a represents an integer of 20 to 60.

50. The toner according to claim 1, wherein the wax contains acid-modified polyethylene having an acid value of 1 to 20 mgKOH/g.

51. The toner according to claim 1, wherein the wax contains acid-modified polypropylene having an acid value of 1 to 20 mgKOH/g.

52. The toner according to claim 1, wherein the wax is added during the manufacturing of the binder resin.

53. The toner according to claim 1, wherein the toner has a weight average particle diameter of 2.5 to 10 μm.

54. The toner according to claim 1, wherein the toner has a weight average particle diameter of 2.5 to 6.0 μm.

55. An image forming method, comprising at least:

(a) a charging step for charging an image bearing member holding an electrostatic image;

(b) an exposing step for forming an electrostatic image on the charged image bearing member by the exposure;

(c) a developing step for developing said electrostatic image with the toner carried on the surface of a toner carrying member to form a toner image;

(d) a transferring step for transferring the toner image formed on the surface of the image bearing member to a transfer material through or not through an intermediate transfer member; and (e) a fixing step for fixing the toner images on the transfer material that have been transferred onto said transfer material; wherein the toner contains at least a binder resin, a colorant, a wax, and an organic aluminum compound, wherein the toner is according to any one of claims 2–33, 34–37 or 38–54.

56. An image forming method, comprising at least (a) a charging step for charging an image bearing member holding an electrostatic image;

(b) an exposing step for forming an electrostatic image on the charged image bearing member by the exposure;

(c) a developing step for developing said electrostatic image with the toner carried on the surface of a toner carrying member to form a toner image;

(d) a transferring step for transferring the toner image formed on the surface of the image bearing member to a transfer material through or not through an intermediate transfer member; and (e) a fixing step for fixing the toner images on the transfer material that have been transferred onto said transfer material; wherein the toner contains at least a binder resin, a colorant, a wax, and an organic aluminum compound, wherein the toner has a contact angle to water of 105 to 130 degrees and i) said binder resin has an acid value of 1 to 40 mgKOH/g, ii) said binder resin contains 2 to 50% by weight of tetrahydrofuran (THF)-insoluble matter based on the binder resin, iii) the tetrahydrofuran-soluble matter of said binder resin has the main peak in the molecular weight range of from 2,000 to 30,000 in the chromatogram by gel permeation chromatography (GPC), and iv) said organic aluminum compound is an aluminum complex compound and/or an aluminum complex salt having three coordinated molecules of a substituted or unsubstituted benzilic acid represented by the following chemical formula (1)

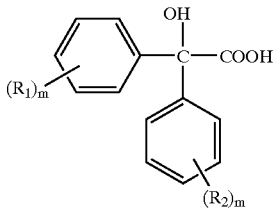

wherein $R_1$ and $R_2$, which may be identical or different, are each a substituent selected from a group consisting of linear or branched alkyl groups, alkenyl groups, alkoxy groups, halogen atoms, nitro groups, cyano groups, amino groups, carboxyl groups, and hydroxyl groups; and, m and n are each an integer of 0 to 5.

57. The image forming method according to claim 56, wherein an alternating bias voltage is applied to said toner carrying member during the developing step.

58. The image forming method according to claim 56, wherein an alternating bias voltage to which a DC voltage component is superimposed is applied to said toner carrier during the developing step.

* * * * *

UNITED STATES PATENT AND TRADEMARK OFFICE

CERTIFICATE OF CORRECTION

PATENT NO. : 6,447,970 B1
DATED : September 10, 2002
INVENTOR(S) : Matsunaga et al.

It is certified that error appears in the above-identified patent and that said Letters Patent is hereby corrected as shown below:

Column 8,
Line 11, “in” should be deleted.

Column 12,
Line 39, “1,5-pentandiol” should read -- 1,5-pentanediol --.

Column 13,
Line 8, “phtalic” should read -- phthalic --; and
Line 13, “fumalic” should read -- fumaric --.

Column 14,
Line 28, “vinyliden” should read -- vinylidene --; and
Line 30, “benzoenate” should read -- benzonate --.

Column 15,
Line 24, “zivinyl” should read -- divinyl --;
Line 31, “glyco ldiacrylate” should read -- glycol diacrylate --; and
Line 44, “pentaerysri” should read -- pentaerythri --.

Column 16,
Line 8, “polimerization” should read -- polymerization --; and
Line 20, “cumen” should read -- cumene --.

Column 17,
Line 47, “fumalic” should read -- fumaric --; and
Line 64, “n-dodesenylglutamic” should read -- n-dodecenylglutamic --.

Column 19,
Line 7, “saponificated” should read -- saponified --;
Line 22, “molecular” should read -- molecule --;
Line 25, “-t-(butylpaeoxy)” should read -- -t-(butylperoxy) --;
Line 28, “-abutylester,” should read -- butylester, --; and
Line 53, “benzoilperoxide” should read -- benzoylperoxide --.

Column 20,
Line 30, “trethyleneglycol” should read -- triethyleneglycol --; and
Line 41, “pentaerysuritol” should read -- pentaerythritol --.

UNITED STATES PATENT AND TRADEMARK OFFICE

CERTIFICATE OF CORRECTION

PATENT NO. : 6,447,970 B1
DATED : September 10, 2002
INVENTOR(S) : Matsunaga et al.

It is certified that error appears in the above-identified patent and that said Letters Patent is hereby corrected as shown below:

Column 23,
Line 4, “Nable” should read -- Naples --;
Line 5, “Hanzai” should read -- Nansa --;
Line 5, “Rake,” should read -- Lake, --;
Line 7, “Banzidine” should read -- Benzidine --;
Line 10, “Rake,” (both occurrences) should read -- Lake, --;
Line 11, “Rake,” should read -- Lake, --;
Line 11, “Indanthlene” should read -- Indanthrene --; and
Line 12, “Marakite” should read -- Malachite --;

Column 24,
Line 17, “phthalocyanye” should read -- phthalocyanine --.

Column 25,
Line 31, “silicon” should read -- silicone --;
Line 64, “aryldimetghylchlorsilane” should read -- aryldimethylchlorsilane --; and
Line 66, “brommethyldimethylchlorsilane,” should read
-- bromomethyldimethylchlorsilane, --.

Column 26,
Line 4, “diphenyldietoxysilane,” should read -- diphenyldiethoxysilane, --; and
Line 6, “diphenyltetramethylsidiloxane,” should read
-- diphenyltetramethyldisiloxane --; and
Line 62, “polytetrafluoroetylene;” should read -- polytetrafluoroethylene; --.

Column 27,
Line 28, “selenium” should read -- selenium, --;
Line 57, “images” should read -- image --.

Column 28,
Lines 4, 27 and 65, “images” should read -- image --;
Line 46, “a” should read -- an --; and
Line 62, “image.” should read -- image is used. --;

Column 29,
Line 26, “contains” should read -- contain --;
Line 28, close up right margin;
Line 29, close up left margin; and
Line 39, “is” should read -- are --.

UNITED STATES PATENT AND TRADEMARK OFFICE

CERTIFICATE OF CORRECTION

PATENT NO. : 6,447,970 B1
DATED : September 10, 2002
INVENTOR(S) : Matsunaga et al.

It is certified that error appears in the above-identified patent and that said Letters Patent is hereby corrected as shown below:

Column 30,
Line 22, “melanin” should read -- melamine --; and
Line 44, “decrease” should read -- decreases the charge of --.

Column 32,
Line 17, “generationi” should read -- generation --;
Line 43, “having of” should read -- which is --;
Line 44, “sheet,” should read -- sheets, --; and
Line 45, “telephthalate),” should read -- terephthalate), --.

Column 35,
Line 46, “Parkin Elmer” should read -- Perkin-Elmer --.

Column 40,
Line 38, “Stearyle” should read -- Stearyl --.

Column 41,
Line 13, “Atom of Aluminum” should read -- Mole of Aluminum Atom --; and
Line 60, “toner” should read -- toners --.

Column 43,
Line 55, “parts” should read -- part --.

Column 46,
Line 57, “measure” should read -- measured --.

Column 47,
Line 26, “Boron” should read -- boron) --.

Column 55,
Line 51, “of” should be deleted.

Column 56,
Line 7, “Smeltering” should read -- Smelter --; and
Line 24, “toner” should read -- toners --.

UNITED STATES PATENT AND TRADEMARK OFFICE

CERTIFICATE OF CORRECTION

PATENT NO. : 6,447,970 B1
DATED : September 10, 2002
INVENTOR(S) : Matsunaga et al.

It is certified that error appears in the above-identified patent and that said Letters Patent is hereby corrected as shown below:

Column 57,
Line 2, “of which” should read -- whose --;
Line 56, “Myler” should read -- Mylar --; and
Line 60, “Myler tap” should read -- Mylar tape --.

Column 58,
Line 3, “of which” should read -- whose --.

Signed and Sealed this

First Day of April, 2003

JAMES E. ROGAN
*Director of the United States Patent and Trademark Office*